US011854332B2

(12) United States Patent
Enomoto

(10) Patent No.: US 11,854,332 B2
(45) Date of Patent: Dec. 26, 2023

(54) COIN DISTRIBUTION MECHANISM AND APPARATUS FOR DISCRIMINATING AND CONVEYING COINS

(71) Applicant: ASAHI SEIKO CO., LTD., Tokyo (JP)

(72) Inventor: Minoru Enomoto, Saitama (JP)

(73) Assignee: ASAHI SEIKO CO., LTD., Tokyo (JP)

( * ) Notice: Subject to any disclaimer, the term of this patent is extended or adjusted under 35 U.S.C. 154(b) by 404 days.

(21) Appl. No.: 17/116,311

(22) Filed: Dec. 9, 2020

(65) Prior Publication Data

US 2021/0201615 A1 Jul. 1, 2021

(30) Foreign Application Priority Data

Dec. 25, 2019 (JP) ..... 2019-235310

(51) Int. Cl.

| | |
|---|---|
| ***G07D 3/14*** | (2006.01) |
| ***G07D 3/12*** | (2006.01) |
| ***G07D 5/02*** | (2006.01) |

(52) U.S. Cl.

CPC ..... *G07D 3/14* (2013.01); *G07D 3/128* (2013.01); *G07D 5/02* (2013.01); *G07D 2205/00* (2013.01)

(58) Field of Classification Search

CPC ..... G07D 3/14; G07D 3/128; G07D 5/02; G07D 2201/00; G07D 2205/00

(Continued)

(56) References Cited

U.S. PATENT DOCUMENTS 3,978,962 A * 9/1976 Gregory, Jr. ..... G07D 5/005 194/328
4,413,718 A * 11/1983 Dean ..... G07D 5/00 194/344

(Continued)

FOREIGN PATENT DOCUMENTS

CN 101714269 A * 5/2010 ..... G07D 5/02
DE 9306231 7/1993

(Continued)

OTHER PUBLICATIONS

Official communication received in European Patent Application No. 20213261.9, dated May 26, 2021.

(Continued)

*Primary Examiner* — Terrell H Matthews
(74) *Attorney, Agent, or Firm* — GREENBLUM & BERNSTEIN, P.L.C.

(57) ABSTRACT

A coin distribution mechanism for distributing coins into their denominations during conveyance is provided, which makes it possible to distribute two desired denominations of coins using a single gate member. A first gate member movable around a first axis is provided below a coin conveyance path. The first gate member is moved by a first position switching device among a default position where a gate is closed, a first switched position that allows a coin to drop through the gate to move in a first direction, or a second switched position that allows a coin to drop through the gate to move in a second direction. When a coin has a first (or second) denomination, the first gate member is moved to the first (or second) switched position. When a coin does not have the first and second denominations, the first gate member is located at the default position.

15 Claims, 51 Drawing Sheets

(58) Field of Classification Search
USPC ..... 209/680
See application file for complete search history.

(56) References Cited

U.S. PATENT DOCUMENTS

| | | | | | |
|---|---|---|---|---|---|
| 5,042,635 | A * | 8/1991 | Bell | G07D 3/14 194/317 |
| 5,167,314 | A * | 12/1992 | Levasseur | G07D 3/14 453/3 |
| 5,496,212 | A * | 3/1996 | Meyer-Weingartner | G07F 1/04 453/4 |
| 5,813,509 | A * | 9/1998 | Boxall | G07D 5/00 194/346 |
| 2021/0201615 | A1 * | 7/2021 | Enomoto | G07D 9/008 |

FOREIGN PATENT DOCUMENTS

| | | | | |
|---|---|---|---|---|
| DE | 9306231 | U1 * | 8/1993 | G07F 1/04 |
| EP | 3407311 | | 11/2018 | |
| EP | 3407711 | A1 * | 12/2018 | A01M 1/06 |
| JP | 5-114066 | | 5/1993 | |
| JP | 2007328660 | A * | 12/2007 | |
| JP | 4997374 | | 5/2012 | |
| JP | 4997374 | B2 * | 8/2012 | G07D 3/14 |
| JP | 5760233 | | 6/2015 | |
| JP | 5760233 | B2 * | 8/2015 | |
| JP | 2016042333 | A * | 3/2016 | |
| JP | 2018-198010 | | 12/2018 | |
| JP | 2018198010 | A * | 12/2018 | G07D 3/02 |
| JP | 2019-057269 | | 4/2019 | |
| JP | 2019057269 | A * | 4/2019 | |

OTHER PUBLICATIONS

Official communication received in Chinese Patent Application No. 202011560626.X, dated Jun. 29, 2022, with an English translation thereof.

Official communication received in Japanese Patent Application No. 2019-235310, dated Jun. 28, 2022, with an English translation thereof.

* cited by examiner

FIG. 25A
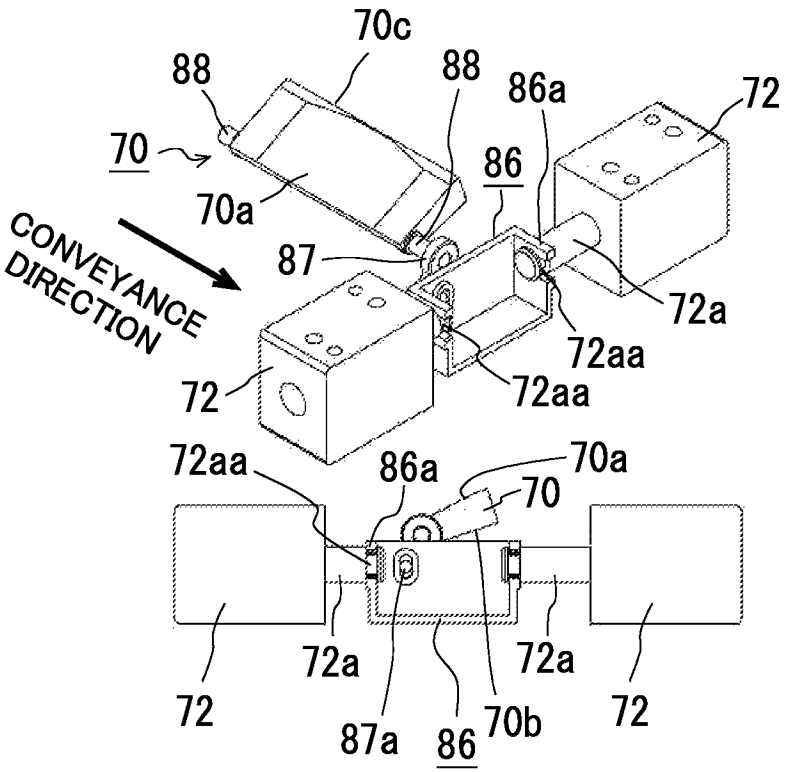
FIG. 25B
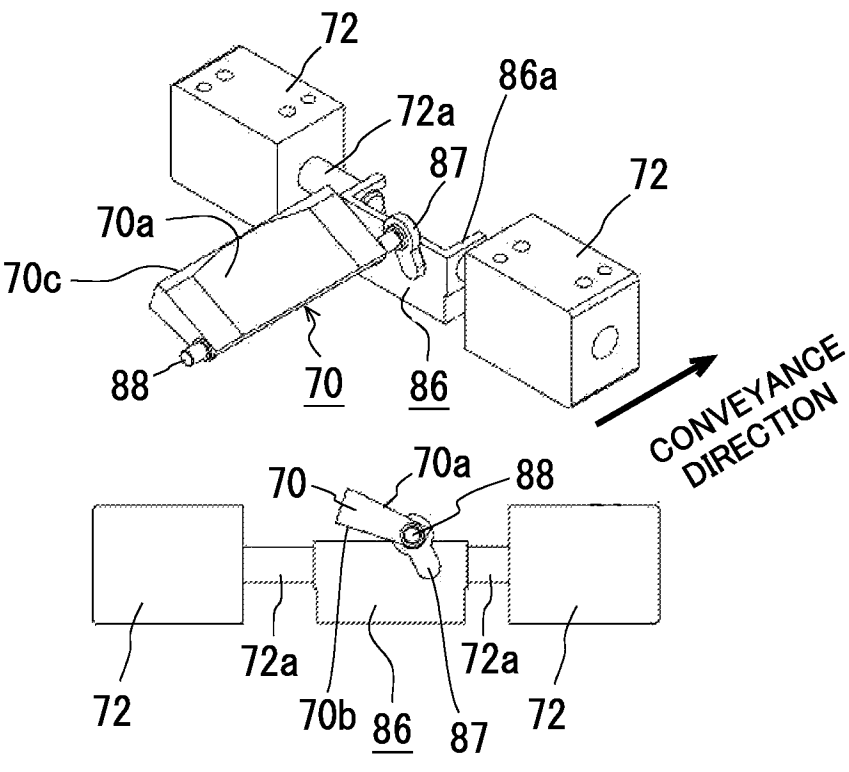
FIG. 25C
FIG. 25D

INTERNAL STRUCTURE OF
FIRST DISTRIBUTION SECTION D1

INTERNAL STRUCTURE OF SECOND, THIRD, AND FOURTH DISTRIBUTION SECTIONS D2, D3, AND D4

DISTRIBUTION TO REAR HOPPER IN FIRST DISTRIBUTION SECTION D1 (1/4)

DISTRIBUTION TO REAR HOPPER IN FIRST DISTRIBUTION SECTION D1 (2/4)

DISTRIBUTION TO REAR HOPPER IN FIRST DISTRIBUTION SECTION D1 (3/4)

DISTRIBUTION TO REAR HOPPER IN FIRST DISTRIBUTION SECTION D1 (4/4)

DISTRIBUTION TO FRONT HOPPER IN FIRST DISTRIBUTION SECTION D1 (1/4)

DISTRIBUTION TO FRONT HOPPER IN FIRST DISTRIBUTION SECTION D1 (2/4)

DISTRIBUTION TO FRONT HOPPER IN FIRST DISTRIBUTION SECTION D1 (3/4)

DISTRIBUTION TO FRONT HOPPER IN FIRST DISTRIBUTION SECTION D1 (4/4)

DISTRIBUTION TO REAR HOPPER IN SECOND, THIRD, AND FOURTH DISTRIBUTION SECTIONS D2, D3, AND D4

DISTRIBUTION TO FRONT HOPPER IN SECOND, THIRD, AND FOURTH DISTRIBUTION SECTIONS D2, D3, AND D4

DISTRIBUTION TO DISPENSING TRAY IN FIRST DISTRIBUTION SECTION D1 (1/3)

DISTRIBUTION TO DISPENSING TRAY IN FIRST DISTRIBUTION SECTION D1 (2/3)

DISTRIBUTION TO DISPENSING TRAY IN FIRST DISTRIBUTION SECTION D1 (3/3)

DISTRIBUTION IN CASE OF OVERFLOW (1/2)

DISTRIBUTION IN CASE OF OVERFLOW (2/2)

COIN DISTRIBUTION MECHANISM AND APPARATUS FOR DISCRIMINATING AND CONVEYING COINS

BACKGROUND OF THE INVENTION

1. Field of the Invention

The present invention relates to a coin distribution mechanism and an apparatus for discriminating and conveying coins equipped with the one or more coin distribution mechanisms. More particularly, the present invention relates to a coin distribution mechanism that is configured to distribute coins that are conveyed on a coin conveyance path into their denominations, and an apparatus for discriminating and conveying coins that includes the one or more coin distribution mechanisms.

In this specification, the term "coin" has a wide meaning that includes not only coins as currency but also coin equivalents such as tokens and medals other than coins as currency, in which the shape of a "coin" is not limited to a circular one and may be a polygonal or any other one.

2. Description of the Related Art

Conventionally, apparatuses for discriminating and conveying coins that are configured to automatically conduct the separation and discrimination operations of coins which are stored in a coin storage section and the subsequent conveyance and distribution operations of the coins thus separated and discriminated have been known. For example, Japanese Examined Patent Publication No. 5760233 issued on Jun. 19, 2015 discloses a coin depositing/dispensing apparatus, which comprises a coin separation section using a rotary disk (a rotary plate), a denomination discrimination section using a rotary wiper (a rotor), and a coin conveyance and distribution section using an endless belt and a guide rail. The coin separation section, the denomination discrimination section, and the coin conveyance and distribution section are aligned, in other words, arranged linearly, in which coins to be processed are conveyed along an approximately straight line (in approximately the same direction) in a horizontal plane when seeing macroscopically. The coin conveyance and distribution section comprises distribution sections that are arranged along the conveyance direction of the coins, in which the total number of the distribution sections is set to be correspondent to the total number of the denominations to be processed. The coin conveyance and distribution section is configured in such a way that the respective coins are distributed according to their denominations while being successively conveyed through the distribution sections.

With the typical structure of the coin conveyance and distribution section of the coin depositing/dispensing apparatus disclosed in the aforementioned Publication No. 5760233, coins of "one relevant denomination" are distributed in each of the distribution sections. An example of the distribution sections of this type is shown in the coin processing apparatus (the coin depositing/dispensing apparatus) disclosed in Japanese Unexamined Patent Publication No. 2019-057269 issued on Apr. 11, 2019. For example, in the case where coins of eight denominations are processed, eight distribution sections are provided in the coin conveyance and distribution section, and coins of "one relevant denomination" are distributed in each of the eight distribution sections. The coin processing apparatus (the coin depositing/dispensing apparatus) of Publication No. 2019-057269 is configured in such a way that coins of one relevant denomination, which have been discriminated by the coin discrimination section as target coins to be counted, are conveyed to a first coin dispensing box, and coins of another relevant denomination, which have been discriminated by the coin discrimination section as non-target coins, are conveyed to a second coin dispensing box.

On the other hand, the structure for distributing coins of "two relevant denominations" in each of the distribution sections is also known. In this structure, for example, as shown in Japanese Examined Patent Publication No. 4997374 issued on May 25, 2012 and Japanese Unexamined Patent Publication No. 2018-198010 issued on Dec. 13, 2018, two or more gate members are provided in each of the distribution sections. The operations of the two or more gate members are individually controlled in such a way as to open or close the corresponding gates, thereby distributing the "two relevant denominations" in each of the distribution sections.

Specifically, with the coin distribution apparatus disclosed in the aforementioned Publication No. 4997374, each of the distribution sections comprises a second opening that is closable by a corresponding second gate member (a movable guide rail) in addition to a first opening that is closable by a corresponding first gate member, in which the first and second openings are disposed adjacent to each other. Coins of a relevant denomination are distributed by opening or closing the first opening using the corresponding first gate member, and coins of another relevant denomination are distributed by opening or closing the second opening using the corresponding second gate member (the movable guide rail). In this way, with the apparatus of the aforementioned Publication No. 4997374, coins of "two" relevant denominations can be distributed or sorted in each of the distribution sections.

With the coin dividing apparatus disclosed in the aforementioned Publication No. 2018-198010, there are provided with first and second dividing members (first and second gate members) that are configured to divide coins from a conveyance path, and a driving part that is configured to set each of the first and second dividing members at one of a first state where the coins are guided in the downstream direction of the conveyance path, a second state where the coins are guided in a first direction for dropping the coins from the conveyance path, and a third state where the coins are guided in a second direction which is different from the downstream direction and the first direction. By displacing the first gate member and the second gate member using the driving part, one of the first, second, and third states can be selectively formed. In this way, with the apparatus of the aforementioned Publication No. 2018-198010, coins of "two" relevant denominations can be distributed or sorted in each of the distribution sections.

As disclosed in the aforementioned Publication No. 4997374 and Publication No. 2018-198010, it is possible to distribute coins of "two relevant denominations" to sort the coins of the said two denominations during conveyance by providing two gate members in each of the distribution sections of the coin conveyance and distribution section in the coin depositing/dispensing apparatus of the aforementioned Publication No. 5760233 and by separately controlling the operations of the said two gate members. However, the two gate members are provided in each of the distribution sections and thus, two driving mechanisms need to be provided for driving the said two gate members. This means that a control program for separately controlling the operations of the two driving mechanisms is inevitably complicated. In other words, when the two gate members are provided in each of the distribution sections, not only the mechanical configuration of each distribution mechanism but also the control program therefor are complicated and therefore, providing the two gate members in each of the distribution sections is disadvantageous from the viewpoint of the fabrication cost and the maintenance.

In addition, since the total number of the distribution sections of the coin conveyance and distribution section of the aforementioned Publication No. 5760233 needs to be set in accordance with the total number (e.g., eight) of the denominations to be processed, both of the overall mechanical configuration of the coin conveyance and distribution section and the control programs therefor are complicated and therefore, the aforementioned disadvantageous situation will be conspicuous furthermore.

Furthermore, in recent years, further downsizing and/or space saving with respect to apparatuses for discriminating and conveying coins has been strongly required. Thus, it is an urgent need to simplify the mechanical configuration of the individual distribution section including a driving mechanism therefor.

SUMMARY OF THE INVENTION

The present invention was created while taking the aforementioned circumstances into consideration.

Accordingly, an object of the present invention is to provide a coin distribution mechanism that makes it possible to distribute two desired denominations of coins using a single gate member.

Another object of the present invention is to provide a coin distribution mechanism that is simpler in mechanical configuration and driving mechanism than the aforementioned conventional coin distribution mechanisms where two desired denominations are distributed using two gate members, that is easy in reducing the fabrication cost and facilitating the maintenance, and that is easy in producing control program for a driving mechanism and version up thereof.

Still another object of the present invention is to provide an apparatus for discriminating and conveying coins that can easily meet the recent requirement for downsizing and/or space saving through the size reduction of each of the distribution sections.

The above objects together with others not specifically mentioned here will become clear to those skilled in the art from the following description.

(1) According to a first aspect of the present invention, a mechanism for distributing coins into their denominations during conveyance is provided, which comprises:

a coin conveyance path having a gate for dropping coins;

a first gate member (e.g., a distribution flap) that is placed below the gate in a vicinity of the coin conveyance path and that is configured to be movable around a first axis; and a first position switching device (e.g., a distribution flap driving mechanism including a solenoid) that is configured to switch a position of the first gate member by moving the first gate member around the first axis;

wherein the first gate member is configured to be movable among (i) a default position where the gate is closed, (ii) a first switched position where the gate is opened to allow a coin to drop from the coin conveyance path through the gate, thereby moving the dropped coin in a first direction, and (iii) a second switched position where the gate is opened to allow a coin to drop from the coin conveyance path through the gate, thereby moving the dropped coin in a second direction which is different from the first direction;

when a coin that is conveyed on the coin conveyance path to be about to reach the gate has a denomination equal to a predetermined first denomination, the first gate member is moved from the default position to be located at the first switched position by the first position switching device, thereby allowing the coin to drop from the coin conveyance path through the gate in the first direction;

when a coin that is conveyed on the coin conveyance path to be about to reach the gate has a denomination equal to a predetermined second denomination which is different from the first denomination, the first gate member is moved from the default position to be located at the second switched position by the first position switching device, thereby allowing the coin to drop from the coin conveyance path through the gate in the second direction; and when a coin that is conveyed on the coin conveyance path to be about to reach the gate has a denomination unequal to the first denomination nor the second denomination, the first gate member is kept at the default position, thereby allowing the coin to pass through the gate without dropping from the coin conveyance path through the gate.

With the mechanism according to the first aspect of the present invention, as described above, the first gate member, which is provided below the gate in the vicinity of the coin conveyance path, is configured to be movable among the default position, the first switched position, and the second switched position. Thus, by switching the position of the first gate member among the default position, the first switched position, and the second switched position in accordance with a desired denomination using the first position switching device, it is possible to allow a coin that is conveyed on the coin conveyance path to be about to reach the gate to drop from the coin conveyance path through the gate in the first direction or the second direction, or to pass through the gate without dropping from the coin conveyance path through the gate.

Accordingly, two desired denominations of coins can be distributed by switching the position of the first gate member as a single gate member in accordance with each of the two denominations (i.e., the first and second denominations). This means that the same function as that of the conventional coin distribution mechanisms disclosed in the aforementioned Publication No. 4997374 and Publication No. 2018-198010 where two gate members are provided for distributing coins of two desired denominations can be realized using the first gate member as a single gate member.

Moreover, since the function of distributing coins of the two denominations (i.e., the first and second denominations) in the different directions (i.e., the first and second directions) is realized using the first gate member as a single gate member, the coin distribution mechanism according to the first aspect of the present invention is simpler in mechanical configuration and driving mechanism than the aforementioned conventional coin distribution mechanisms disclosed in the aforementioned Publication No. 4997374 and Publication No. 2018-198010 where two desired denominations are distributed in different directions using two gate members. In addition, the coin distribution mechanism according to the first aspect of the present invention is easy in reducing the fabrication cost and facilitating the maintenance and is easy in producing the control program for the driving mechanism (i.e., the first position switching device) and version up thereof.

(2) In a preferred embodiment of the mechanism according to the first aspect of the present invention, at the default position, the gate is closed by the first gate member in such a way that an end of the first gate member is contacted with the gate;

at the first switched position, the gate is opened in such a way that the end of the first gate member is apart from the gate, and a first face (e.g., a side face) of the first gate member serves as a guiding face for guiding a coin that has dropped through the gate in the first direction; and at the second switched position, the gate is opened in such a way that the end of the first gate member is apart from the gate, and a second face (e.g., another side face) of the first gate member serves as a guiding face for guiding a coin that has dropped through the gate in the second direction.

(3) In another preferred embodiment of the mechanism according to the first aspect of the present invention, the first axis for the first gate member is disposed in a vicinity of the gate so as to extend along a conveyance direction of the coin conveyance path;

a moving direction of the first gate member around the first axis when the first gate member is switched to the second switched position from the default position is opposite to a moving direction of the first gate member around the first axis when the first gate member is switched to the first switched position from the default position.

(4) In still another preferred embodiment of the mechanism according to the first aspect of the present invention, a chute member is provided below the first gate member; and the chute member is configured to guide a coin that has dropped through the gate toward a desired container (e.g., a hopper) when the first gate member is switched to the first switched position or the second switched position from the default position.

(5) In a further preferred embodiment of the mechanism according to the first aspect of the present invention, the first position switching device comprises a reciprocating motion generating device (e.g., a solenoid) that is configured to reciprocate an operating part (e.g., a plunger) in a direction approximately perpendicular to the first axis; and a crank mechanism that is configured to convert a reciprocating motion of the operating part of the reciprocating motion generating device to a pivoting motion around the first axis and to transmit the pivoting motion to the first gate member.

(6) In a further preferred embodiment of the mechanism according to the first aspect of the present invention, there are provided with a second gate member (e.g., a rejection flap) that is placed below the gate in a vicinity of the coin conveyance path and that is configured to be movable around a predetermined second axis; and a second position switching device (e.g., a rejection flap driving mechanism including a solenoid) that is configured to switch a position of the second gate member by moving the second gate member around the second axis;

wherein the second gate member is configured to allow a coin that has dropped from the coin conveyance path through the gate to move in the second direction or a third direction according to a denomination of the coin when the first gate member is located at the second switched position; and the third direction is different from the first direction and the second direction.

(7) In a further preferred embodiment of the mechanism according to the first aspect of the present invention, the second gate member is configured to be movable between (a) a default position where a moving path for allowing a coin that has dropped from the coin conveyance path through the gate to move in the third direction is closed, and (b) a switched position where the moving path is opened;

wherein when a coin that is conveyed on the coin conveyance path to be about to reach the gate has a predetermined third denomination which is different from the first denomination and the second denomination, the first gate member is located at the second switched position by the first position switching device and the second gate member is located at the switched position by the second position switching device, thereby allowing the coin that has dropped from the coin conveyance path through the gate to move through the moving path in the third direction; and when a coin that is conveyed on the coin conveyance path to be about to reach the gate has the second denomination, the first gate member is located at the second switched position by the first position switching device and the second gate member is located at the default position by the second position switching device, thereby allowing the coin that has dropped from the coin conveyance path through the gate to move in the second direction.

(8) In a further preferred embodiment of the mechanism according to the first aspect of the present invention, a rejective denomination is designated as the third denomination;

wherein when a coin that is conveyed on the coin conveyance path to be about to reach the gate has the rejective denomination, the first gate member is located at the second switched position and the second gate member is located at the switched position, thereby allowing the coin to drop from the coin conveyance path through the gate to be discharged through the moving path to an outside of an apparatus that comprises the said mechanism.

(9) In a further preferred embodiment of the mechanism according to the first aspect of the present invention, the first gate member is formed by a distribution flap that is configured to be pivotable around the first axis.

(10) In a further preferred embodiment of the mechanism according to the first aspect of the present invention, the first gate member is formed by a distribution flap that is configured to be pivotable around the first axis;

wherein the first position switching device comprises a reciprocating motion generating device that is configured to reciprocate an operating part in a direction approximately perpendicular to the first axis; and the operating part is configured to selectively take one of a middle position where the distribution flap is located at the default position, a protruded position where the distribution flap is located at the first or second switched position, and a retracted position where the distribution flap is located at the second or first switched position.

(11) In a further preferred embodiment of the mechanism according to the first aspect of the present invention, the coin conveyance path is formed by a guide rail, an inclined portion of a front cover, and an inclined portion of a rear cover;

wherein the guide rail forms a bottom of the coin conveyance path, the inclined portion of the front cover forms a front cover of the coin conveyance path, and the inclined portion of the rear cover forms a rear cover of the coin conveyance path;

the gate is formed by an opening which is formed in the guide rail; and a coin is conveyed on the guide rail in an inclined standing state while being contacted with the guide rail and the inclined portion of the front cove or the rear cover; and is dropped through the opening of the guide rail when the first gate member is located at the first switched position or the second switched position.

(12) In a further preferred embodiment of the mechanism according to the first aspect of the present invention, there are provided with an incoming coin sensor that is configured to detect presence or absence of introduction of a coin into the coin conveyance path;

a moving coin sensor that is configured to detect presence or absence of arrival of a coin that is being conveyed on the coin conveyance path at the gate; and a dropping coin sensor that is configured to detect presence or absence of dropping of a coin through the gate from the coin conveyance path.

(13) In a further preferred embodiment of the mechanism according to the first aspect of the present invention, the second gate member is formed by a rejection flap that is configured to be pivotable around the second axis.

(14) In a further preferred embodiment of the mechanism according to the first aspect of the present invention, the second gate member is formed by a rejection flap that is configured to be pivotable around the second axis;

wherein the second position switching device comprises a reciprocating motion generating device that is configured to reciprocate an operating part in a direction approximately perpendicular to the second axis; and the operating part is configured to selectively take one of a first position where the rejection flap is located at the default position, and a second position where the rejection flap is located at the switched position.

(15) According to a second aspect of the present invention, an apparatus for discriminating and conveying coins is provided, which comprises one or more distribution sections mounted in a coin conveyance and distribution unit;

wherein each of the one or more distribution sections comprises the mechanism according to the first aspect of the present invention.

With the apparatus according to the second aspect of the present invention, each of the one or more distribution sections comprises the mechanism according to the first aspect of the present invention and therefore, each of the one or more distribution sections is smaller in size than the aforementioned conventional distribution sections disclosed in the aforementioned Publication No. 4997374 and Publication No. 2018-198010 where two denominations are distributed using two gate members. Accordingly, the recent requirement for downsizing and/or space saving of the apparatus for discriminating and conveying coins can be easily met through the size reduction of each of the one or more distribution sections.

(16) In a preferred embodiment of the apparatus according to the second aspect of the present invention, in a plan view, a macroscopic moving direction of coins to be processed in the coin conveyance and distribution unit has an approximately orthogonal relationship to a macroscopic moving direction of the coins to be processed in a coin separation and discrimination section.

BRIEF DESCRIPTION OF THE DRAWINGS

In order that the present invention may be readily carried into effect, it will now be described in detail with reference to the accompanying drawings.

FIG. 15O is a partial explanatory view showing the coin feeding operation of the coin separation and discrimination unit of the apparatus of FIG. 1, in which the head and the substrate box are detached, which is subsequent to FIG. 15N.

FIG. 25A is a perspective view showing the distribution flap and its driving solenoid provided in each of the first to fourth distribution sections of the coin conveyance and distribution unit of the apparatus of FIG. 1, in which the distribution flap is located at a second switched position, which is seen obliquely downward from the upper right front.

FIG. 25B is a perspective view showing the distribution flap and its driving solenoid of FIG. 25A, which is seen obliquely downward from the upper left front.

FIG. 25C is a right side view showing the distribution flap and its driving solenoid of FIG. 25A.

FIG. 25D is a left side view showing the distribution flap and its driving solenoid of FIG. 25A.

DETAILED DESCRIPTION OF THE INVENTION

Figure 1:
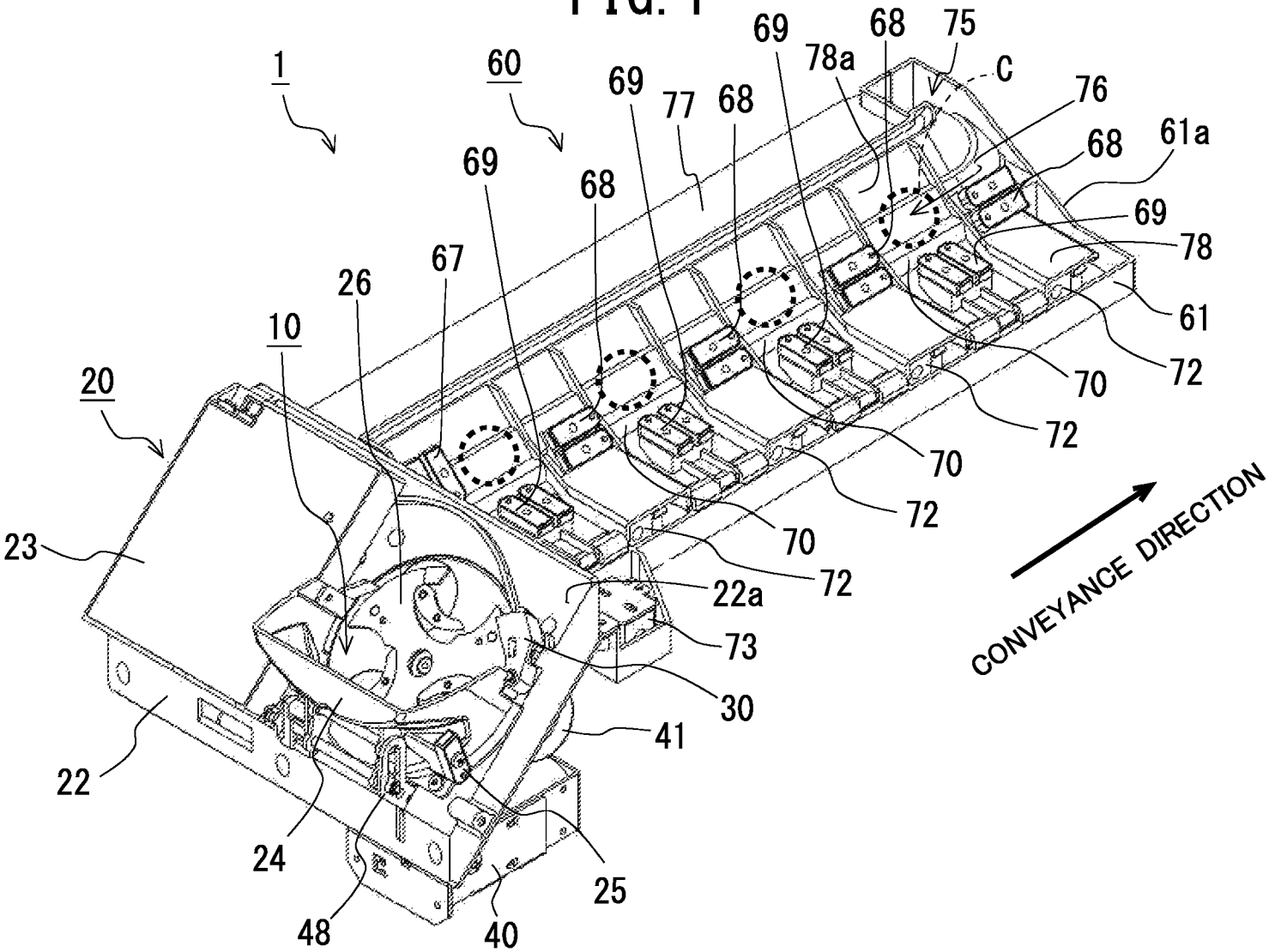
FIG. 1 is a perspective view showing the overall structure of an apparatus for discriminating and conveying coins according to an embodiment of the present invention, which is seen obliquely downward from the upper left front.
Figure 2:
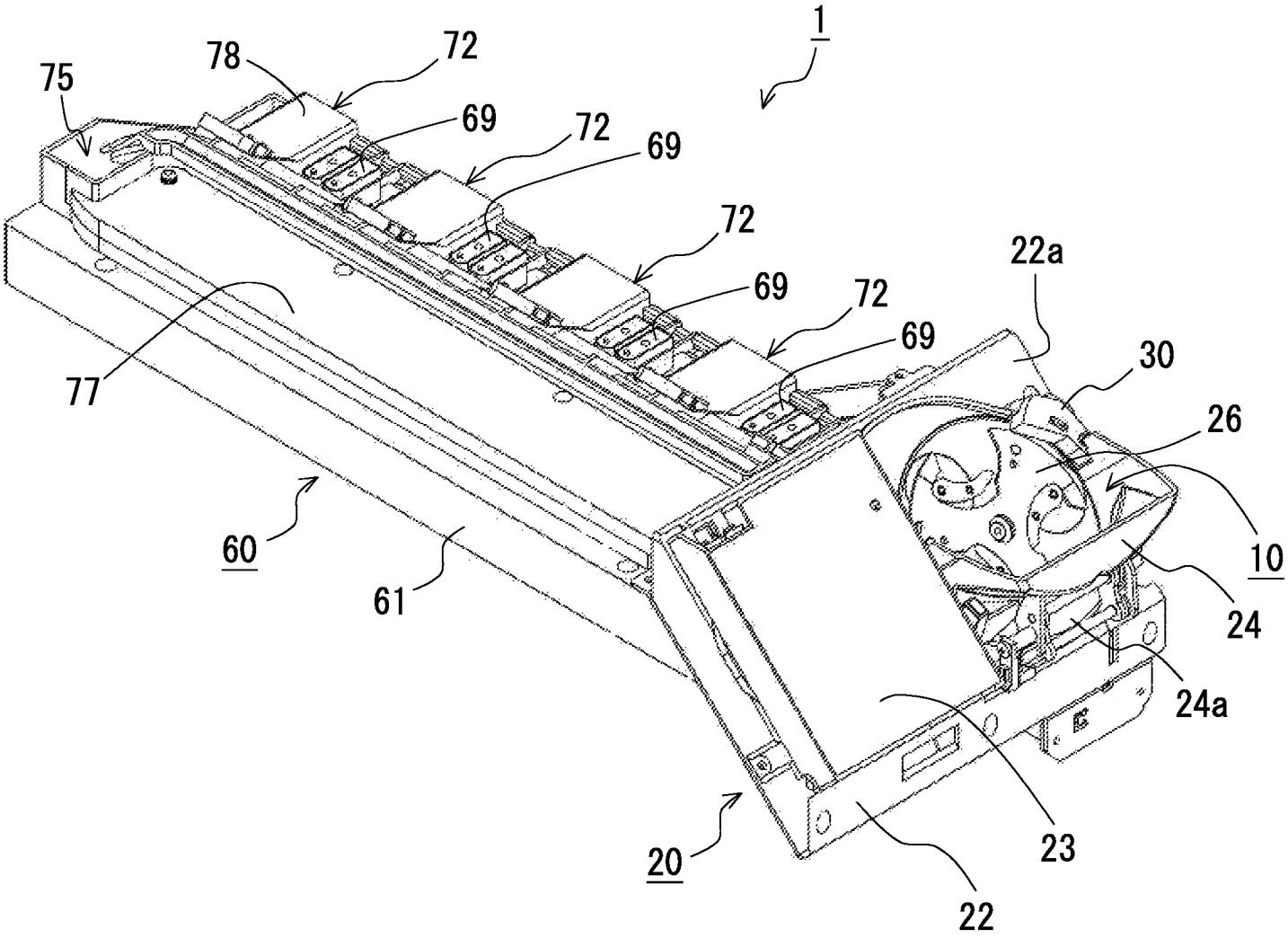
FIG. 2 is a perspective view showing the overall structure of the apparatus of FIG. 1, which is seen obliquely downward from the upper left rear.

Preferred embodiments of the present invention will be described in detail below while referring to the drawings attached.

Structure of Apparatus for Discriminating and Conveying Coins

Figure 21:
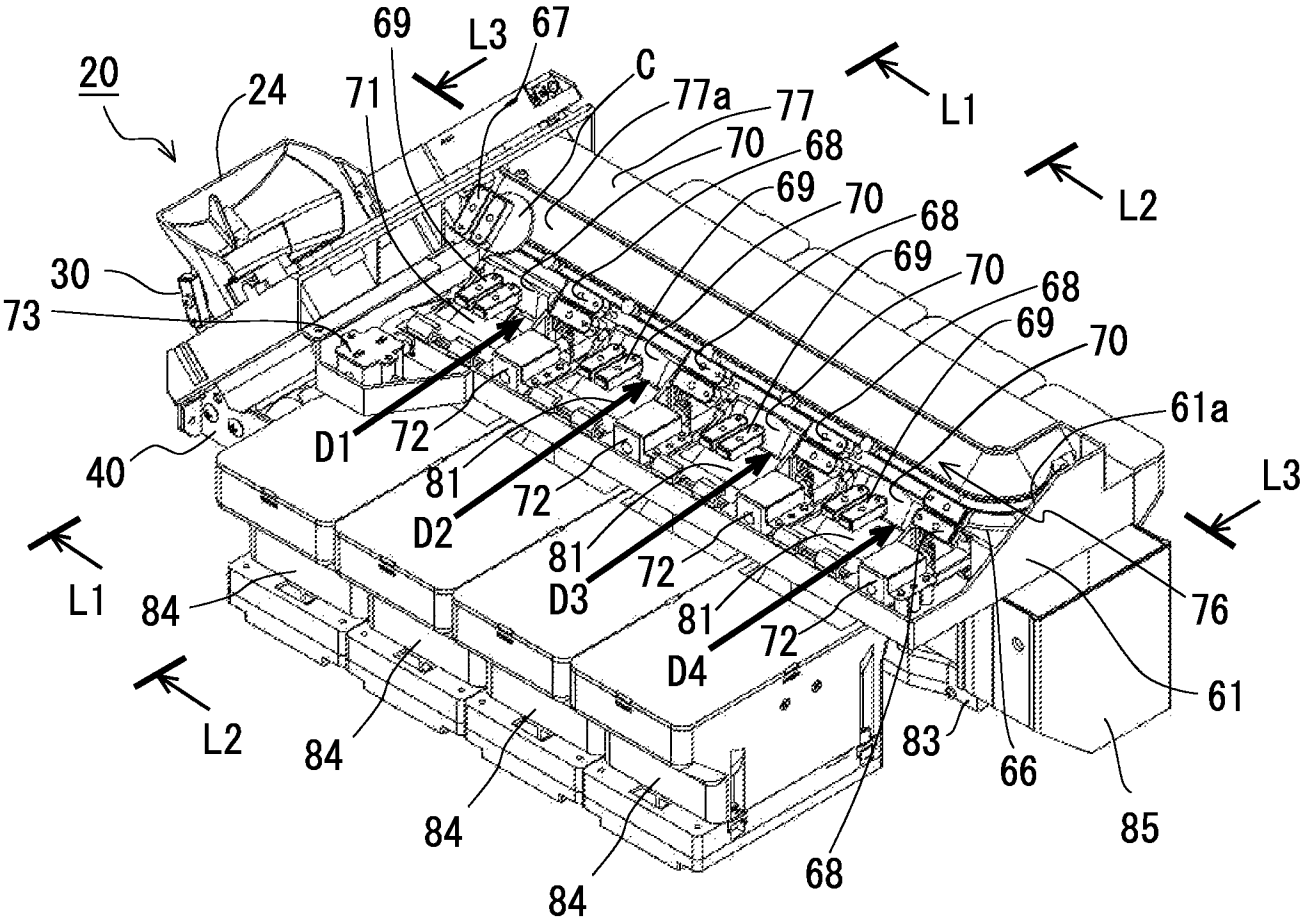
FIG. 21 is a perspective view showing the overall structure of the apparatus of FIG. 1, which is seen obliquely downward from the upper right front, in which front hoppers and rear hoppers are attached to a lower surface of the coin conveyance and distribution unit, and the front cover that covers the upper opening of the sensor and solenoid mounting section of the coin conveyance and distribution unit is removed.
Figure 44:
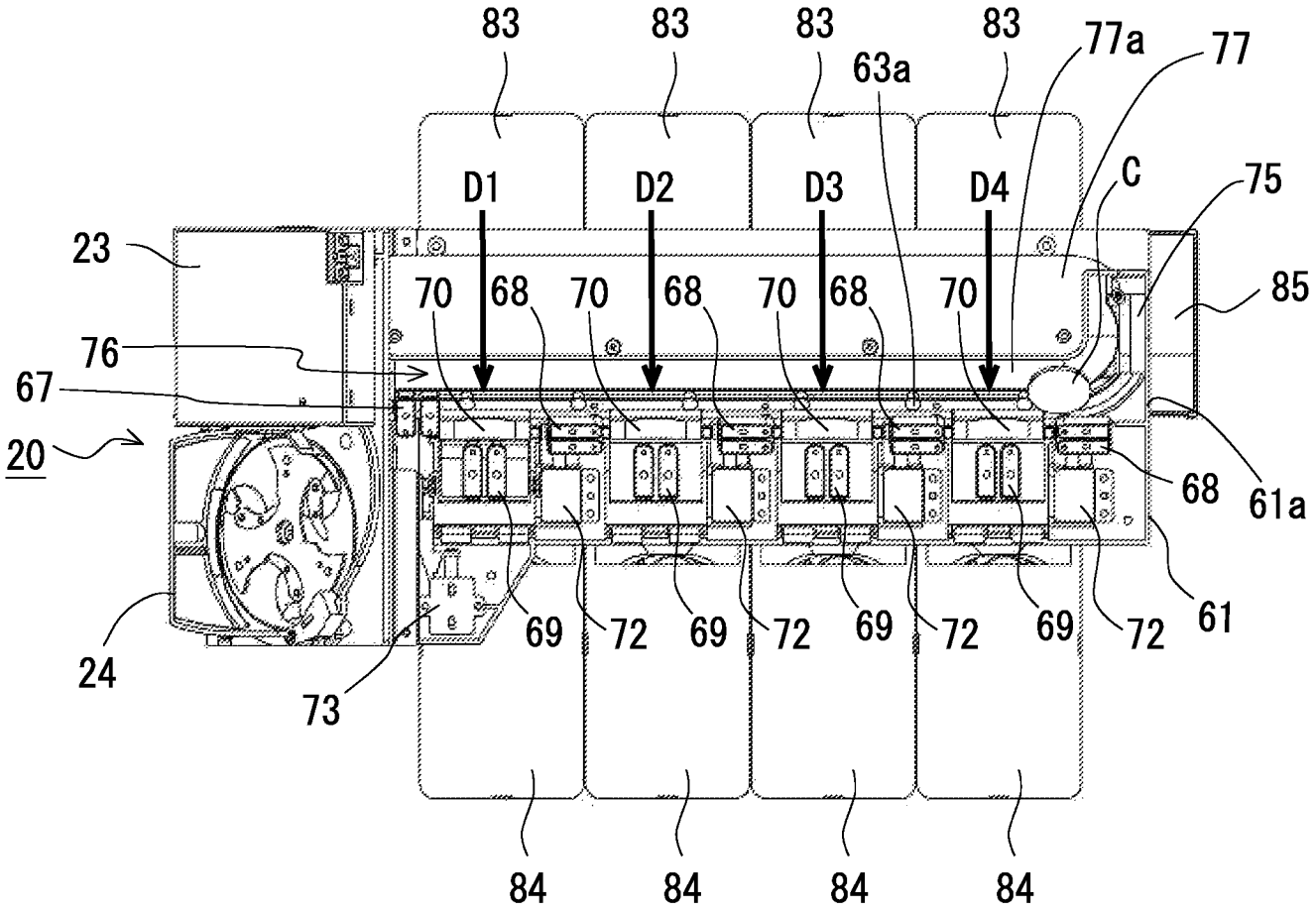
FIG. 44 is a plan view showing the distribution operation of an overflowed coin toward an overflowed coin receiving container in the coin distribution mechanism provided in the first distribution section of the coin conveyance and distribution unit of the apparatus of FIG. 1, in which the front cover that covers the upper opening of the sensor and solenoid mounting section of the coin conveyance and distribution unit is removed, and a relevant coin is conveyed toward an overflow path by the endless belt.

The schematic overall structure of an apparatus 1 for discriminating and conveying coins according to an embodiment of the present invention is shown in FIGS. 1 to 9. The apparatus 1 of this embodiment is configured to conduct the discrimination and conveyance operations for euro coins of eight designated denominations, i.e., 1 cent, 2 cents, 5 cents, 10 cents, 20 cents, 50 cents, 1 euro, and 2 euros. Accordingly, coins C that are distributed into these eight designated denominations during conveyance are separately stored in eight hoppers (coin ejecting devices) in total, that is, four rear hoppers 83 and four front hoppers 84, as shown in FIGS. 21 and 44. In addition, as shown in FIGS. 21 and 44, the apparatus 1 is mounted on an approximately horizontal surface for use, in which the four rear hoppers 83 and the four front hoppers 84 are respectively arranged in two rows at the front and rear sides of a main body 61 along the horizontal surface.

As shown in FIG. 1, the apparatus 1 of this embodiment comprises mainly a coin storage unit 10, a coin separation and discrimination unit 20, and a coin conveyance and distribution unit 60. As clearly shown in FIGS. 12 and 13, a second delivery region P2 is formed at the connecting part of the coin separation and discrimination unit 20 and the coin conveyance and distribution unit 60. In this apparatus 1, a coin C that has already been subjected to the coin separation and the denomination and authentication discrimination in the coin separation and discrimination unit 20 is delivered to a coin conveyance path 76 which is provided in the coin conveyance and distribution unit 60 through the second delivery region P2. The coin separation and discrimination unit 20 is divided into a coin separation section (in which a rotary disk 26 is used) and a coin discrimination section (in which a rotary wiper 27 is used). A first delivery region P1 is formed at the connecting part of the coin separation section and the coin discrimination section. In the coin separation and discrimination unit 20, a coin C that has already been subjected to the coin separation in the coin separation section is delivered to the coin discrimination section through the first delivery region P1. In addition, a coin discrimination region P3 for discriminating the denomination and the authentication of the coin C is formed in the coin discrimination section. In the coin discrimination section, a coin C passes through the coin discrimination region P3 while being rotated and moved along with the rotation of the rotary wiper 27, in which the denomination discrimination and the authentication discrimination of the coin C are performed using a plurality of discrimination sensors 46 which are provided in the coin discrimination region P3.

Figure 4:
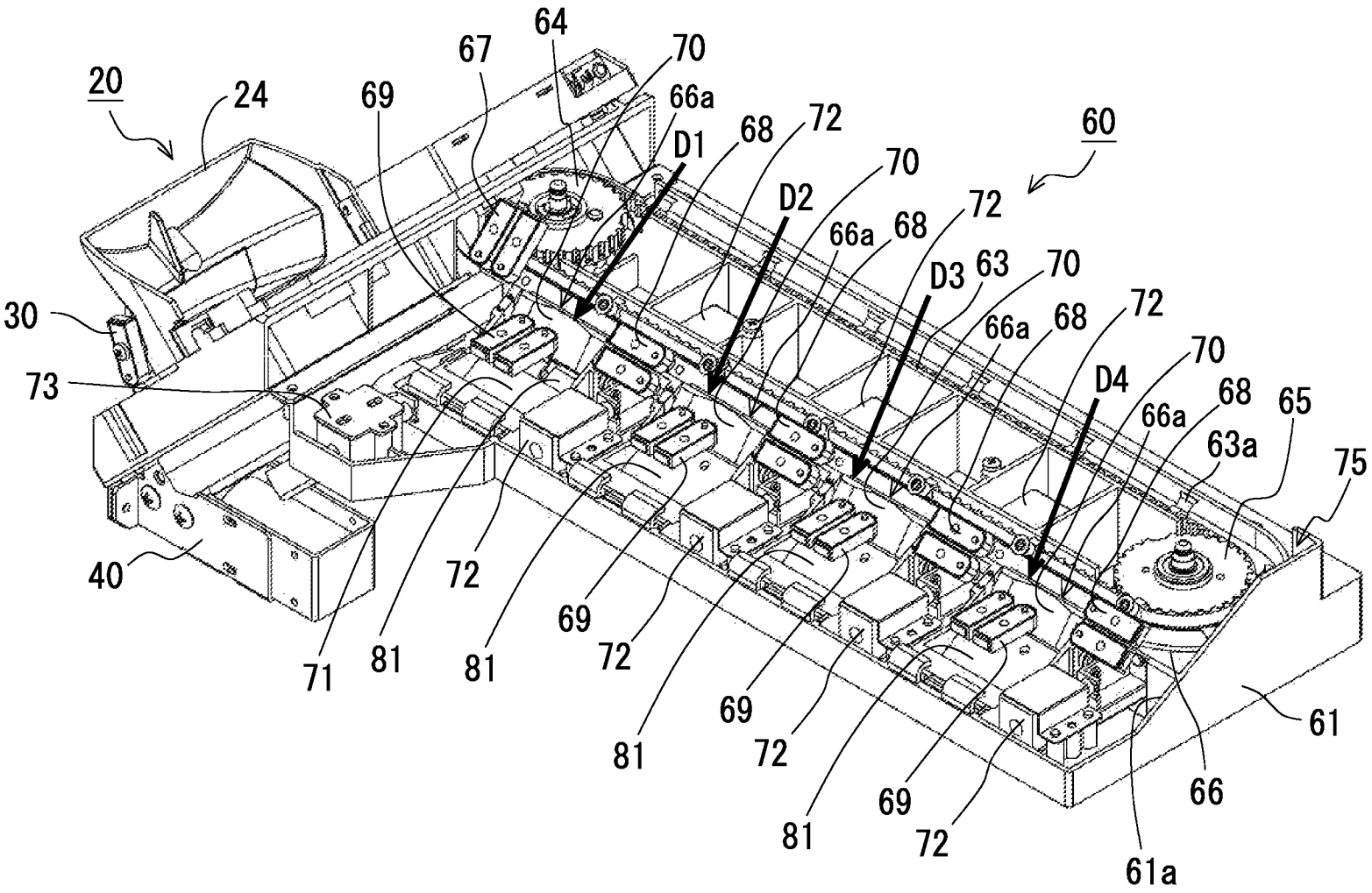
FIG. 4 is a perspective view showing the overall structure of the apparatus of FIG. 1, which is seen obliquely downward from the upper right front, in which a rear cover that covers an upper opening of an endless belt receiving section of a coin conveyance and distribution unit and a front cover that covers an upper opening of a sensor and solenoid mounting section of the coin conveyance and distributing unit are removed.
Figure 5:
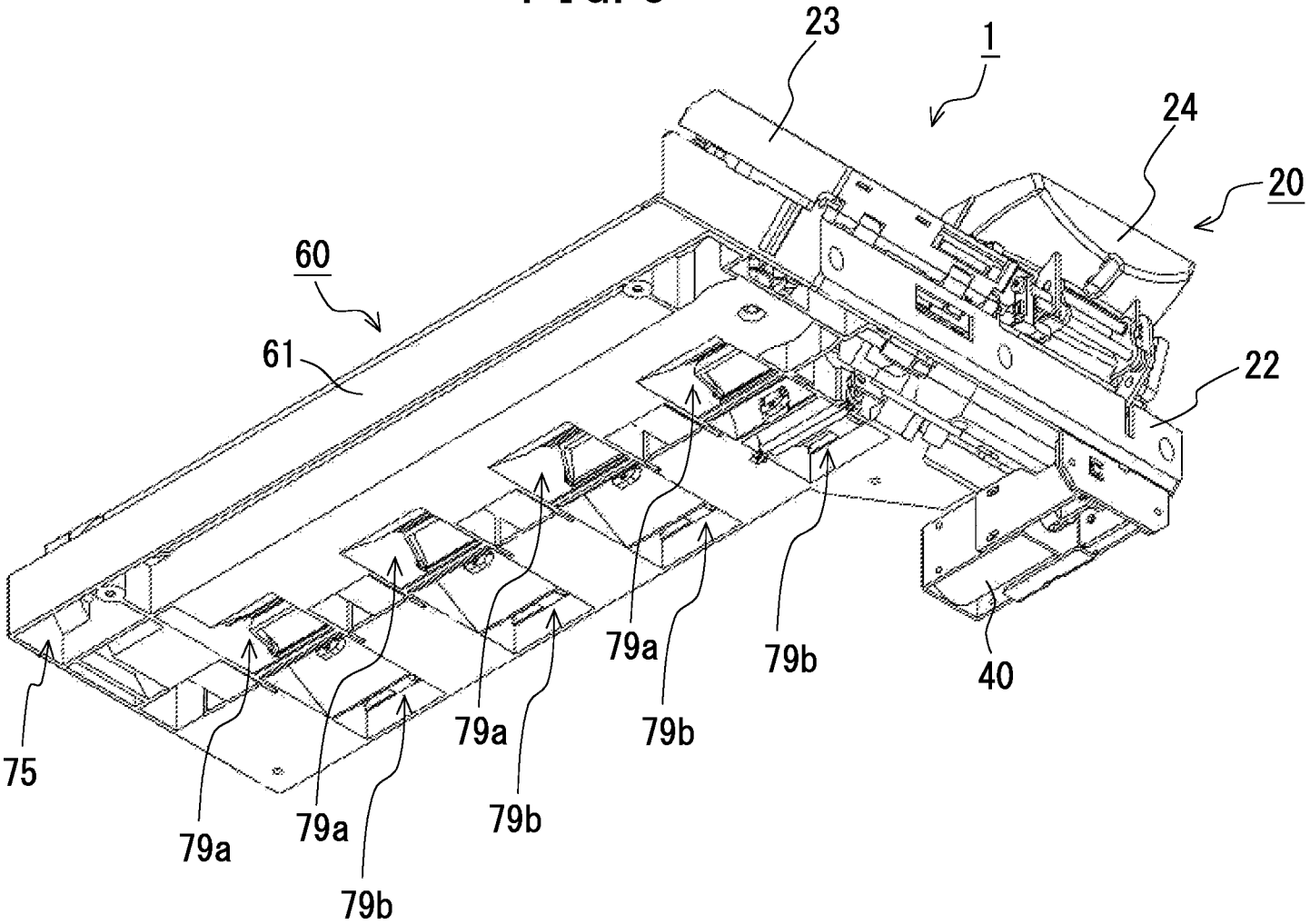
FIG. 5 is a perspective view showing the overall structure of the apparatus of FIG. 1, which is seen obliquely upward from the lower left rear.
Figure 6:
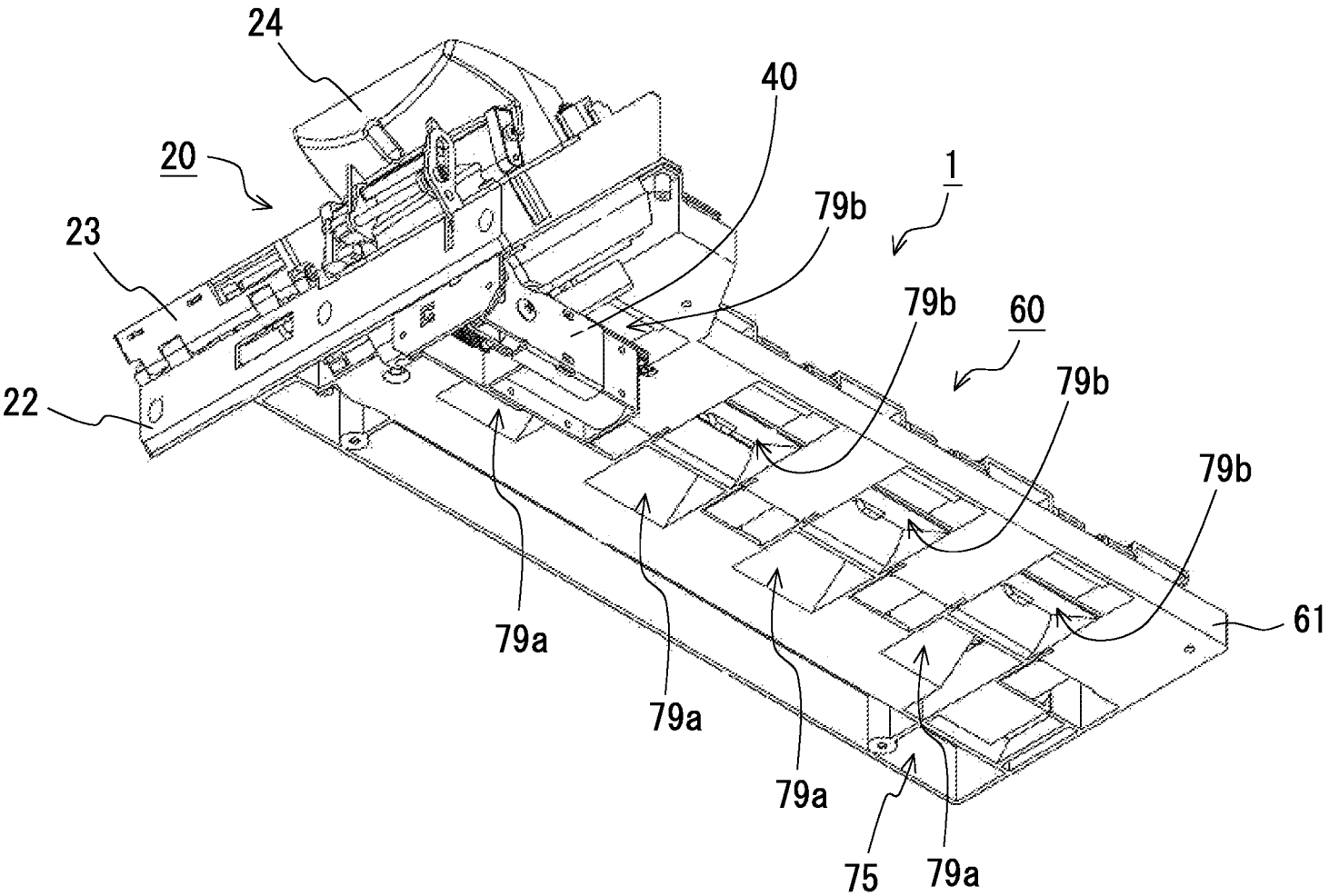
FIG. 6 is a perspective view showing the overall structure of the apparatus of FIG. 1, which is seen obliquely upward from the lower left front.
Figure 7:
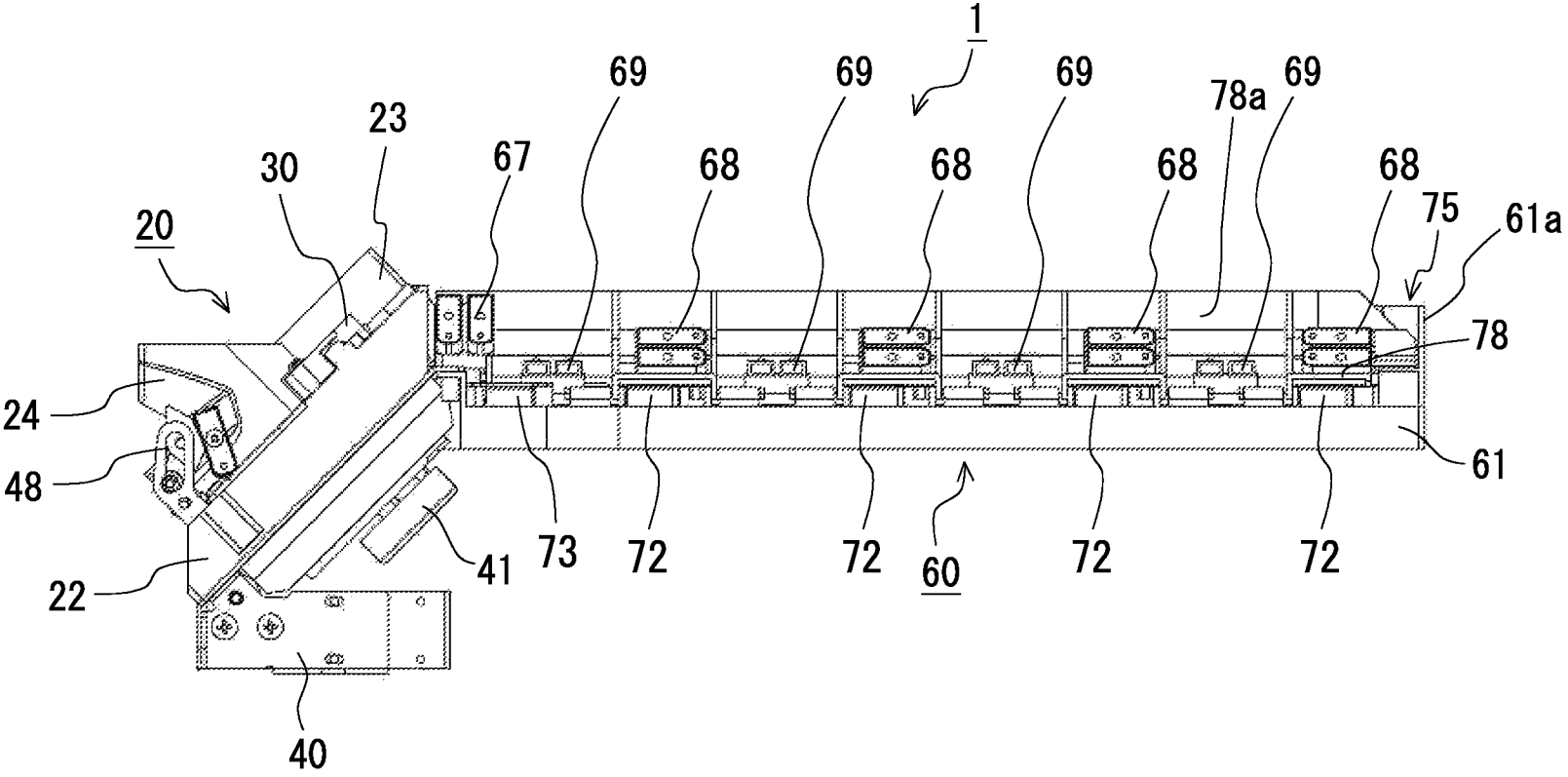
FIG. 7 is a front view showing the overall structure of the apparatus of FIG. 1.
Figure 8:
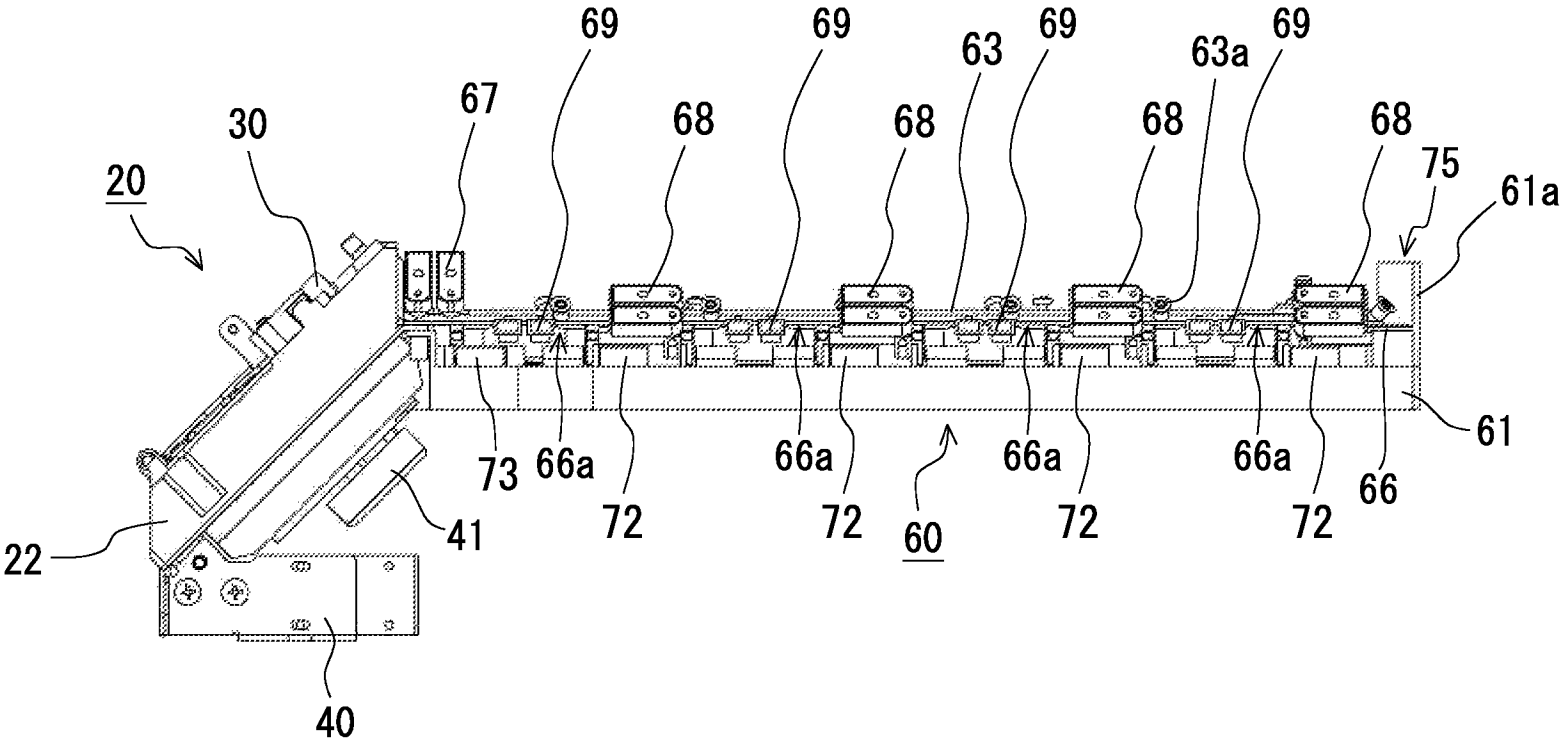
FIG. 8 is a front view showing the overall structure of the apparatus of FIG. 1, in which the rear cover that covers the upper opening of the endless belt receiving section of the coin conveyance and distribution unit, the front cover that covers the upper opening of the sensor and solenoid mounting section of the same unit, and a head and a substrate box of a coin separation and discrimination unit are detached.

In the coin conveyance and distribution unit 60, as shown in FIGS. 4 and 21, the coin conveyance path 76 is provided so as to extend along the conveyance direction of coins C as indicated by an arrow in FIG. 1 for the purpose of conveyance and distribution of the aforementioned euro coins of eight denominations. A first distribution section D1, a second distribution section D2, a third distribution section D3, and a fourth distribution section D4 are provided so as to be arranged along the coin conveyance path 76 in this order from the side of the coin separation and discrimination unit 20. Although details will be explained later, the first distribution section D1 comprises a coin distribution mechanism (i.e., a mechanism for distributing coins C into their denominations during conveyance) which has a distribution flap 70 and a rejection flap 71 and which is configured to distribute coins C into their "three" denominations in total, i.e., two predetermined or target denominations and one rejective denomination (see FIG. 29, FIGS. 31 to 38, and FIGS. 41 to 43). Each of the second to fourth distribution sections D2, D3, and D4 comprises a coin distribution mechanism (i.e., a mechanism for distributing coins C into their denominations during conveyance) which has a distribution flap 70 only and which is configured to distribute coins C into their "two" predetermined or target denomination (see FIG. 30, and FIGS. 39 to 40).

Structure of Coin Storage Unit

The coin storage unit 10 comprises a head 24 which is detachably attached to the surface of an upper wall 22*a* (see FIGS. 1 and 10) of a casing 22 of the coin separation and discrimination unit 20. The head 24 is formed by a depressed plate-like member, here. A hollow space, to which the rotary disk 26 is exposed, is formed on the depressed inner surface of the head 24 and the surface of the upper wall 22*a*. This space serves as a coin storage space for coins C.

Structure of Coin Separation and Discrimination Unit

The coin separation and discrimination unit 20 comprises the coin separation section that is configured to separate coins C which are stored in the coin storage unit 10 from each other one by one and to deliver the coins C thus separated to the coin discrimination section in a predetermined inclined attitude, and the coin discrimination section that is configured to discriminate the denomination and authenticity of the respective coins C which are delivered from the coin separation section and to deliver the coins C thus discriminated to the coin conveyance and distribution unit 60. In this embodiment, as seen from FIGS. 9 to 11, the coin separation section and the coin discrimination section of the unit 20 are arranged to be adjacent to each other on the upper wall 22*a* of the casing 22 which has a shape like a rectangular parallelepiped. The upper wall 22*a* of the casing 22 is placed to be inclined at approximately 45° with respect to a horizontal plane. The bottom of the casing 22 is opened and the inside of the casing 22 is hollow. An approximately rectangular base plate 21 is fitted to the opened bottom of the casing 22.

Figure 3:
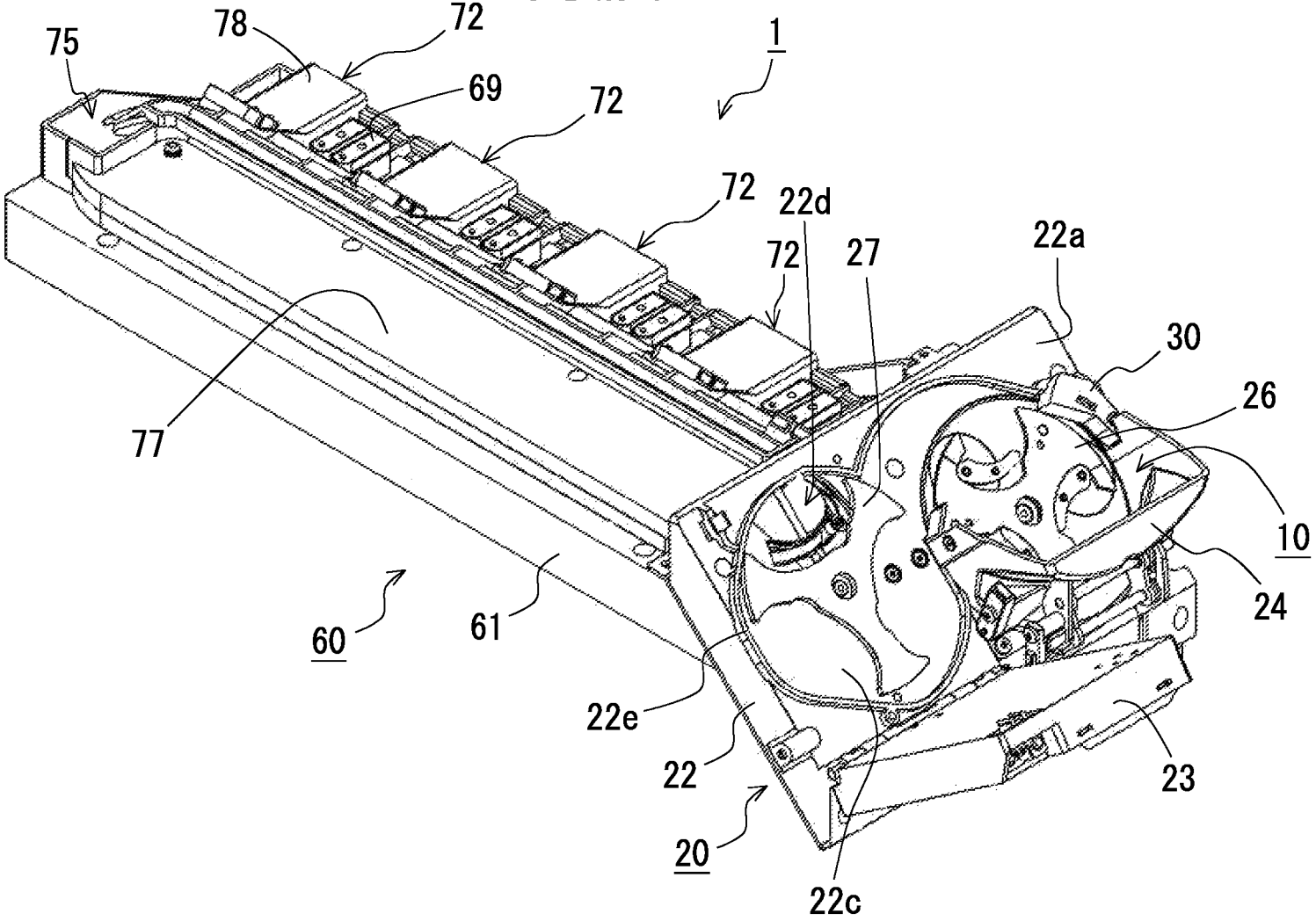
FIG. 3 is a perspective view showing the overall structure of the apparatus of FIG. 1, which is seen obliquely downward from the upper left rear, in which a substrate box is opened.
Figure 10:
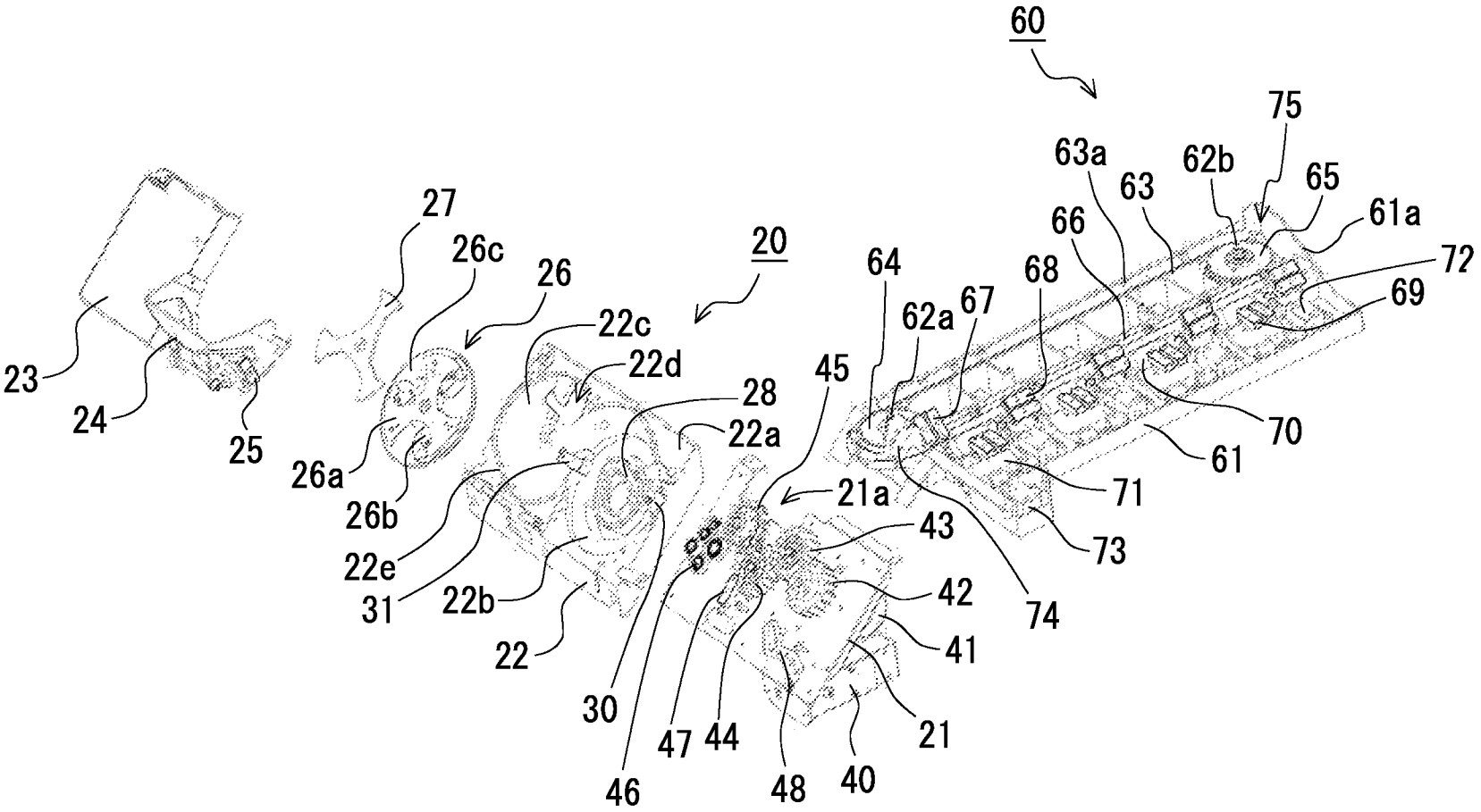
FIG. 10 is an exploded perspective view showing main constitutional elements of the apparatus of FIG. 1, which is seen obliquely downward from the upper left front, in which the rear cover that covers the upper opening of the endless belt receiving section of the coin conveyance and distribution unit, and the front cover that covers the upper opening of the sensor and solenoid mounting section of the same unit are detached.

A first depressed part 22*b*, a second depressed part 22*c*, a through hole 22*d*, and a guide wall 22*e* are formed on the upper wall 22*a* of the casing 22 (see FIGS. 3 and 10).

Since the first depressed part 22*b* is formed to receive the rotary disk 26 for coin separation, this part 22*b* has a circular shape whose diameter is slightly larger than the disk 26 and whose depth is enough for receiving the entirety of the disk 26.

Since the second depressed part 22*c* is formed to receive the rotary wiper 27 for denomination discrimination and authentication discrimination of coins C, this part 22*c* has an approximately circular shape whose diameter is slightly larger than the wiper 27 and whose depth is enough for receiving the entirety of the wiper 27. This is similar to the first depressed part 22*b*. However, the second depressed part 22*c* is necessarily formed in such a way that coins C pass through the upper areas of the discrimination sensors 46 for denomination discrimination and authentication discrimination while being rotated and moved by the rotary wiper 27 and therefore, the plan shape of the second depressed part 22*c* is slightly deformed from a perfect circle (see FIGS. 3 and 12, for example). To make it sure to move coins C to the coin discrimination section from the coin separation section, the second depressed part 22*c* comprises a connecting part which has a shape like a half of a crescent and which is formed between the rotary disk 26 and the rotary wiper 27. Thus, the entire shape of the second depressed part 22*c* is a combination of the rotary wiper receiving part having an approximately circular shape and the connecting part having a shape like a half of a crescent. The discrimination sensors 46, which are fixed in the casing 22, are disposed in the coin discrimination region P3 of the second depressed part 22*c* (see FIGS. 13 and 14).

The through hole 22*d* is formed to enable the coins C which have been subjected to the denomination discrimination and the authenticity discrimination on the upper wall 22*a* to arrive at the entrance of the coin conveyance path 76 which is disposed on the back side of the upper wall 22*a*. The through hole 22*d* is placed at the top of the second depressed part 22*c*, in other words, at the uppermost position to which the coins C can be moved to reach by the rotation of the wiper 27. Since the coins C of all the target denominations to be processed (i.e., eight denominations here) need to pass through the upper wall 22*a*, the size of the through hole 22*d* is set in such a way as to be larger than the coins C having the largest diameter among all the target denominations to be processed.

The guide wall 22*e* is formed to define the second depressed part 22*c* and to guide the coins C which are rotated and moved by the rotation of the wiper 27 for discriminating their denomination and authenticity.

Figure 9:
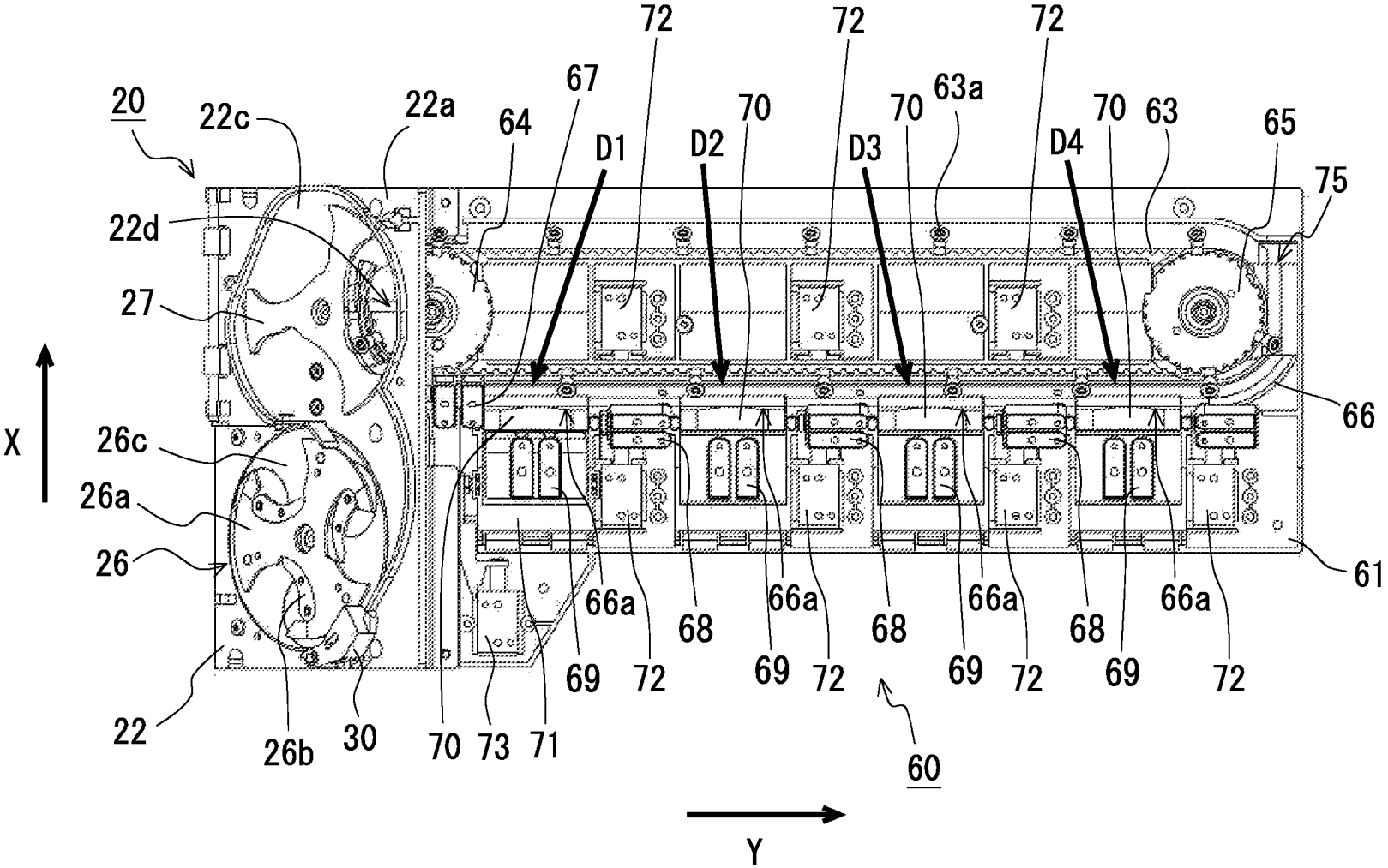
FIG. 9 is a plan view showing the overall structure of the apparatus of FIG. 1, in which the rear cover that covers the upper opening of the endless belt receiving section of the coin conveyance and distribution unit, the front cover that covers the upper opening of the sensor and solenoid mounting section of the same unit, and the head and the substrate box of the coin separation and discrimination unit are detached.
Figure 12:
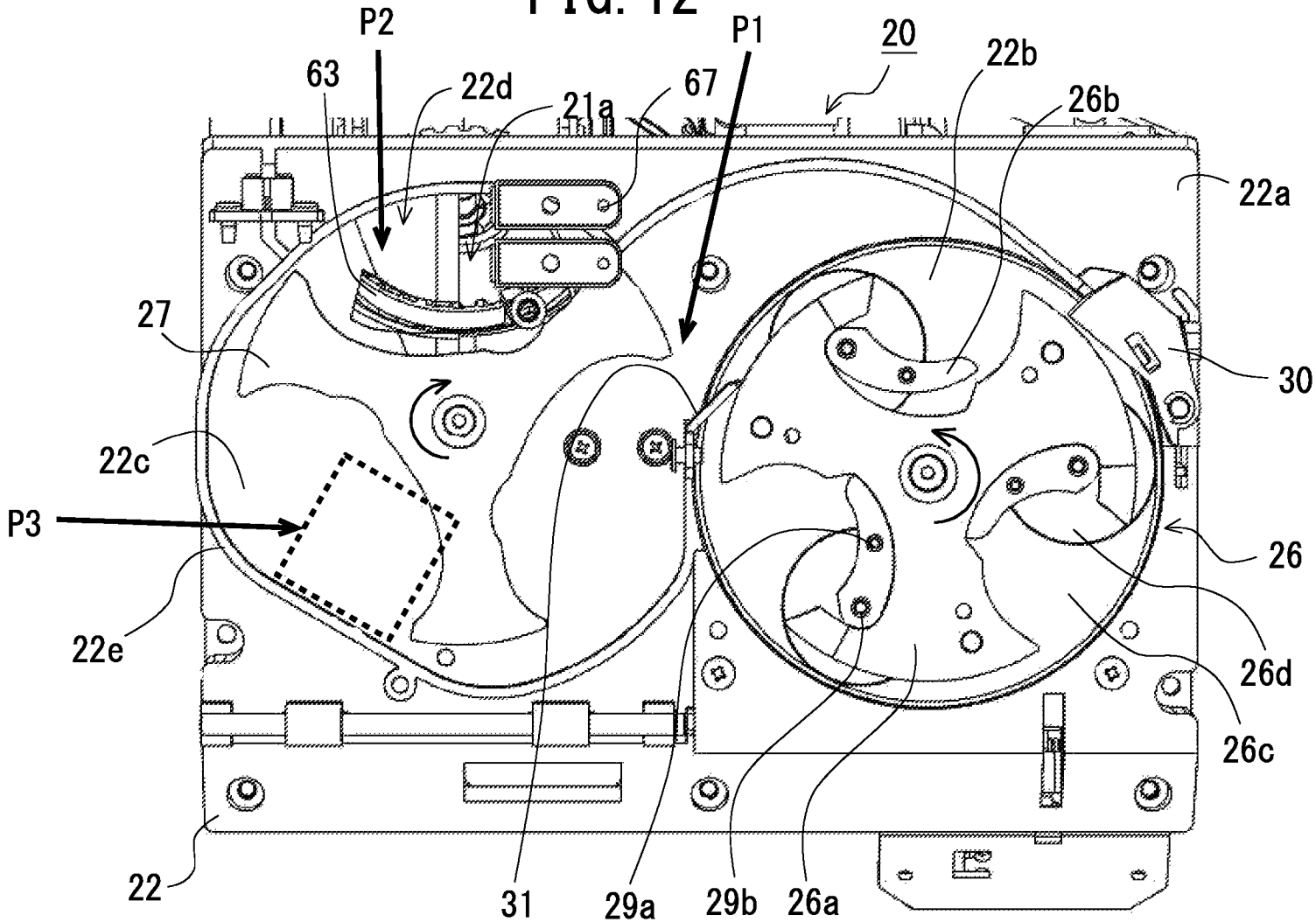
FIG. 12 is a partial enlarged explanatory view showing the structure of the coin separation and discrimination unit of the apparatus of FIG. 1, in which the head and the substrate box are detached.
Figure 13:
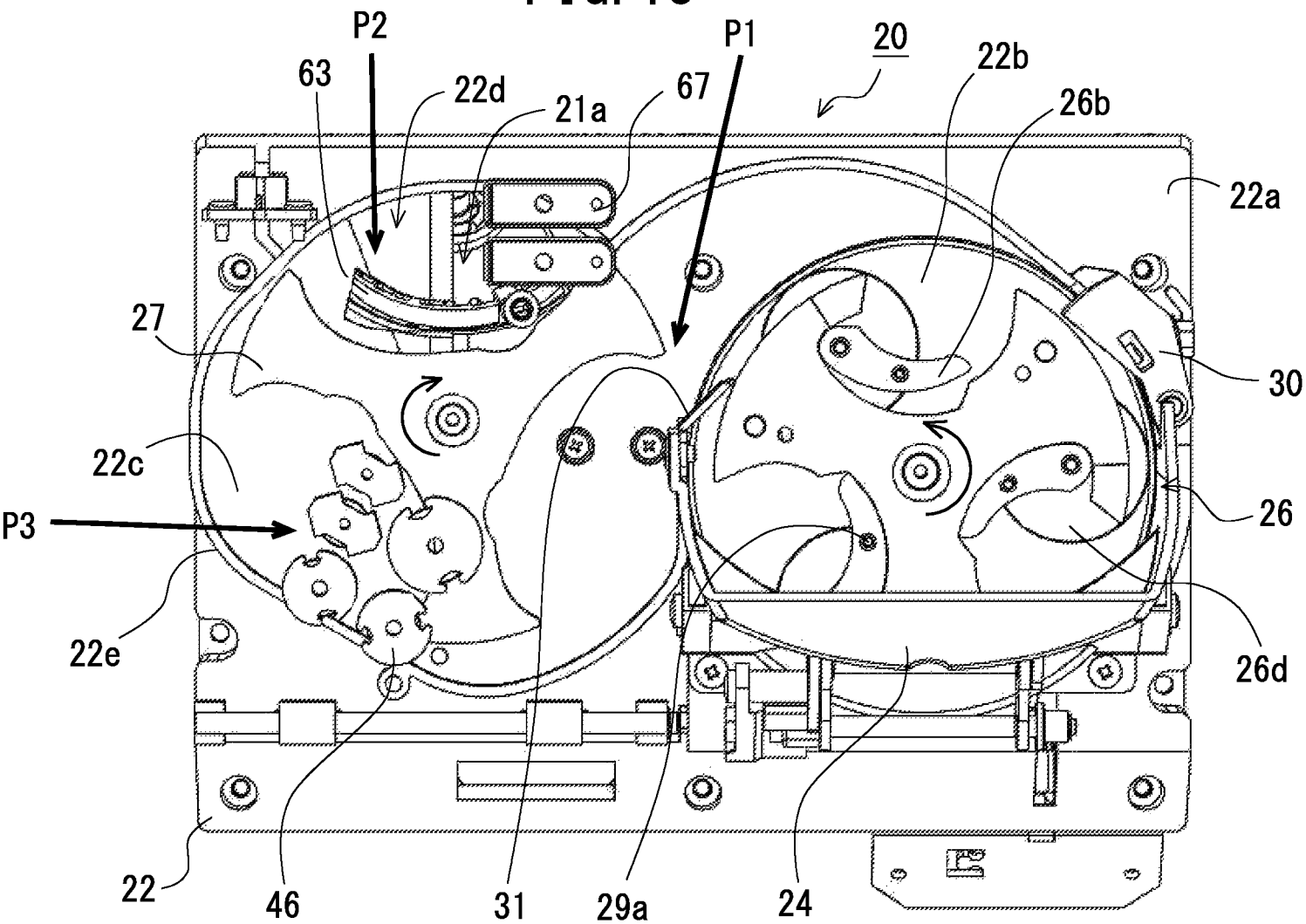
FIG. 13 is a partial enlarged explanatory view showing the structure of the coin separation and discrimination unit of the apparatus of FIG. 1, in which the substrate box is detached so as to uncover underlying discrimination sensors.

As clearly shown in FIGS. 9, 10, and 12, the rotary disk 26 for coin separation, which is provided in the coin separation section, comprises a pushing part 26*a*, three pushing members 26*b*, and three dust drop preventing members 26*d*. The pushing part 26*a* has a shape formed by selectively removing three portions from the surface layer of a circular plate to form three engaging recesses 26*c*, in which three coins C are respectively engaged with these engaging recesses 26*c*. The three pushing members 26*b* are respectively placed in the three engaging recesses 26*c* of the pushing part 26*a*. The three dust drop preventing members 26*d* are respectively placed near the corresponding pushing members 26*b*. The pushing part 26*a* is formed to push coins C which are respectively engaged with the engaging recesses 26*c* by the rotation of the rotary disk 26 in the first depressed part 22*b*. Each of the pushing members 26*b* is configured to be pivoted at the time immediately before a coin C that is being rotated by the rotation of the disk 26 passes through the first delivery region P1, thereby pushing the said coin C from the corresponding engaging recess 26*c* for the purpose of smooth delivery to the coin discrimination section. Each of the dust drop preventing member 26*d* is configured to prevent dust from dropping to positions below the disk 26 to cause malfunctions.

There is no restriction to the overall thickness of the disk 26; however, the thickness of the pushing part 26*a* is set so as not to be larger than the thickness of the thinnest coin C among all the target denominations to be processed. This is because if the thickness of the pushing part 26*a* is set so as to be larger than the thickness of the thinnest coin C, there is a possibility that two or more of the coins C whose thicknesses are smaller than the thickness thus set are pushed simultaneously.

Coins C stored in the coin storage unit 10 are likely to enter the three engaging recesses 26*c* of the rotary disk 26 at random and to move along with the rotation of the disk 26. Since a coin dropping member 30 is fixed onto the upper wall 22*a* of the casing 22 in the vicinity of the first depressed part 22*b*, coins C which are raised wastefully by the rotation of the disk 26 drop naturally and as a result, the coins C are entered the respective engaging recesses 26*c* one by one and rotated along with the rotating disk 26 around the center of the disk 26. For this reason, the coins C stored in the coin storage unit 10 are separated from each other and entered the respective engaging recesses 26*c* one by one and thereafter, they are delivered successively toward the rotary wiper 27. In this way, the "coin separation operation" for the coins C which are taken out of the coin storage unit 10 is carried out.

Figure 11:
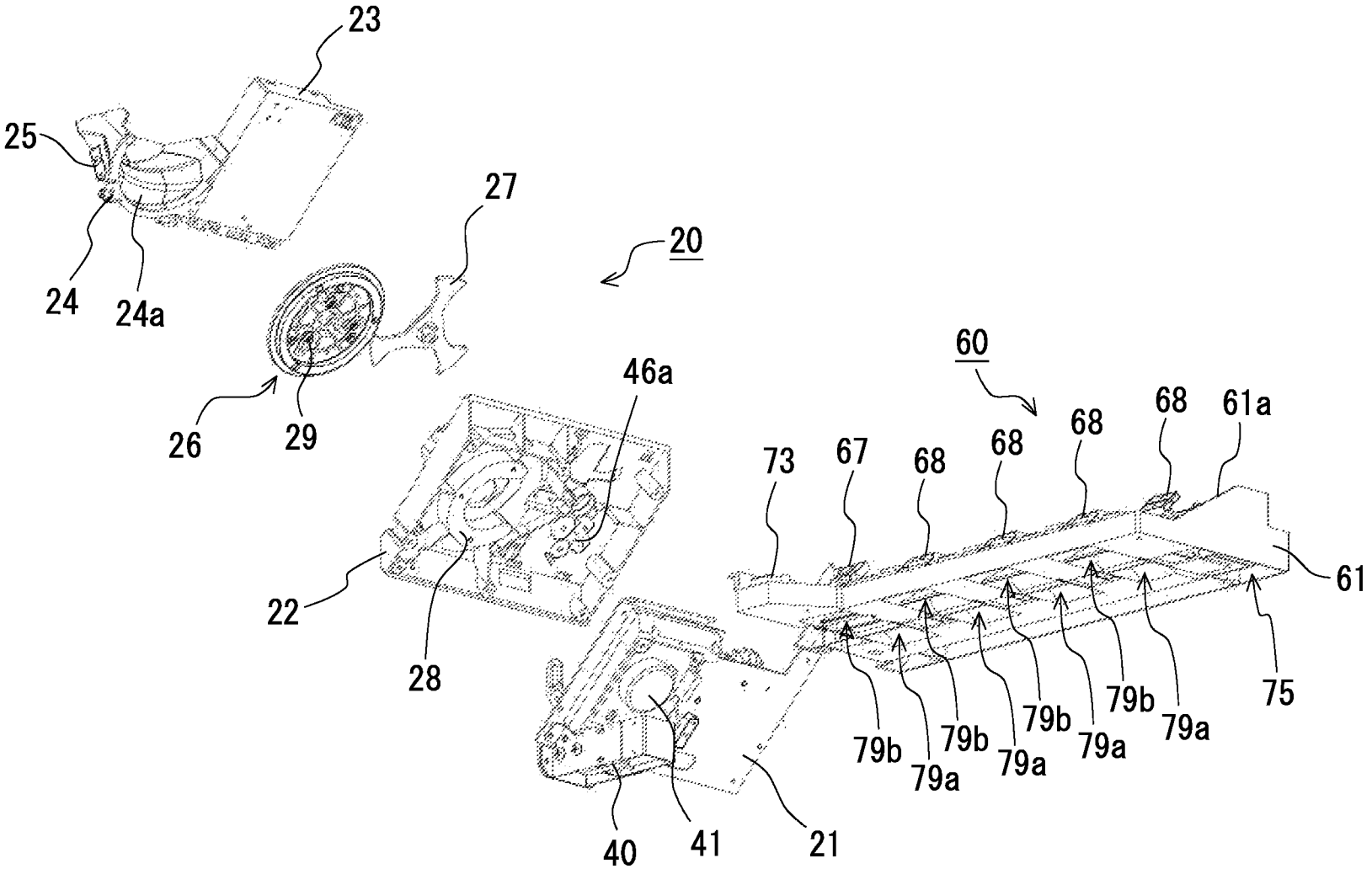
FIG. 11 is an exploded perspective view showing the main constitutional elements of the apparatus of FIG. 1, which is seen obliquely upward from the lower right rear, in which the rear cover that covers the upper opening of the endless belt receiving section of the coin conveyance and distribution unit, and the front cover that covers the upper opening of the sensor and solenoid mounting section of the same unit are detached.

In the aforementioned coin separation process, each coin C which is entered and engaged with one of the three engaging recesses 26*c* is pushed by the pushing part 26*a*. Since the relevant pushing member 26*b* is configured to push out the coin C from the corresponding engaging recess 26*c* immediately before the said coin C passes through the first delivery region P1, the said coin C can be delivered smoothly to the coin discrimination section by way of the first delivery region P1. This pushing action of the relevant pushing member 26*b* is realized by a grooved cam 28 which is formed on the casing 22 at the position right below the disk 26 and three cam followers 29 which are fixed to the back of the disk 26. Specifically, as shown in FIGS. 10 and 11, the grooved cam 28 is formed on the upper wall 22*a* of the casing 22, and three cam follower pins 29*a* of the cam followers 29 are engaged with the groove of the cam 28 (see FIG. 12). Since the cam follower pins 29*a* are moved along the groove of the cam 28 in accordance with the rotation of the disk 26, the pushing members 26*b* are pivoted outward or inward around their pivoting shafts 29*b* which are provided for the respective pins 29*a*. As a result, each of the pushing members 26*b* can be pivoted to push out the relevant coin C from the corresponding engaging recess 26*c* at the time immediately before the said coin C passes through the first delivery region P1 during its rotation, and the said coin C can be kept close to the corresponding engaging recess 26*c* except for the time of conducting this pushing action.

Since a delivery direction regulation or control member 31 is fixed near the first delivery region P1 (see FIGS. 12 and 13), coins C that pass through the first delivery region P1 are surely sent to the second depressed part 22*c* formed on the upper wall 22*a* of the casing 22. Here, the delivery direction regulation member 31 is fixed to the upper wall 22*a* at the position where the outer edge of the first depressed part 22*b* is next to the first delivery region P1.

As clearly shown in FIGS. 10, 11, and 12, the rotary wiper 27 for denomination and authenticity discrimination has a simple shape which is formed by removing three portions from a circular plate to form three engaging holes for coins C. Thus, the wiper 27 has three radially extending arms which are arranged around the center of the wiper 27 at equal angular intervals. Each of the three engaging holes with which a relevant coin C can be engaged is formed by the two adjoining arms of the wiper 27. The wiper 27 receives coins C that are successively sent to the second depressed part 22*c* by way of the first delivery region P1 by using the three arms, and discriminates the denomination and authenticity of the coins C thus received while rotating the said coins C around the center of the wiper 27. Thereafter, the coins C thus discriminated are successively sent to the coin conveyance path 76 of the coin conveyance and distribution unit 60 by way of the second delivery region P2. Since the coins C are moved in the second depressed part 22*c* along with the rotation of the wiper 27 before they are sent to the coin conveyance path 76, the discrimination operation for the denomination and authenticity of the coins C is carried out in the coin discrimination region P3 formed in the second depressed part 22*c*.

The through hole 22*d* is formed in the upper wall 22*a* of the casing 22 at the corresponding position to the second delivery region P2, and an opening 21*a* is formed on the top end of the base plate 21 which is placed on the back side of the casing 22. The opening 21*a*, which is formed by a cutout part of the base plate 21 here, is disposed at the position overlapped with the through hole 22*d*. Therefore, the coins C whose denomination and authenticity have been discriminated can pass successively through the through hole 22*d* and the opening 21*a*, which are disposed in the second delivery region P2, to reach the coin conveyance path 76 of the coin conveyance and distribution unit 60. This means that the said coins C can penetrate successively through the casing 22 and the base plate 21 to reach the path 76 of the unit 60. The overall thickness of the rotary wiper 27 (which is approximately equal to the height of the guide wall 22*e*) is approximately the same as the thickness of the thickest coin C among all the target denominations to be processed.

The coins C that have been sent to the second depressed part 22*c* in the coin discrimination section from the coin separation section due to the rotation of the rotary disk 26 are entered and engaged with the respective engaging holes of the rotary wiper 27 while keeping their attitude (in which one side face of each coin C is supported by the inclined surface of the upper wall 22*a* of the casing 22) and then, moved in the second depressed part 22*c* along the guide wall 22*e* in accordance with the rotation of the rotary wiper 27. The moving path of the coins C in the coin discrimination section (in the second depressed part 22*c*) is extended to the second delivery region P2 from the first delivery region P1. However, the coin discrimination region P3 is formed between these two delivery regions P2 and P1 and therefore, discrimination of the denomination and authenticity of the coins C can be automatically carried out when the respective coins C pass through the coin discrimination region P3. The shape of the guide wall 22*e* (i.e., the shape of the moving path of the coins C) is determined in such a way that a desired denomination and authenticity discrimination operation of the coins C is automatically carried out in the coin discrimination region P3. For this reason, the "denomination discrimination and authenticity discrimination" of the coins C that have been delivered to the coin discrimination section from the coin separation section is conducted only by the motion of the coins C along the guide wall 22*e* in the second depressed part 22*c* using the rotary wiper 27.

The rotary disk 26 and the rotary wiper 27 that perform the above-described operations are rotationally driven using the rotational driving force of a single electric motor 41 in the following way:

The electric motor 41 is fixed to the back of the base plate 21. The rotational shaft of this motor 41 is protruded from the surface of the base plate 21 through the same (see FIGS. 10 and 11). A driving gear 42, which is connected to the rotational shaft of the motor 41, is exposed from the surface of the base plate 21. The rotation of the driving gear 42 is transmitted to driven gears 43, 44, and 45 which are rotatably supported on the surface of the base plate 21 in this order. Since the rotational shaft of the rotary disk 26 is connected to the driving gear 42, the rotary disk 26 is rotationally driven at the same rotational frequency as that of the driving gear 42. Since the rotational shaft of the rotary wiper 27 is connected to the driven gear 45, the rotary wiper 27 is rotationally driven at the same rotational frequency as that of the driven gear 45. Since the count of the gear teeth of each of the driven gears 43, 44, and 45 is set in such a way that the rotational frequency per minute of the disk 26 is equal to that of the wiper 27, the disk 26 and the wiper 27 are rotated in the opposite directions at the same rotational speed. This means that the disk 26 is rotated in the counterclockwise direction and the wiper 27 is rotated in the clockwise direction, as shown in FIG. 12.

The discrimination sensors 46 are fixed to the surface of the base plate 12 in the coin discrimination region P3. Any known sensors may be used as the discrimination sensors 46 and therefore, detailed explanation about the sensors 46 are omitted here. In addition, the reference numeral 46*a* shown in FIG. 11 denotes the part to which the discrimination sensors 46 are attached or mounted, which is termed a "discrimination sensor mounting part" here.

Figure 14:
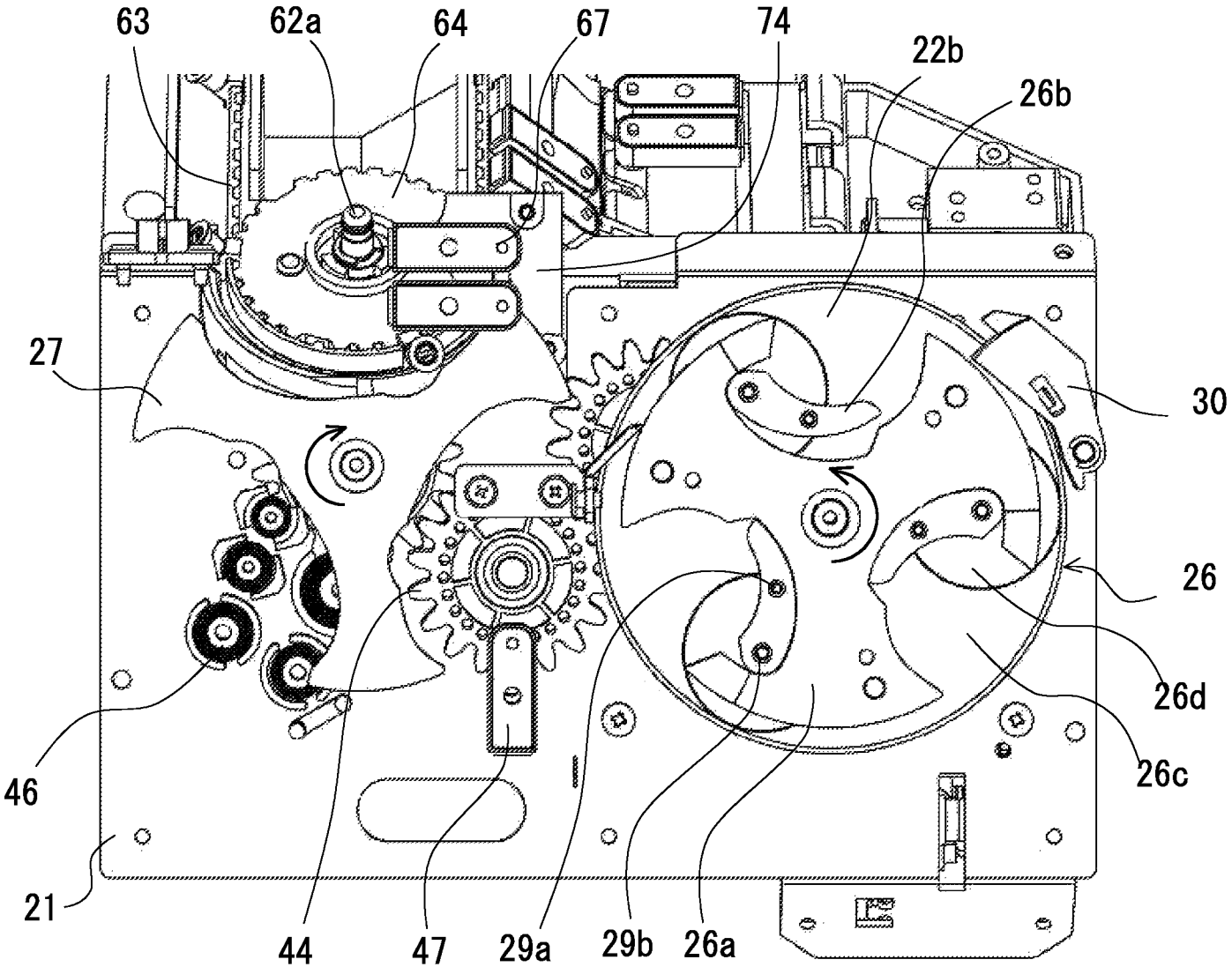
FIG. 14 is a partial enlarged explanatory view showing the structure of the coin separation and discrimination unit of the apparatus of FIG. 1, in which the head, the substrate box, and a casing are detached.

A wiper rotation detection sensor 47 is provided on the surface of the base plate 21 for the purpose of detecting whether or not the rotary wiper 27 keeps rotating at a predetermined rotational frequency (see FIGS. 10 and 14). In this embodiment, the wiper rotation detection sensor 47 is configured to detect optically the rotation of the driven gear 44. Specifically, as shown in FIG. 14, small holes are formed in the driven gear 44 in the circumferential direction at equal intervals and a known light emitting device is provided on the back side of the driven gear 44. The sensor 47 is configured to detect the light which passes through a designated one of the small holes from the light emitting device. Since the light passing though the designated small hole flashes on and off according to the rotation of the driven gear 44 when seeing from the surface side of the base plate 21, the rotational situation of the wiper 27 can be easily known by detecting this flashing light.

Figure 20A:
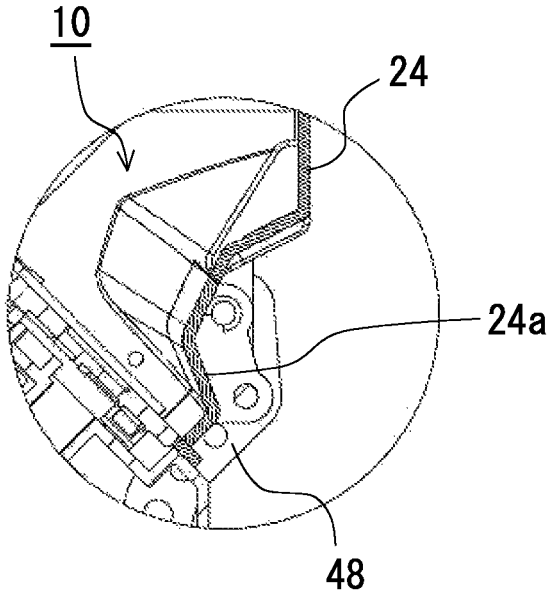
FIG. 20A is a explanatory partial cross-sectional view showing the situation where a coin or coins stored in a coin storage unit is/are returned in accordance with an ejecting action by a user in the apparatus of FIG. 1, in which the state before the ejecting action is performed is shown.
Figure 20B:
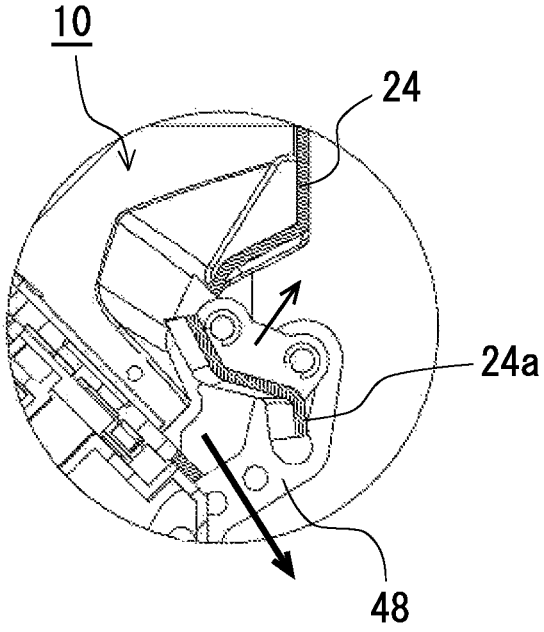
FIG. 20B is a explanatory partial cross-sectional view showing the situation where a coin or coins stored in the coin storage unit is/are returned in accordance with an ejecting action by a user in the apparatus of FIG. 1, in which the state where a movable part of the head is opened for coin ejection after the ejecting action is performed is shown.

A residual quantity detection sensor 25, which is mounted on the side face of the head 24, is provided for detecting the residual quantity of coins C which are waiting for processing, i.e., the total number of coins C retained in the coin storage unit 10 to wait for processing (see FIG. 10). The head 24 is not integrated with a substrate box 23. In addition, the head 24 comprises a movable part 24*a*, which is provided for returning a coin or coins C stored in the coin storage unit 10 in accordance with an ejecting operation by a user. Normally, the movable part 24*a* is closed, as shown in FIG. 20A. However, when an ejecting operation is applied, the movable part 24*a* is opened, as shown in FIG. 20B and as a result, a coin or coins C is/are dropped through an opening formed by the motion of the movable part 24*a* to be returned. The opening and closing operations of the movable part 24*a* are detected by an opening/closing detection sensor (not shown) which is incorporated into the head 24.

A linking part 48, which is formed to protrude from the surface of the base plate 21, is a part for linking a solenoid 40 which is provided on the back side of the base plate 21 with the movable part 24*a* of the head 24 (see FIG. 10). When the solenoid 40 is energized or deenergized, the linking part 48 is moved according to the reciprocating motion of the plunger (core) of the solenoid 40. The movable part 24*a* is configured to be opened or closed according to the reciprocating motion of the solenoid 40. This means that the linking part 48 realizes a desired linking operation between the movable part 24*a* and the solenoid 40 regardless of whether the movable part 24*a* is opened or closed.

Structure of Coin Conveyance and Distribution Unit

Next, the structure of the coin conveyance and distribution unit 60 will be explained below with reference to FIGS. 1 to 11, and FIGS. 21 to 30.

In this embodiment, as shown in FIG. 21, the coin conveyance and distribution unit 60 comprises the first to fourth distribution sections D1, D2, D3, and D4 which are arranged in this order along the extending direction of the this unit 60 from the side of the coin separation and discrimination unit 20 according to the aforementioned eight denominations of euro coins C to be processed. The four rear hoppers 83 (coin ejecting devices) placed at the rear side of the unit 60 and the four front hoppers 84 (coin ejecting devices) placed at the front side thereof, which are used for separately storing the coins C having their respective denominations, are attached to the lower side of the unit 60. One of the four rear hoppers 83 and a corresponding one of the four front hoppers 84 are assigned to each of the first to fourth distribution sections D1, D2, D3, and D4. Coins C are distributed by the first to fourth distribution sections D1, D2, D3, and D4 according to the respective denominations while being conveyed in the unit 60 along the coin conveyance path 76 (i.e., in a predetermined conveyance direction indicated by an arrow in FIG. 1) and then, the coins C thus distributed according to their denominations are dropped naturally from the first to fourth distribution sections D1 to D4 into the corresponding hoppers 83 and 84 and stored therein.

In addition, coins C which are judged not to be the aforementioned eight denominations (i.e., non-target coins) are designated as a rejective denomination or denominations (rejective coins). The coins C thus designated as the rejective denomination or denominations are distributed by the first distribution section D1 and to be sent to a dispensing tray (not shown). This means that the coins C of this type are not stored in the hoppers 83 and 84 but discharged to the outside of the apparatus 1 according to this embodiment.

As shown in FIGS. 1, 4, and 21, the coin conveyance and distribution unit 60 comprises the main body 61 that extends linearly along the coin conveyance direction. The main body 61 is divided into an endless belt receiving section which is relatively high and disposed on the rear side, and a sensor and solenoid mounting section which is relatively low and disposed on the front side.

In the endless belt receiving section of the main body 61, a pair of driven gears 64 and 65 which are arranged at a predetermined distance, an endless belt 63 which is stretched between the driven gears 64 and 65, and the distribution flap driving solenoids 72 are provided (see FIG. 4). The upper opening of the endless belt receiving section is covered with a rear cover 77 (see FIGS. 1 and 21). An inclined portion 77*a* (see FIG. 21) is formed as the front part of the rear cover 77, and a guide rail 66 is mounted near the lower end of the inclined portion 77*a* of the rear cover 77. The guide rail 66, which has a plan shape like a J character, is extended from the vicinity of the second delivery region P2 to an overflow path 75 which is disposed at the opposite end of the endless belt receiving section to the coin separation and discrimination unit 20 (see FIGS. 4 and 9). The guide rail 66 comprises four openings 66*a* that form gates 76*a* of the coin conveyance path 76 (see FIGS. 7 and 8). These four gates 76*a*, which are disposed at predetermined intervals, are respectively assigned to the first to fourth distribution sections D1, D2, D3, and D4.

In the sensor and solenoid mounting section of the main body 61, an incoming coin sensor 67, four moving coin sensors 68, four dropping coin sensors 69, the eight distribution flap driving solenoids 72, and four rejection flap driving solenoids 73 are provided. The upper opening of the sensor and solenoid mounting section is covered with a front cover 78. An inclined portion 78*a* is formed as the rear part of the front cover 78. The inclined portion 78*a* of the front cover 78 is overlapped with the inclined portion 77*a* of the rear cover 77 (see FIG. 1). The combination of these two inclined portions 77*a* and 78*a* and the guide rail 66 which is located near the lower end of the inclined portion 77*a* constitutes the coin conveyance path 76 in which coins C are conveyed in their standing state which is inclined with respect to a vertical plane. Thus, the cross section of the coin conveyance path 76 is like an inclined U-shape. Similar to the guiderail 66, the coin conveyance path 76 has a plan shape like a J character and is extended from the vicinity of the second delivery region P2 to the overflow path 75.

Here, the inclined portions 77*a* and 78*a* of the rear and front covers 77 and 78 have the same inclination angle of approximately 45° with respect to the bottom surface of the main body 61. An inclined edge 61*a* of the main body 61, which is disposed at the opposite end of the main body 61 (in other words, at the opposite end to the coin separation and discrimination unit 20), has an inclination angle of approximately 30° with respect to the bottom surface of the main body 61. Accordingly, when (the coin conveyance and distribution unit 60 of) the apparatus 1 is placed horizontally, each coin C is conveyed on the coin conveyance path 76 in the inclined state at approximately 45° with respect to the horizontal plane along the coin conveyance direction shown in FIG. 1 from the vicinity of the second delivery region P2 to the overflow path 75.

As described above, the guide rail 66 constitutes the bottom part of the coin conveyance path 76 to support the rim of a coin C, the inclined portion 77*a* of the rear cover 77 constitutes the back part of the path 76 to support the rear side face of the coin C, and the inclined portion 78*a* of the front cover 78 constitutes the front part of the path 76 to cover the front side face of the coin C (see FIG. 21). For this reason, a coin C is placed on (the leading end of) the guide rail 66 in the standing state which is inclined backward. As a result, a coin C that has been sent to the leading end of the guide rail 66 through the second delivery region P2 from the coin separation and discrimination unit 20 can be conveyed on the guide rail 66 in the conveyance direction shown in FIG. 1 while the rear side face of the coin C is supported by the inclined portion 77*a* of the rear cover 77.

Engaging pins 63*a* are fixed at equal intervals to the endless belt 63 that extends along the guide rail 66 so as to be adjacent to the same (see FIG. 4, for example). These pins 63*a* are protruded toward the front from the inclined portion 77*a* of the rear cover 77 through the gap formed near the lower end of the inclined portion 77*a*. Thus, a coin C that has been placed on the leading end of the guide rail 66 is engaged with any one of the pins 63*a* to be pressed or moved in the conveyance direction of FIG. 1 along with the motion of the belt 63. In this way, coins C can be successively conveyed on the guide rail 66 or on the coin conveyance path 76.

Since the front side of the guide rail 66 is covered with the inclined portion 78*a* of the front cover 78, a coin C is moved on the guide rail 66 or the coin conveyance path 76 in such a state as to be sandwiched by the two inclined portions 77*a* and 78*a*. For this reason, there is no danger that the coin C is dropped from the guide rail 66 or the coin conveyance path 76 even if vibration or the like is applied during conveyance.

In each of the first to fourth distribution sections D1 to D4, the gate 76*a* is formed for allowing coins C of two or three designated denominations to drop downward, in which the gate 76*a* is formed by a corresponding one of the openings 66*a* of the guide rail 66 that forms the bottom part of the coin conveyance path 76 (see FIGS. 29 to 32, FIGS. 35 and 36, and FIGS. 39 to 43). This means that the four gates 76*a* in total are formed at the bottom part of the coin conveyance path 76.

Figure 30:
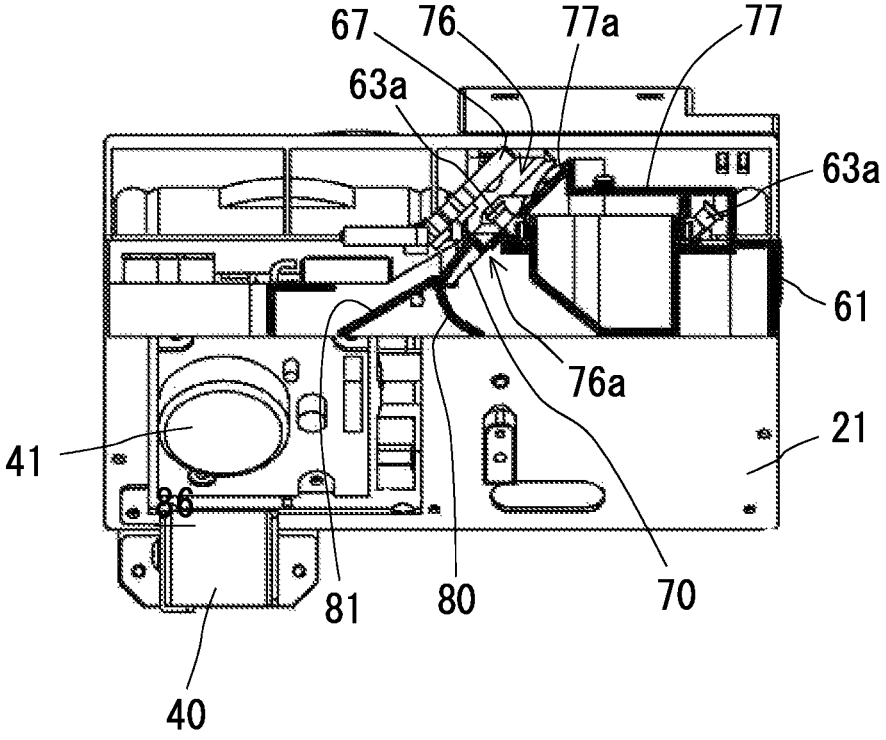
FIG. 30 is a partial cross-sectional view showing the internal structure of a coin distribution mechanism (which includes the distribution flap and the driving solenoid for driving the distribution flap) provided in each of the second to fourth distribution sections of the coin conveyance and distribution unit of the apparatus of FIG. 1.
Figure 38:
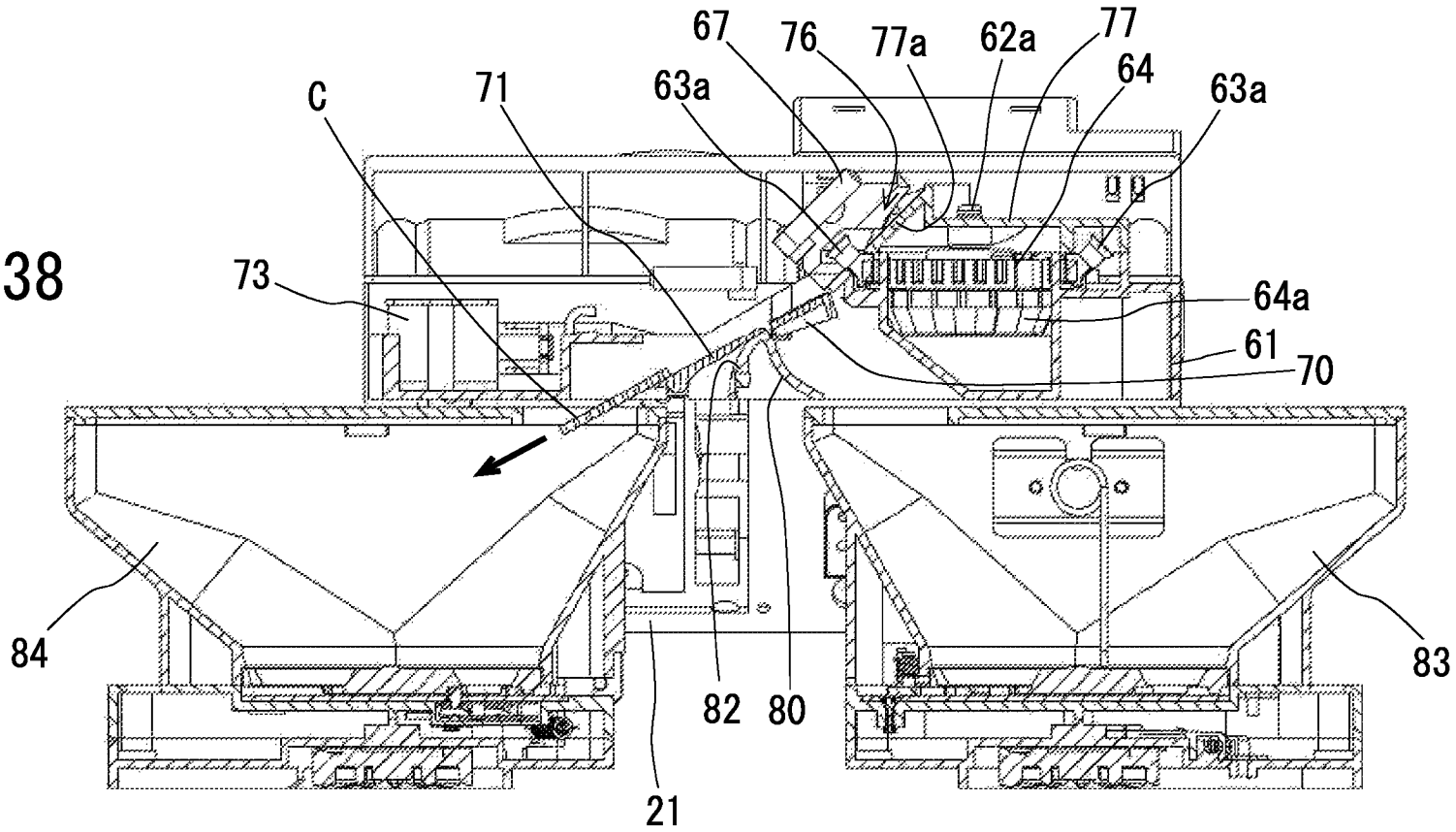
FIG. 38 is a cross-sectional view along the line L1 in FIG. 21 showing the distribution operation of the relevant coin toward the corresponding one of the front hoppers in the coin distribution mechanism provided in the first distribution section of the coin conveyance and distribution unit of the apparatus of FIG. 1, in which the relevant coin is being further dropping toward the corresponding front hopper while being guided by the distribution flap and the rejection flap in the coin distribution mechanism, which is subsequent to FIG. 37.
Figure 39:
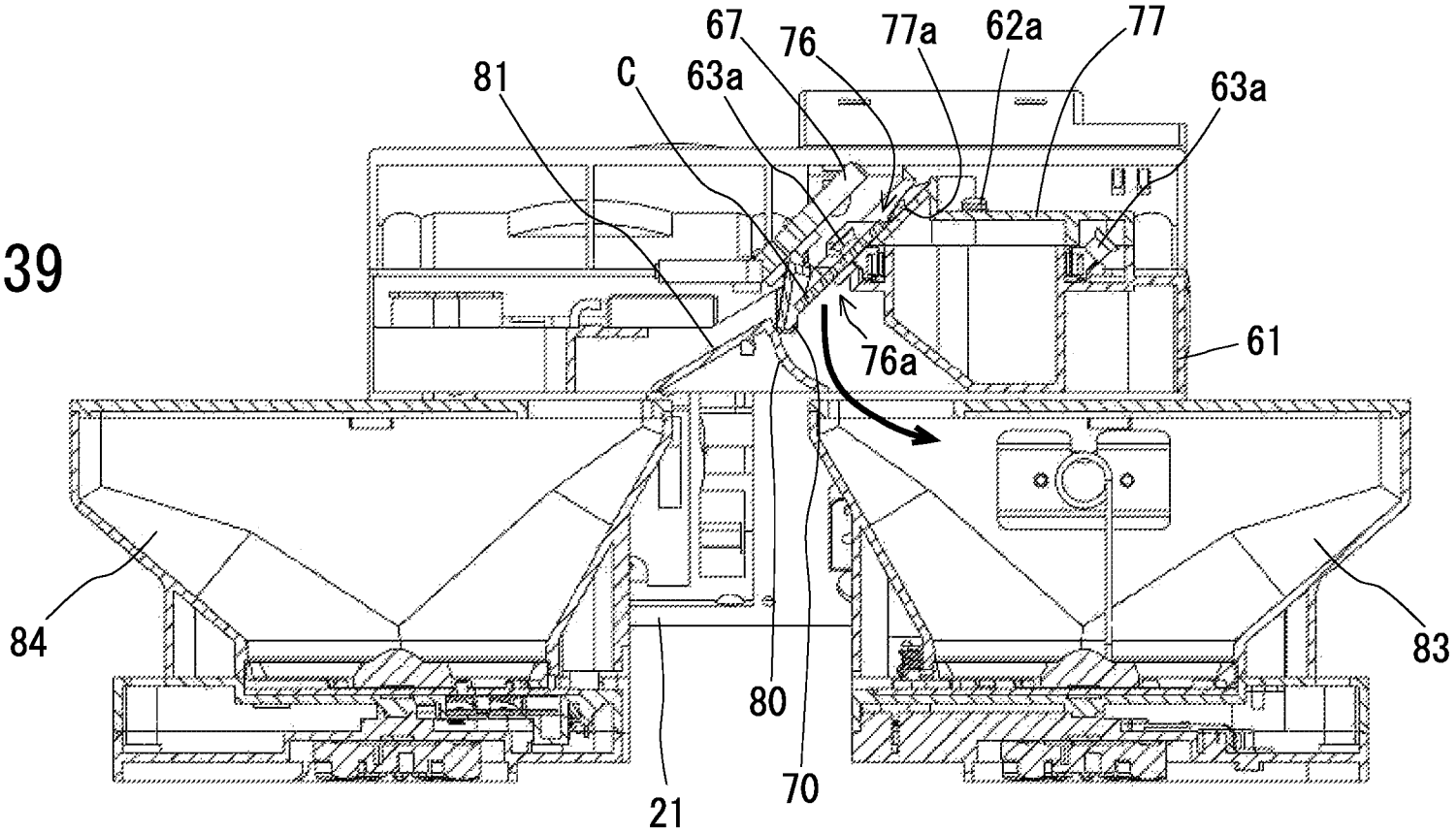
FIG. 39 is a cross-sectional view along the line L2 in FIG. 21 showing the distribution operation of a relevant coin toward a corresponding one of the rear hoppers in the coin distribution mechanism provided in each of the second, third, and fourth distribution sections of the coin conveyance and distribution unit of the apparatus of FIG. 1, in which the relevant coin is being sent toward the corresponding rear hopper while being guided by the distribution flap and the first chute of the coin distribution mechanism.
Figure 40:
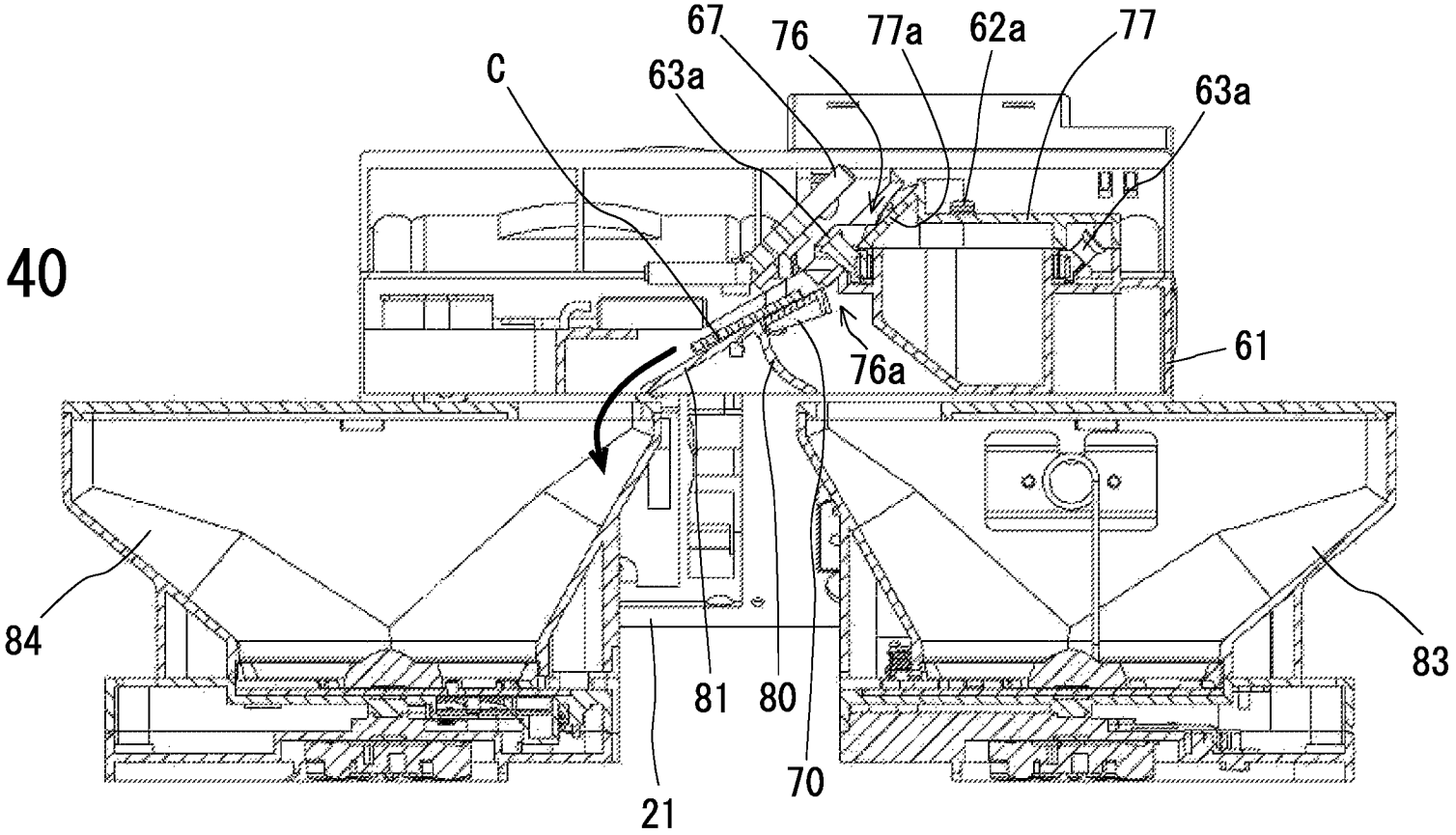
FIG. 40 is a cross-sectional view along the line L2 in FIG. 21 showing the distribution operation of a relevant coin toward a corresponding one of the front hoppers in the coin distribution mechanism provided in each of the second, third, and fourth distribution sections of the coin conveyance and distribution unit of the apparatus of FIG. 1, in which the relevant coin is being sent toward the corresponding front hopper while being guided by the distribution flap and a second chute of the coin distribution mechanism.

In the first distribution section D1, the distribution flap 70 serving as a first gate member and the rejection flap 71 serving as a second gate member are provided in a location just below the relevant gate 76*a* of the coin conveyance path 76 in such a way as to be adjacent to the said gate 76*a*, as shown in FIG. 29 and FIGS. 31 to 43. Unlike this, in each of the second to fourth distribution sections D2 to D4, only the distribution flap 70 serving as a first gate member is provided in a location just below the relevant gate 76*a* of the coin conveyance path 76 in such a way as to be adjacent to the said gate 76*a*, as shown in FIG. 30 and FIGS. 39 to 40. The reason why the rejection flap 71 serving as the second gate member is not provided in each of the second to fourth distribution sections D2 to D4 is that the discharge operation of the rejective coin, i.e., a coin or coins C to be rejected, is not carried out in these three distribution sections D2 to D4.

The distribution flap 70 provided in the first distribution section D1 (see FIG. 29) is driven or pivoted to open the relevant gate 76*a* of the coin conveyance path 76 provided in this section D1 according to the necessity, thereby allowing coins C of the aforementioned two designated or target denominations and coins C of the rejective denomination(s) during conveyance on the path 76 to selectively drop naturally along the inclined portion 77*a* of the rear cover 77 through the said gate 76*a*. The dropping direction of the said coins C at this stage is the same as the direction of the inclined portion 77*a*, i.e., an obliquely forward and downward direction which is inclined at approximately 45° with respect to a horizontal plane.

(a) When the denomination of a coin C that drops through the relevant gate 76*a* is equal to one of the aforementioned two designated or target denominations for the first distribution section D1, the distribution flap 70 is pivoted upward to the first switched position from the default position, thereby closing the dropping path of the coin C. As a result, the dropping direction of the said coin C is changed to the obliquely backward and downward direction from the obliquely forward and downward direction due to contact with the distribution flap 70. Subsequently, the said coin C is guided backward by a first chute 80 which is provided below the distribution flap 70 in the main body 61. Finally, the said coin C is stored in the relevant rear hopper 83 which is provided just below the main body 61 (see FIGS. 31 to 34). In this case, the distribution flap 70 serves as a guide member for changing the dropping direction of the said coin C.

(b) When the denomination of a coin C that drops through the relevant gate 76*a* is equal to the other of the aforementioned two designated or target denominations for the first distribution section D1, the distribution flap 70 is pivoted downward to the second switched position from the default position, in which the dropping path of the said coin C is not closed. As a result, the dropping direction of the said coin C is not changed and thus, the said coin C can be moved in the obliquely forward and downward direction while being supported by the distribution flap 70. In this case, the rejection flap 71, which is kept at the default position, closes the entrance of a third chute 82 which is provided below the rejection flap 71 in the main body 61, thereby making the third chute 82 unpassable. At the same time, the rejection flap 71 is inclined in the obliquely forward and downward direction similar to the distribution flap 70. Thus, the said coin C is moved on the distribution flap 70 and the rejection flap 71 which are connected to each other in the obliquely forward and downward direction. Finally, the said coin C is stored in the relevant front hopper 84 which is provided at an obliquely forward and downward position with respect to the main body 61 (see FIGS. 35 to 38). In this case, both of the distribution flap 70 and the rejection flap 71 serve as guide members for guiding the said coin C to the relevant front hopper 84.

(c) When the denomination of a coin C that drops through the relevant gate 76*a* is equal to the aforementioned rejective denomination, similar to the case where the said coin C is equal to the other of the aforementioned two designated or target denominations for the first distribution section D1, the distribution flap 70 is pivoted downward to the second switched position from the default position, in which the dropping path of the said coin C is not closed. As a result, the dropping direction of the said coin C is not changed and thus, the said coin C can be moved in the obliquely forward and downward direction while being supported by the distribution flap 70. In this case, however, the rejection flap 71 is pivoted upward to the switched position from the default position at this stage, and the entrance of the third chute 82 is opened, thereby making the third chute 82 passable. Thus, the said coin C is moved in the obliquely forward and downward direction while being supported by the distribution flap 70 and sent to the third chute 82 without being supported by the rejection flap 71. Subsequently, the said coin C is dropped in an approximately vertical direction while being guided by the third chute 82, thereby reaching the surface of a dispensing belt (not shown) which is provided just below the third chute 82 (see FIGS. 41 and 42). The said coin C of the rejective denomination placed on the dispensing belt in this way is discharged to the outside of the apparatus 1 for discriminating and conveying coins according to the embodiment e.g., to a dispensing tray (not shown), along with the running of the dispensing belt. In this case, both of the distribution flap 70 and the third chute 82 serve as guide members for guiding the said coin C to the dispensing belt.

(d) When the denomination of a coin C that is conveyed on the coin conveyance path 76 is not equal to both of the aforementioned two designated or target denominations for the first distribution section D1 nor the aforementioned rejective denomination, the relevant gate 76*a* is kept closed by the distribution flap 70 which is located at the default position. For this reason, the coin C that is conveyed on the coin conveyance path 76 does not drop through the relevant gate 76*a* but passes through the same gate 76*a* to move toward the second distribution section D2.

The distribution flap 70 provided in each of the second, third, and fourth distribution sections D2, D3, and D4 (see FIG. 30) is driven or pivoted to open the relevant gate 76*a* of the coin conveyance path 76 in a corresponding one of the sections D2, D3, and D4 according to the necessity, thereby allowing coins C of the two designated or target denominations that are conveyed on the path 76 to selectively drop naturally through the said gate 76*a*. The dropping direction of the said coins C at this stage is the same as that in the first distribution section D1, in other words, the obliquely forward and downward direction which is inclined at approximately 45° with respect to a horizontal plane.

(e) When the denomination of a coin C that drops through the relevant gate 76*a* is equal to one of the two designated or target denominations for the corresponding one of the sections D2, D3, and D4, the distribution flap 70 is pivoted upward to the first switched position from the default position, thereby closing the dropping path of the said coin C. As a result, the dropping direction of the said coin C is changed to the obliquely backward and downward direction from the obliquely forward and downward direction due to contact with the distribution flap 70. Subsequently, the said coin C is guided to be sent backward by the first chute 80 which is provided below the distribution flap 70 in the main body 61. Finally, the said coin C is stored in the relevant rear hopper 83 which is provided just below the main body 61 (see FIG. 39). In this case, the distribution flap 70 serves as a guide member for changing the dropping direction of the said coin C.

(f) When the denomination of a coin C that drops through the relevant gate 76*a* is equal to the other of the two designated or target denominations for the corresponding one of the sections D2, D3, and D4, the distribution flap 70 is pivoted downward to the second switched position from the default position, in which the dropping path of the said coin C is not closed. As a result, the dropping direction of the said coin C is not changed and thus, the said coin C can be moved on the distribution flap 70 in the obliquely forward and downward direction while being supported by the distribution flap 70. In this case, in each of the second, third, and fourth sections D2, D3, and D4, a second chute 81 inclined in the obliquely forward and downward direction, which is similar to the rejection flap 71 located at the default position where the entrance of the third chute 82 is closed, is provided at the same position as that where the rejection flap 71 is provided in the first distribution section D1. Thus, the said coin C is sent in the obliquely forward and downward direction while being supported by the distribution flap 70 and the second chute 81. Finally, the said coin C is stored in the relevant front hopper 84 which is provided at an obliquely forward and downward position with respect to the main body 61 (see FIG. 40). In this case, both of the distribution flap 70 and the second chute 81 serve as guide members for guiding the said coin C to the relevant front hopper 84.

(g) When the denomination of a coin C that is conveyed on the coin conveyance path 76 is not equal to both of the two designated or target denominations for the corresponding one of the sections D2, D3, and D4, the relevant gate 76*a* is kept closed by the distribution flap 70. For this reason, the coin C that is conveyed on the coin conveyance path 76 does not drop through the relevant gate 76*a* but passes through the same gate 76*a* to move toward the overflow path 75.

The distribution flaps 70 provided respectively in the second, third, and fourth distribution sections D2, D3, and D4 have the same structure and the same driving mechanism. An example of the distribution flap 70 and the driving mechanism thereof are shown in FIGS. 22 to 25.

As clearly seen from FIGS. 22 to 25, the distribution flap 70, which has a shape of an approximately rectangular plate, comprises a first side face 70*a* formed on one side and a second side face 70*b* formed on the other side. A depressed curved surface is formed on the first side face 70*a*. This depressed curved surface is partially cylindrical, the reason of which is to guide a coin C so as not to diverge from its moving direction.

Specifically, in the case where a coin C is sent toward the relevant front hopper 84 in such a manner as shown in FIGS. 35 to 38 in the first distribution section D1, the reason why the depressed curved surface of the first side face 70*a* of the distribution flaps 70 is partially cylindrical is to surely guide the coin C so as not to diverge from its original moving direction while the said coin C is slid on the first side face 70*a* of the distribution flap 70 in the obliquely forward and downward direction due to the gravity to reach a surface 71*b* of the rejection flap 71 which is adjacent to the distribution flap 70. Moreover, in the case where a coin C is sent toward the relevant front hopper 84 in such a manner as shown in FIG. 40 in each of the second, third, and fourth distribution sections D2, D3, and D4, the reason why the depressed curved surface of the first side face 70*a* of the distribution flaps 70 is partially cylindrical is to surely guide the coin C so as not to diverge from its original moving direction while the coin C is slid on the first side face 70*a* of the distribution flap 70 in the obliquely forward and downward direction due to the gravity to reach a surface of the second chute 81 which is adjacent to the distribution flap 70.

A cavity whose lower end is opened is formed in the second side face 70*b* of the distribution flap 70, the reason of which is to surely change the original moving direction of a coin C.

Specifically, in the case where a coin C is sent toward the relevant rear hopper 83 in such a manner as shown in FIGS. 31 to 34 and FIG. 39 in each of the first to fourth distribution sections D1, D2, D3, and D4, the reason why the cavity is formed in the second side face 70*b* of the distribution flap 70 is to surely receive the lower end of the coin C which is dropped in the obliquely backward and downward direction due to the gravity by the inner surface of the said cavity of the second side face 70*b*, thereby making it sure to change the original moving direction of the said coin C to the obliquely backward and downward direction.

As described above, the distribution flap 70 serves as the role of a distribution member for a coin C and the role of a guide member for the coin C.

In addition, an upper end 70*c* of the distribution flap 70 is used to close the corresponding gate 76*a* of the coin conveyance path 76 in each of the first to fourth distribution sections D1, D2, D3, and D4.

The driving mechanism for the distribution flap 70 as the position switching device for the flap 70, i.e., the distribution flap driving mechanism, comprises the two distribution flap driving solenoids 72, a driving member 86 disposed between these two solenoids 72, a linking member 87 for linking the distribution flap 70 with the driving member 86, and a pair of pivoting shafts 88 for pivotably supporting the distribution flap 70. One end of each pivoting shaft 88 is fixed to an opposing end of the flap 70 and the other end thereof is pivotably supported at a predetermined position in the main body 61. The pair of pivoting shafts 88 is held in the main body 61 in such a way as to be parallel to the bottom surface of the main body 61. Thus, when the apparatus 1 is placed on a horizontal surface, the distribution flap 70 can be pivoted around the pair of pivoting shafts 88 which is held to be approximately horizontal. The pair of pivoting shafts 88 is extended along the conveyance direction of coins C in a horizontal plane.

The driving member 86 has a shape like a hollow rectangular parallelepiped whose upper and front walls are removed. Two engaging parts 86*a*, each of which has an approximately U-shaped opening, are respectively formed at left and right sidewalls of the driving member 86. Each of the engaging parts 86*a* is engaged with a circular engaging groove 72*aa* which is formed at the top end of a plunger (a movable core) 72*a* of a corresponding one of the solenoids 72. Because of these engagement structures of the engaging parts 86*a* and the corresponding engaging grooves 72*aa*, the driving member 86 can be moved linearly (i.e., reciprocated) as desired by the protruding and retracting actions of the two plungers 72*a*.

The linking member 87 is formed by an approximately linear bar-shaped material having a circular opening at its one end and a protrusion 87*a* at its other end. The circular opening of the linking member 87 is pivotably engaged with a corresponding one of the two pivotable shafts 88. The protrusion 87*a* of the linking member 87 is rotatably engaged with a circular opening formed in the rear wall of the driving member 86. The linking member 87, which is pivotably engaged with the relevant pivotable shaft 88 and the driving member 86, constitutes "a crank mechanism" for converting the horizontal linear motion (horizontal reciprocation) generated by the two distribution flap driving solenoids 72 to the pivoting motion of the pivotable shafts 88 or the distribution flap 70.

One of the two distribution flap driving solenoids 72 is placed in the sensor and solenoid mounting section of the main body 61 and the other of the solenoids 72 is placed at a suitable position below the endless belt 63 and the guide rail 66 in the endless belt receiving section of the body 61 (see FIGS. 4 and 21). The two plungers 72*a* of the solenoids 72, which are perpendicular to the coin conveyance direction in a horizontal plane, are configured to take any one of the "middle position", the "protruded position", and the "retracted position".

Specifically, when each of the two solenoids 72 is energized by applying a positive voltage, a corresponding one of the plungers 72*a* is protruded or moved to the side of the distribution flap 70 to be located at the "protruded position". When each of the solenoids 72 is energized by applying a negative voltage, the corresponding one of the plungers 72*a* is retracted or moved to the opposite side to the distribution flap 70 to be located at the "retracted position". When each of the solenoids 72 is not energized, in other words, neither the positive voltage nor the negative voltage is applied to each of the solenoids 72, the corresponding one of the plungers 72*a* is kept at the "middle position".

The polarity of the application voltages to the two solenoids 72 is controlled in such a way that one of the solenoids 72 is located at the "protruded position" and at the same time, the other is located at the "retracted position". This means that the driving member 86 is controlled by the two solenoids 72 in such a way as to be surely displaced from the "default position" to the "first switched position" or the "second switched position". For example, when one of the two solenoids 72 is applied with the positive voltage, the other is surely applied with the negative voltage. Moreover, when one of the two solenoids 72 is applied with none of the positive and negative voltages, i.e., deenergized, the other is also surely applied with none of the positive and negative voltages, i.e., deenergized.

As described above, by synchronously energizing or deenergizing the two solenoids 72 while alternately changing the polarity of the application voltages to the said solenoids 72, the state or attitude of the distribution flap 70 can be selectively set at any one of the "default position A0"

shown in FIG. 23, the "first switched position A1" shown in FIG. 24, and the "second switched position A2" shown in FIG. 25.

Figures 22A, 22B:
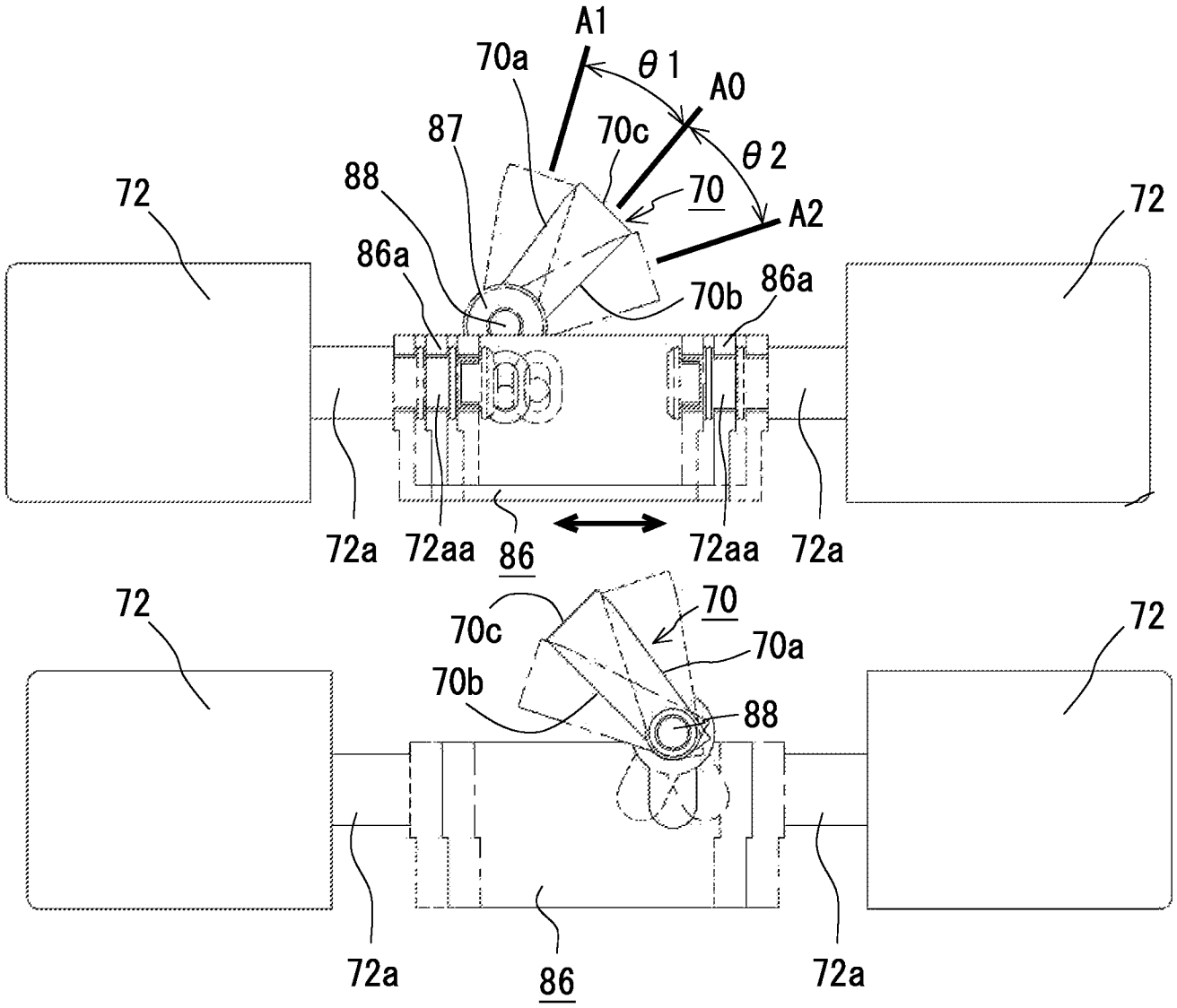
FIG. 22A is a right side view showing a distribution flap (a first gate member) and a driving solenoid for driving the distribution flap, which are provided in each of first to fourth distribution sections of the coin conveyance and distribution unit of the apparatus of FIG. 1.
FIG. 22B is a left side view showing the distribution flap and the driving solenoid of FIG. 22A.
Figure 23A:
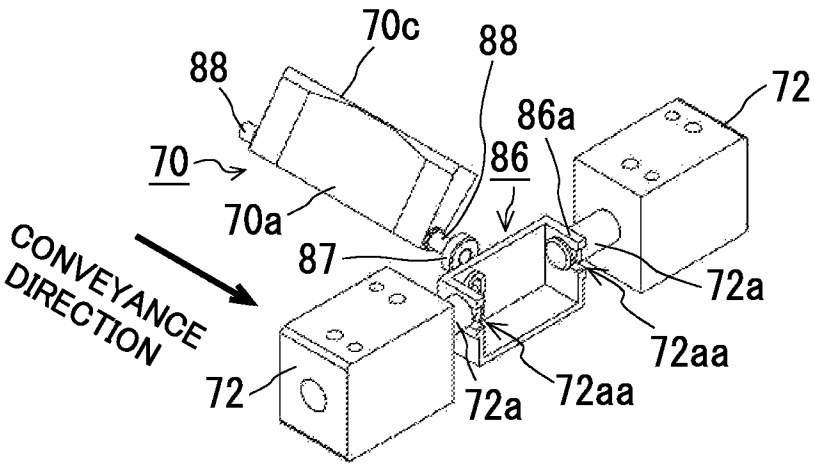
FIG. 23A is a perspective view showing the distribution flap and its driving solenoid provided in each of the first to fourth distribution sections of the coin conveyance and distribution unit of the apparatus of FIG. 1, in which the distribution flap is located at a default position, which is seen obliquely downward from the upper right front.
Figure 23B:
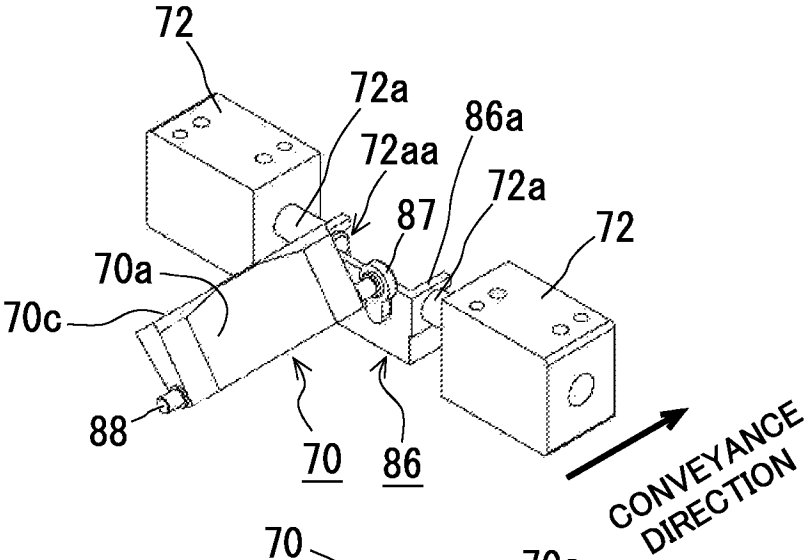
FIG. 23B is a perspective view showing the distribution flap and its driving solenoid of FIG. 23A, which is seen obliquely downward from the upper left front.
Figure 23C:
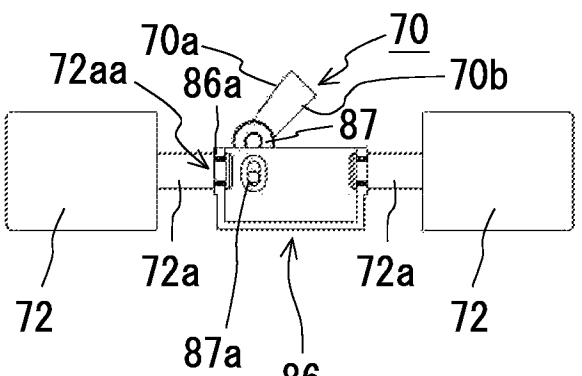
FIG. 23C is a right side view showing the distribution flap and its driving solenoid of FIG. 23A.
Figure 23D:
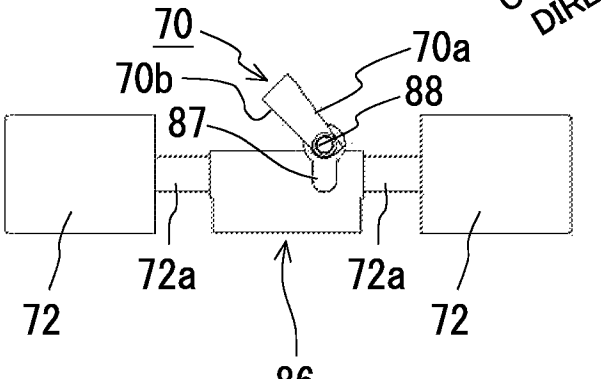
FIG. 23D is a left side view showing the distribution flap and its driving solenoid of FIG. 23A.
Figure 24A:
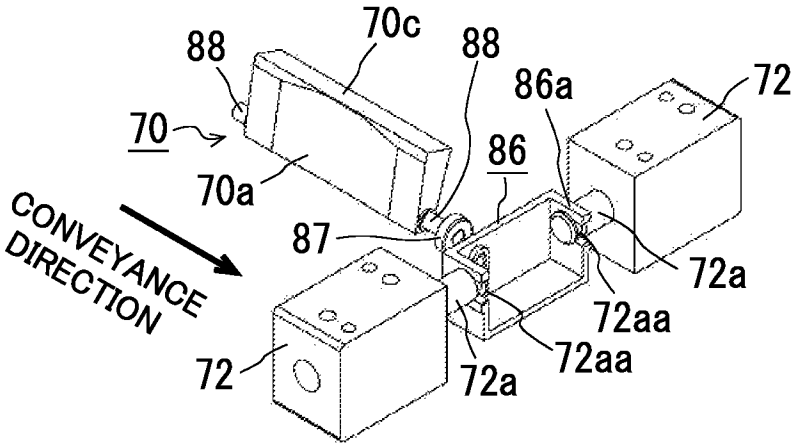
FIG. 24A is a perspective view showing the distribution flap and its driving solenoid provided in each of the first to fourth distribution sections of the coin conveyance and distribution unit of the apparatus of FIG. 1, in which the distribution flap is located at a first switched position, which is seen obliquely downward from the upper right front.
Figure 24B:
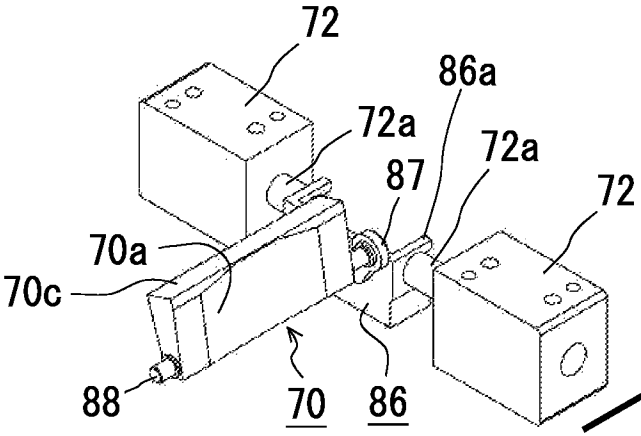
FIG. 24B is a perspective view showing the distribution flap and its driving solenoid of FIG. 24A, which is seen obliquely downward from the upper left front.
Figure 24C:
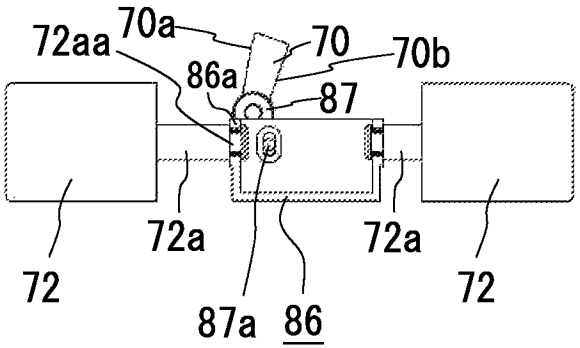
FIG. 24C is a right side view showing the distribution flap and its driving solenoid of FIG. 24A.
Figure 24D:
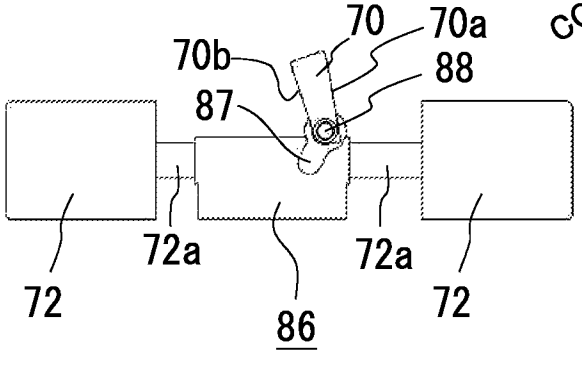
FIG. 24D is a left side view showing the distribution flap and its driving solenoid of FIG. 24A.

As shown in FIG. 22, when the distribution flap 70 is located at the default position A0 (see FIG. 23), the central plane of the flap 70 is inclined at a predetermined angle with respect to the pivoting shafts 88 which are held to be approximately horizontal (see the position A0 in FIG. 22). In each of the first to fourth distribution sections D1 to D4, the relevant gate 76*a* of the coin conveyance path 76 is configured to be closed by putting the upper end 70*c* of the distribution flap 70 on the said relevant gate 76*a* at the default position A0. Thus, a coin C that is conveyed on the coin conveyance path 76 does not drop through the said relevant gate 76*a* but passes through the same gate 76*a* in this position A0.

When the distribution flap 70 is displaced to the first switched position A1 (see FIG. 24) from the "default position A0", the central plane of the flap 70 is pivoted upward by an angle θ1 around the pair of pivoting shafts 88 to move to the first switched position A1. At this stage, the upper end 70*c* of the flap 70 is shifted upward from the said relevant gate 76*a* to open the said gate 76*a* and therefore, a coin C that is conveyed on the coin conveyance path 76 drops through the said gate 76*a* to move along the inclined portion 77*a* of the rear cover 77 in the obliquely forward and downward direction. However, during this dropping action of the coin C, the direction of the said coin C is changed to the obliquely backward and downward direction from the obliquely forward and downward direction due to contact with the second side face 70*b* of the flap 70. Thereafter, the said coin C is sent to the relevant rear hopper 83 by the first chute 80 and then, stored therein.

On the other hand, when the distribution flap 70 is displaced to the second switched position A2 (see FIG. 25) from the "default position A0", the central plane of the flap 70 is pivoted downward by an angle θ2 around the pair of pivoting shafts 88 to move to the second switched position A2. At this stage, the upper end 70*c* of the flap 70 is shifted downward from the said relevant gate 76*a* to open the said gate 76*a* and therefore, a coin C that is conveyed on the coin conveyance path 76 drops through the said gate 76*a* to move along the inclined portion 77*a* of the rear cover 77 in the obliquely forward and downward direction. During this dropping action of the coin C, the said coin C is sent in the obliquely forward and downward direction while being supported by the first side face 70*a* of the flap 70. The dropping direction of the said coin C is not changed here. Thereafter, the said coin C is sent to the relevant front hopper 84 by the rejection flap 71 which is located at the default position (in the first distribution section D1) or the second chute 81 (in each of the second to fourth distribution sections D2 to D4) and then, stored therein.

The structure of the distribution flap 70 and that of its driving mechanism are not limited to those described here, and it is needless to say that any other structures may be used for this purpose. Moreover, any other driving device such as an electric motor may be used instead of the distribution flap driving solenoid 72. The driving mechanism also is not limited to that including the driving member 86 and the linking member 87; any other structure may be used for this purpose. In summary, any other structure may be used for this purpose if the distribution flap 70 can be selectively located at any one of the "default position A0", the "first switched position A1", and the "second switched position A2" according to the necessity.

Figure 26A:
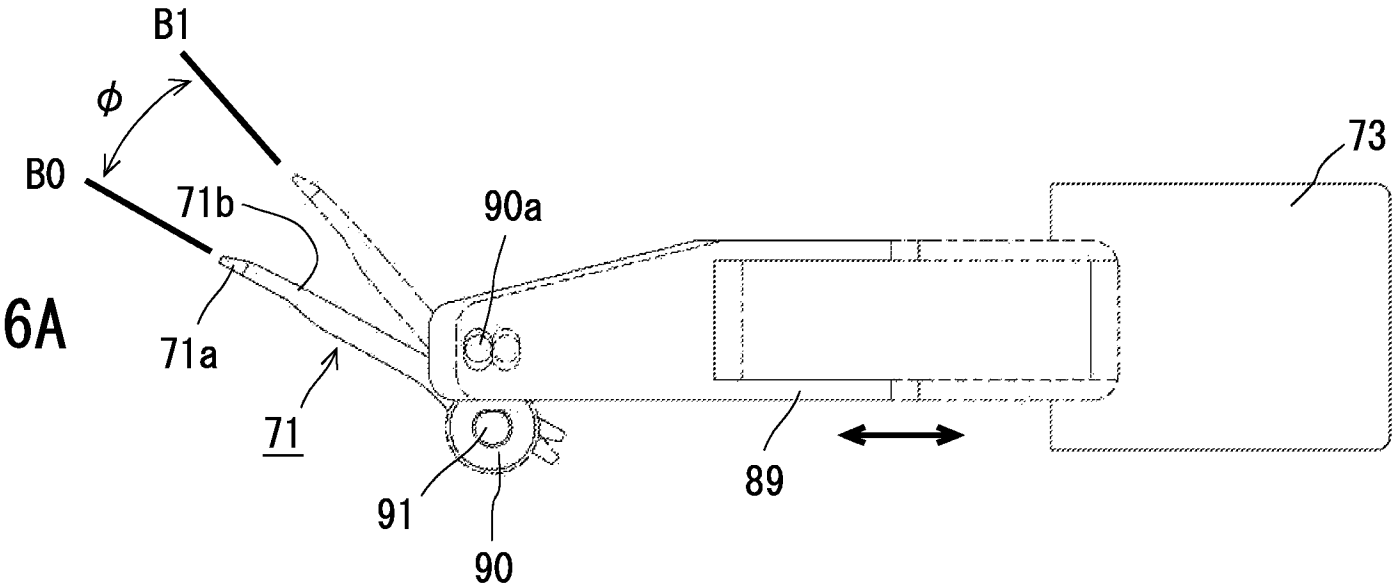
FIG. 26A is a left side view showing a rejection flap (a second gate member) and its driving solenoid, which are provided in the first distribution section of the coin conveyance and distribution unit of the apparatus of FIG. 1.
Figure 26B:
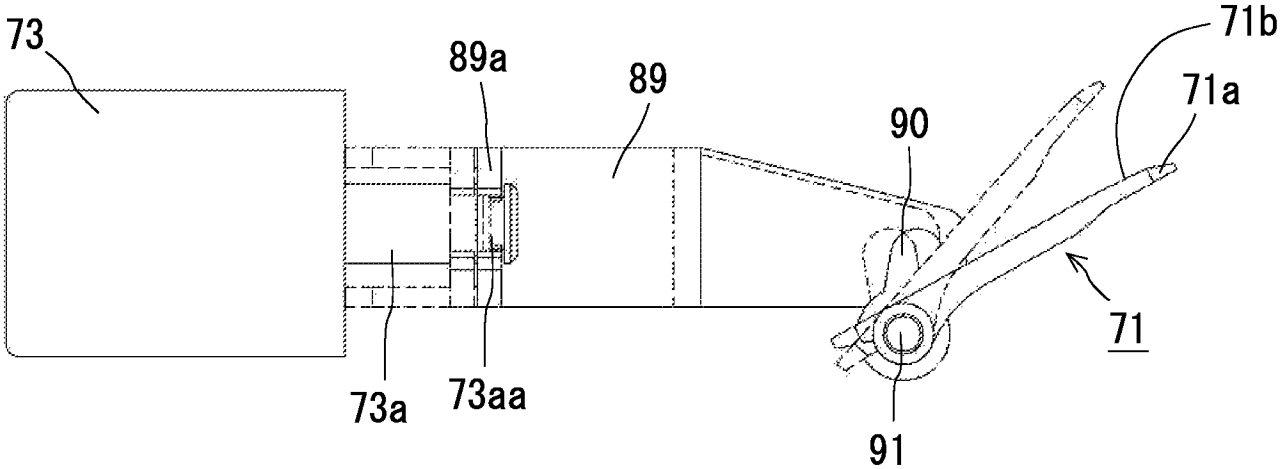
FIG. 26B is a right side view showing the rejection flap and its driving solenoid of FIG. 26A.
Figure 27A:
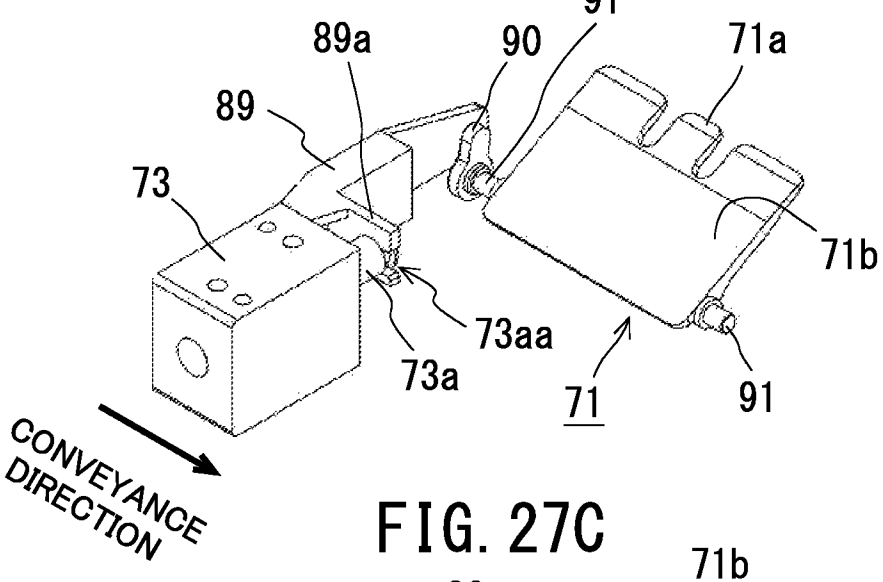
FIG. 27A is a perspective view showing the rejection flap and its driving solenoid provided in the first distribution section of the coin conveyance and distribution unit of the apparatus of FIG. 1, in which the rejection flap is located at a default position, which is seen obliquely downward from the upper right front.
Figure 27B:
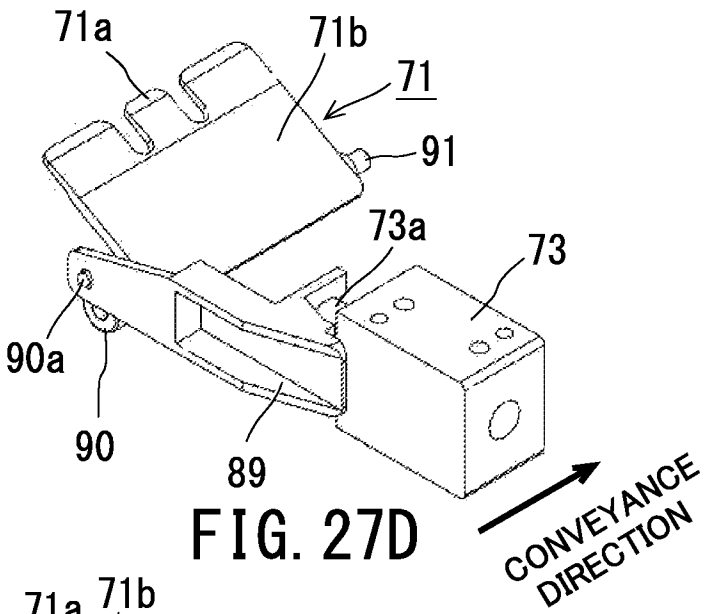
FIG. 27B is a perspective view showing the rejection flap and its driving solenoid of FIG. 27A, which is seen obliquely downward from the upper left front.
Figure 27C:
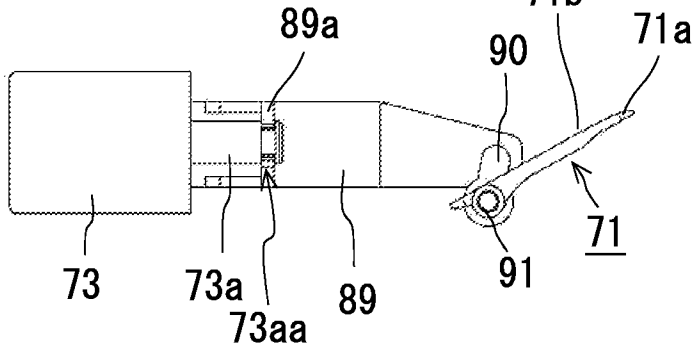
FIG. 27C is a right side view showing the rejection flap and its driving solenoid of FIG. 27A.
Figure 27D:
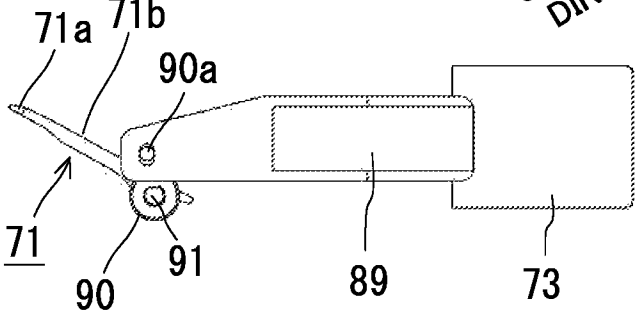
FIG. 27D is a left side view showing the rejection flap and its driving solenoid of FIG. 27A.
Figure 28A:
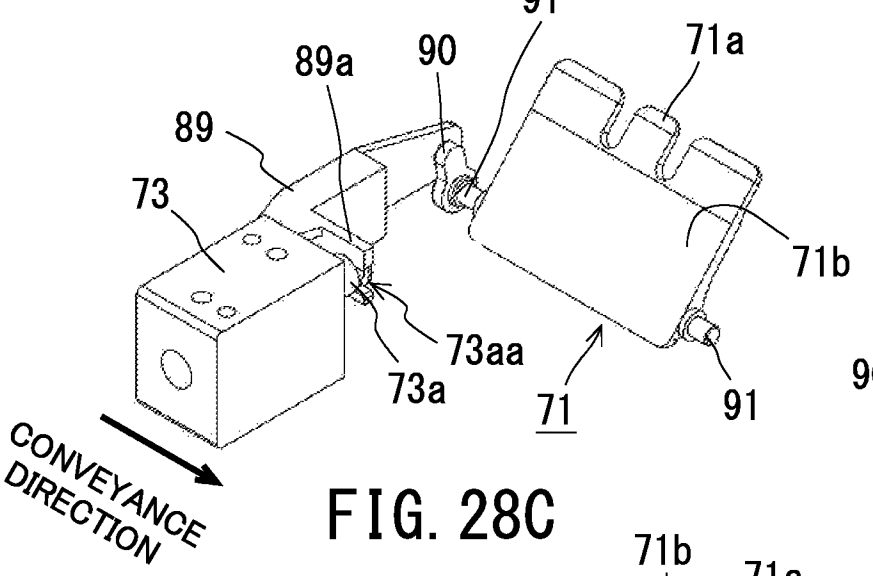
FIG. 28A is a perspective view showing the rejection flap and its driving solenoid provided in the first distribution section of the coin conveyance and distribution unit of the apparatus of FIG. 1, in which the rejection flap is located at a switched position, which is seen obliquely downward from the upper right front.
Figure 28B:
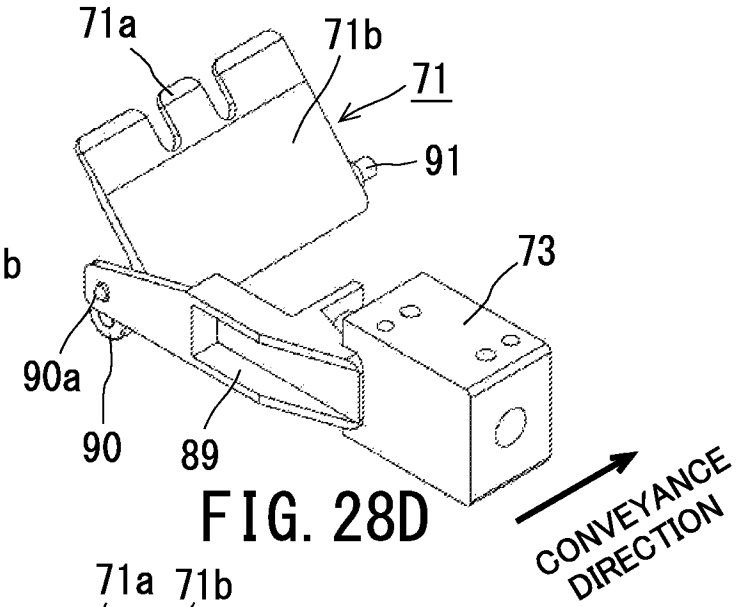
FIG. 28B is a perspective view showing the rejection flap and its driving solenoid of FIG. 28A, which is seen obliquely downward from the upper left front.
Figure 28C:
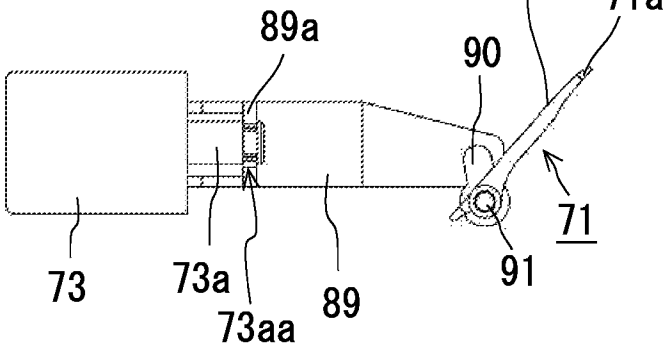
FIG. 28C is a right side view showing the rejection flap and its driving solenoid of FIG. 28A.
Figure 28D:
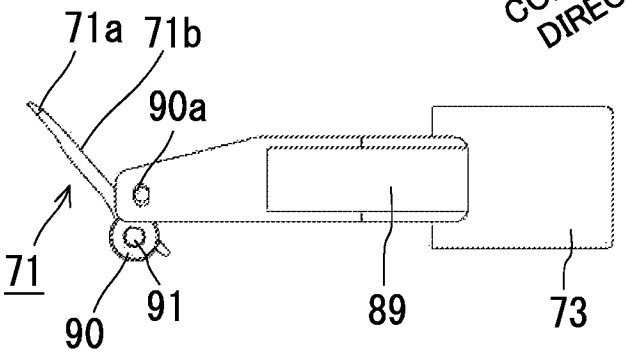
FIG. 28D is a left side view showing the rejection flap and its driving solenoid of FIG. 28A.
Figure 29:
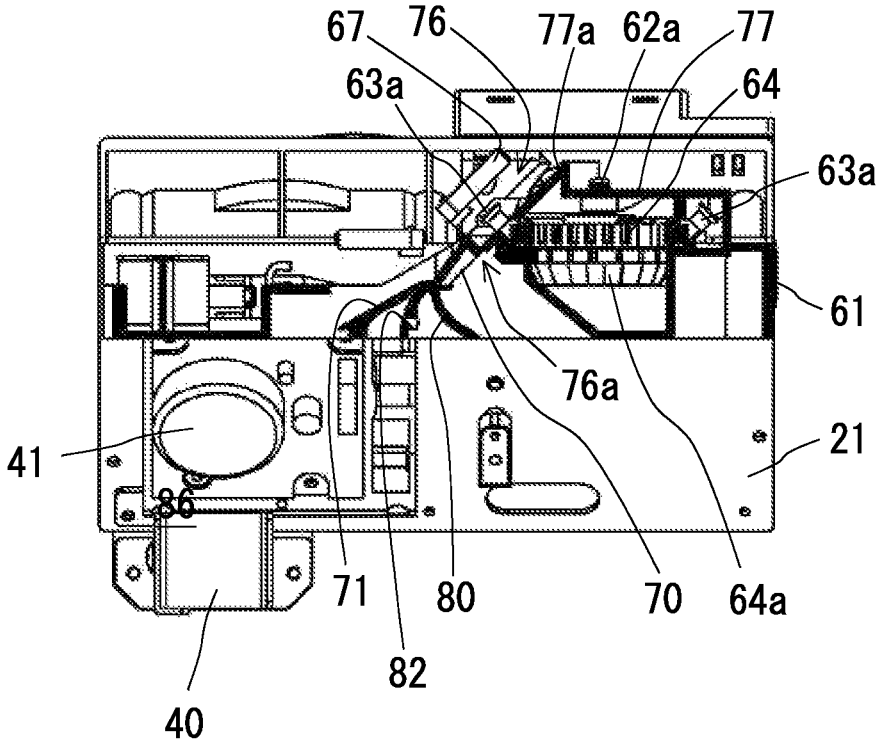
FIG. 29 is a partial cross-sectional view showing the internal structure of a coin distribution mechanism (which includes the distribution flap, the rejection flap, and the driving solenoids for driving these two flaps) provided in the first distribution section of the coin conveyance and distribution unit of the apparatus of FIG. 1.

An example of the rejection flap 71 and the driving mechanism thereof, which are provided in the first distribution section D1 only, is shown in FIGS. 26 to 28.

As clearly seen from FIGS. 26 to 28, the rejection flap 71 has a shape of an approximately rectangular plate whose top end 71*a* is tapered and grooved. The tapered and grooved top end 71*a* is formed for the purpose described below.

Specifically, when the entrance of the third chute 82 is closed by contacting the top end 71*a* of the rejection flap 71 with the upper end of the third chute 82 (at the default position), a coin C that is dropped through the relevant gate 76*a* which is provided in the first distribution section D1 to move in the obliquely forward and downward direction and that is moved on the first side face 70*a* of the distribution flap 70 can be smoothly transferred to the surface 71*b* of the rejection flap 71 to be slid forward due to the top end 71*a*. During this moving action of the coin C, the surface 71*b* of the rejection flap 71 serves as a guide surface or member for sending the said coin C toward the relevant front hopper 84.

The driving mechanism for the rejection flap 71 as the position switching device for the flap 71, i.e., the rejection flap driving mechanism, comprises the rejection flap driving solenoid 73, a driving member 89 which is engaged with a plunger (a movable core) 73*a* of the solenoid 73, a linking member 90 for linking the rejection flap 71 with the driving member 89, and a pair of pivoting shafts 91 for pivotably supporting the rejection flap 71. One end of each pivoting shaft 91 is fixed to an opposing end of the flap 71 and the other end thereof is pivotably supported at a predetermined position in the sensor and solenoid mounting section of the main body 61. The pair of pivoting shafts 91 is held in the main body 61 in such a way as to be parallel to the bottom surface of the main body 61. Thus, when the apparatus 1 is placed on a horizontal surface, the rejection flap 71 can be pivoted around the pair of pivoting shafts 91 which is held to be approximately horizontal. The pair of pivoting shafts 91 is extended along the conveyance direction of coins C in a horizontal plane.

The driving member 89 is formed by an approximately linear bar-shaped material. An engaging part 89*a*, which has an approximately U-shaped opening, is formed near the base end of the driving member 89. The engaging part 89*a* is engaged with a circular engaging groove 73*aa* formed at the top end of the plunger 73*a* of the solenoid 73. Because of the engagement structure of the engaging part 89*a* and the engaging groove 73*aa*, the driving member 89 can be moved linearly (i.e., reciprocated) as desired by the protruding and retracting action of the plunger 73*a*.

The linking member 90 is formed by an approximately linear bar-shaped material having a circular opening at its one end and a protrusion 90*a* at its other end. The circular opening of the linking member 90 is engaged with an opposing one of the two pivotable shafts 91. The protrusion 90*a* of the linking member 90 is rotatably engaged with a circular opening formed at the end of the driving member 89. The linking member 90, which is engaged with the relevant pivotable shaft 91 and the driving member 89, constitutes "a crank mechanism" for converting the horizontal linear motion (horizontal reciprocation) of the driving member 89 generated by the plunger 73*a* of the solenoid 73 to the pivoting motion of the pivotable shafts 91 or the rejection flap 71.

The rejection flap driving solenoid 73 is placed outside the sensor and solenoid mounting section of the main body 61 and is located at a position which is slightly shifted forward horizontally from this section (see FIG. 21). The plunger 73*a* of the solenoid 73, which is perpendicular to the coin conveyance direction in a horizontal plane, is configured to take any one of the "retracted position" and the "protruded position".

Specifically, when the solenoid 73 is energized by applying a positive (or negative) voltage, the plunger 73*a* is protruded to be located at the "protruded position". When the solenoid 73 is not energized, in other words, the positive (or the negative) voltage is not applied to the solenoid 73, the plunger 73*a* is kept at the "retracted position". As a result, the state or attitude of the rejection flap 71 can be selectively set at any one of the "default position B0" shown in FIG. 27 and the "switched position B1" shown in FIG. 28 by energizing or deenergizing the solenoid 73 using an application voltage with a predetermined polarity.

As shown in FIG. 26, when the rejection flap 71 is located at the default position B0 (see FIG. 27), the central plane of the flap 71 is inclined at a predetermined angle with respect to the pivoting shafts 91 which are held to be approximately horizontal (see FIG. 26). At the default position B0, the entrance of the third chute 82 is configured to be closed by the flap 71 in the first distribution section D1. Thus, a coin C that is conveyed on the coin conveyance path 76 and dropped through the relevant gate 76*a* in the first distribution section D1 to move in the obliquely forward and downward direction is sent toward the relevant front hopper 84 by way of the first side face 70*a* of the distribution flap 70 which is located at the second switched position A2 and the surface 71*b* of the rejection flap 71 which is located at the default position B0 and then, stored therein.

When the rejection flap 71 is displaced to the switched position B1 (see FIG. 28) from the "default position B0" by the action of the rejection flap driving solenoid 73, the central plane of the flap 71 is pivoted upward by an angle ϕ around the pair of pivoting shafts 91 (see FIG. 26). At the switched position B1, the rejection flap 71 opens the entrance of the third chute 82, in other words, makes the third chute 82 available. Therefore, a coin C that is dropped through the relevant gate 76*a* in the first distribution section D1 to move on the first side face 701 of the distribution flap 70 which is located at the second switched position A2 is not sent to the relevant front hopper 84 but is guided by the third chute 82 to be dropped onto the dispensing belt (not shown) which is provided just below the third chute 82.

The structure of the rejection flap 71 and that of its driving mechanism are not limited to those described here, and it is needless to say that any other structures may be used for this purpose. Moreover, any other driving device such as an electric motor may be used instead of the rejection flap driving solenoids 73. The driving mechanism also is not limited to that including the driving member 89 and the linking member 90; any other structure may be used for this purpose. In summary, any other structure may be used for this purpose if the rejection flap 71 can be selectively located at any one of the "default position B0" and the "switched position B1" according to the necessity.

Next, the constituent elements of the coin conveyance and distributing section 60 other than the main body 61, the guide rail 66, and the first to fourth distribution sections D1 to D4 will be described below.

Figure 19:
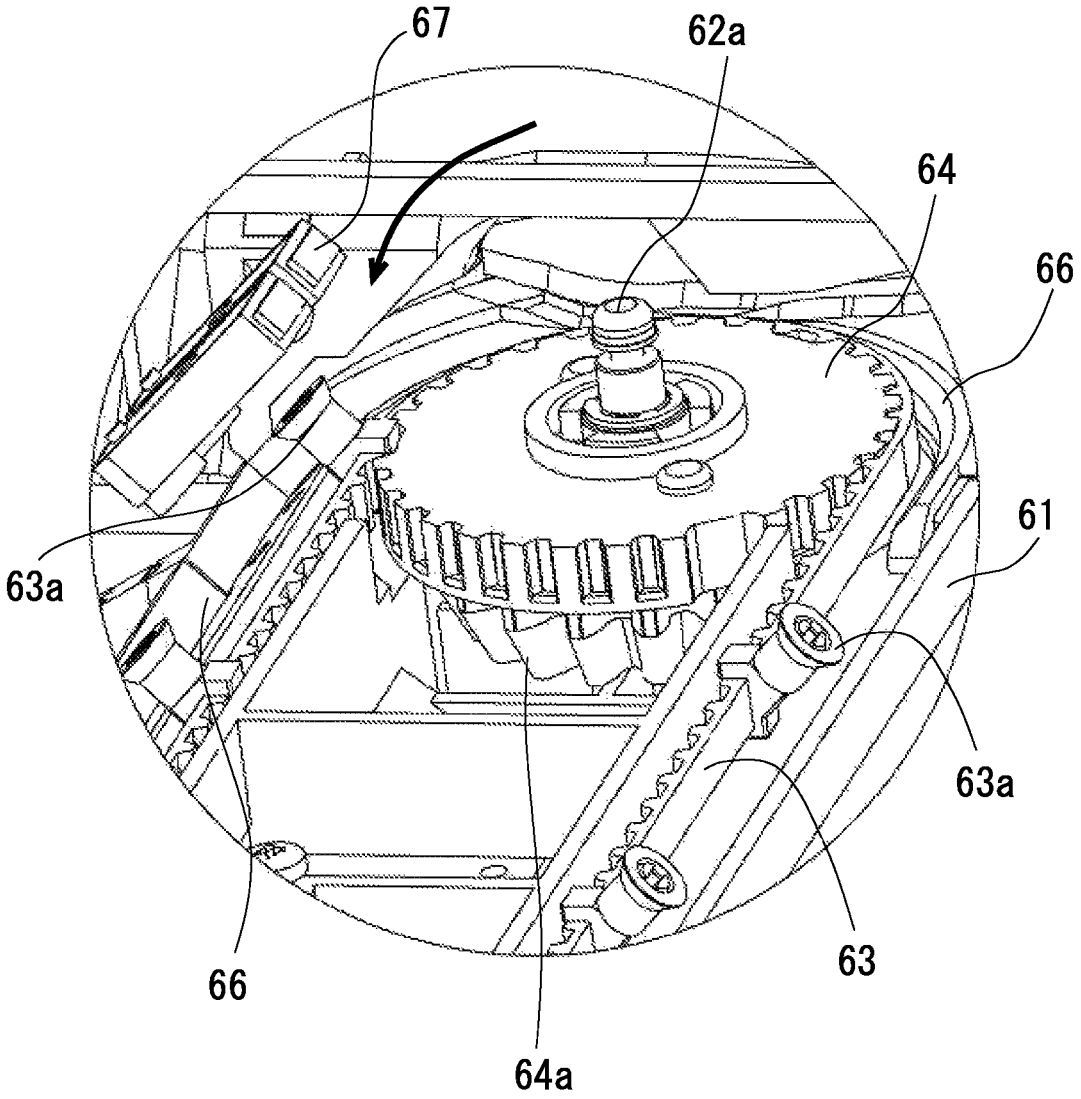
FIG. 19 is a partial enlarged partial explanatory view showing the structure of the second delivery region which is formed at the connecting part of the coin separation and discrimination unit and the coin conveyance and distribution unit in the apparatus of FIG. 1.

The endless belt 63, which is provided in the endless belt receiving section of the main body 61, comprises gear teeth and is stretched between the two driven gears 64 and 65 which are fixed at the predetermined distance. The driven gears 64 and 65 are respectively supported by rotational axes 62*a* and 62*b* and are respectively rotated around these axes 62*a* and 62*b*. The belt 63 is placed to be approximately horizontal. Since the driven gear 64 disposed near the coin separation and discrimination unit 20 is connected to the driven gear 45 disposed in the same unit 20 by way of a linking gear 64*a* (see FIG. 19) which is connected to the overlying driven gear 64, the driven gear 64 is rotationally driven by the electric motor 41 provided in the coin separation and discrimination unit 20. For this reason, the belt 63 is also rotationally driven by the motor 41 similar to the rotary disk 26 and the rotary wiper 27. The driven gear 64 may be rotationally driven by any other electric motor than the motor 41 provided in the unit 20. As shown in FIG. 9, the pins 63*a* are fixed to the belt 63 at the predetermined distances and thus, coins C are successively engaged with any one of these pins 63*a* and conveyed on the coin conveyance path 76 according to the traveling of the belt 63. Since the endless belt receiving section is covered with the rear cover 77, the belt 63 and the driven gears 64 and 65 are not seen from the outside.

The sensors provided in the sensor and solenoid mounting section of the main body 61 are the incoming coin sensor 67, the moving coin sensors 68, and the dropping coin sensors 69 (see FIG. 9). These sensors 67, 68, and 69 are optical sensors, each of which has a light-emitting element and a light-receiving element. The optical sensors of this type are configured to detect the presence or absence of irradiation light which is emitted from the light-emitting element using the light-receiving element. Specifically, for example, when a coin C does not pass through a detection region of the optical sensor, the light-receiving element receives the irradiation light which is emitted from the light-emitting element continuously. On the other hand, when a coin C passes through the detection region, the irradiation light is temporarily blocked by the coin C and as a result, the light-receiving element does not detect the said light temporarily. In this way, the optical sensor can detect arrival or passing of a coin C by detecting the presence or absence of the irradiation light. It is needless to say that any other sensors than optical sensors may be used as the sensors 67, 68, and 69. In addition, all of these sensors 67, 68, and 69 are disposed on the surface (i.e., the inclined portion 78*a*) of the front cover 78 (see FIG. 1). In FIG. 4, FIGS. 8 to 11, FIG. 21, and FIGS. 29 to 44, the front cover 78 is omitted for clear viewing and therefore, the sensors 67, 68, and 69 are illustrated as if they are floating in the air.

Figure 16:
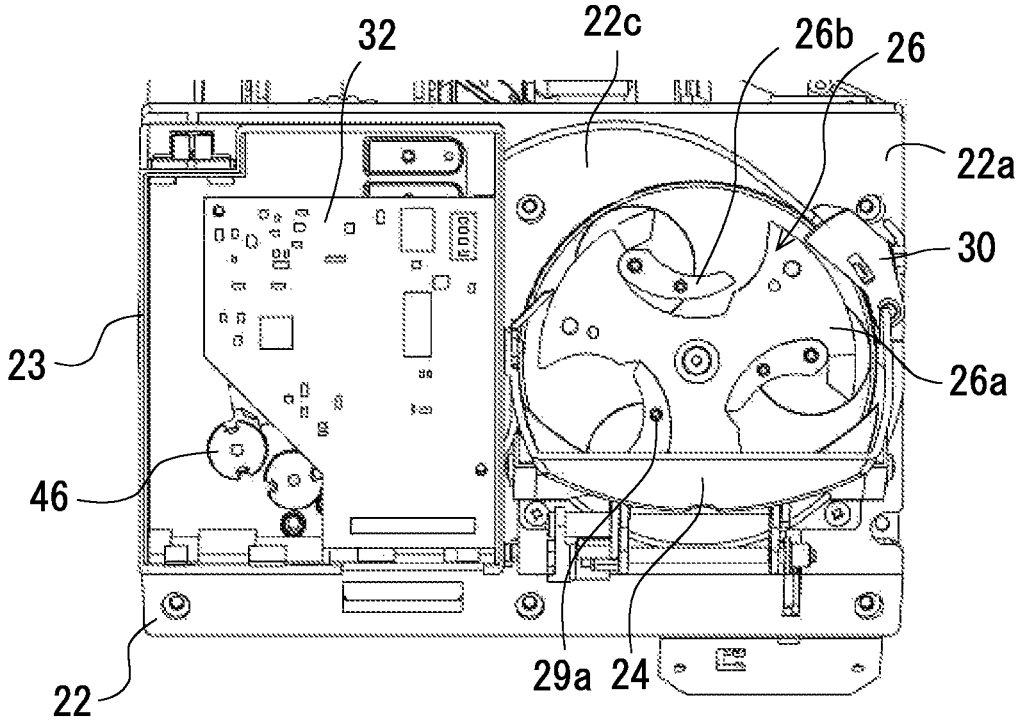
FIG. 16 is a partial explanatory view showing the structure of the coin separation and discrimination unit of the apparatus of FIG. 1, in which a lid of the substrate box is detached.
Figure 17:
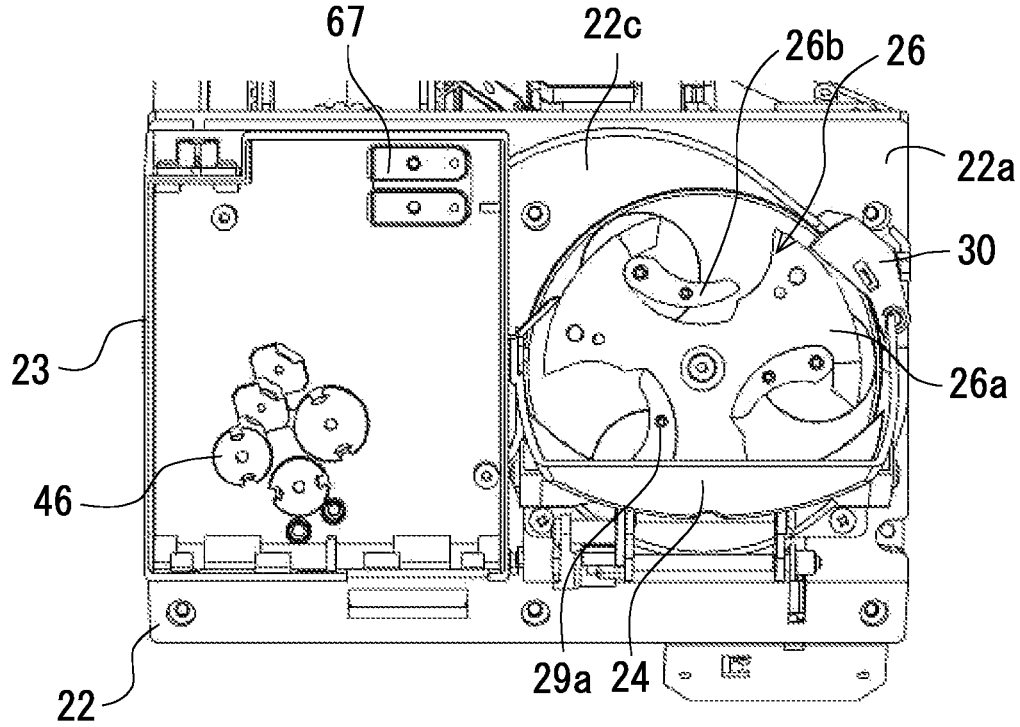
FIG. 17 is a partial explanatory view showing the structure of the coin separation and discrimination unit of the apparatus of FIG. 1, in which the lid of the substrate box and a control substrate provided in the substrate box is detached.

The incoming coin sensor 67 is disposed on the inclined portion 78*a* of the front cover 78 at the starting end of the coin conveyance path 76, which is at a position immediately before the first distribution section D1. This sensor 67 detects the presence or absence of the introduction of a coin C into the coin conveyance path 76 and the introduction timing thereof when the introduction of the coin C is present. By the output signal of the incoming coin sensor 67, a control device (a control program) of the apparatus 1 for discriminating and conveying coins, which is mounted on a control substrate 32 (see FIG. 16) disposed in the substrate box 23 of the coin separation and discrimination unit 20, can know or find the presence or absence of the introduction of an incoming coin C into the path 76 and the introduction timing thereof when the introduction of an incoming coin C is present.

The four moving coin sensors 68, which are arranged on the inclined portion 78*a* of the front cover 78 along the coin conveyance path 76 at the predetermined distances (here, at equal distances), are respectively disposed at positions immediately after the four relevant gates 76*a* of the first to fourth distribution sections D1, D2, D3, and D4. Each of these sensors 68 detects the presence or absence of arrival of a moving coin C that is conveyed on the coin conveyance path 76 at a corresponding one of the gates 76*a* in the first, second, third, or fourth distribution section D1, D2, D3, or D4, and the arrival timing thereof when the arrival of a moving coin C is present. By the output signal of each moving coin sensor 68, the control device (the control program) of the apparatus 1, which is mounted on the control substrate 32, can know or find the presence or absence of the arrival of a moving coin C at the position immediately after the corresponding gate 76*a* to the first, second, third, or fourth distribution section D1, D2, D3, or D4, and the arrival timing thereof when the arrival of a moving coin C is present.

The four dropping coin sensors 69 are arranged on the flat portion of the front cover 78 along the coin conveyance path 76 at the predetermined distances (here, at equal distances) to be slightly apart forward from the path 76. These four sensors 69 are respectively disposed at the positions right above two distribution paths 79*a* and two distribution paths 79*b* (see FIGS. 5 and 6) which lead respectively to the four gates 76*a* of the first to fourth distribution sections D1, D2, D3, and D4. Each of these sensors 69 detects the presence or absence of the dropping of a coin C through the corresponding gate 76*a* of the first, second, third, or fourth distribution section D1, D2, D3, or D4 when the said gate 76*a* is opened, and the total number of the dropped coins C when the dropping of a coin C is present. By the output signal of each dropping coin sensor 69, the control device (the control program) of the apparatus 1, which is mounted on the control substrate 32, can know or find the presence or absence of the dropping of a coin or coins C through the corresponding gate 76*a* and the total number thereof when the dropping of a coin or coins C is present.

The overflow path 75 is disposed at the terminal end of the coin conveyance path 67 (see FIG. 1) and is used for collecting an overflowed coin or coins C, that is, a coins or coins C that exceed(s) the corresponding one of the storage limits of the rear and front hoppers 83 and 84 which are respectively placed below the distribution paths 79*a* and 79*b*. Since the overflow path 75 has an opening which is formed at the bottom surface of the coin conveyance and distribution unit 60 (see FIG. 5), the overflowed coin(s) C is/are quickly sent to an overflown coin collecting container 85 (see FIG. 45) and stored therein. The judgement whether or not a coin or coins C is/are overflowed and the coin discharging process which is carried out according to the judgement of overflow are controlled by a control device (a control program) mounted on a main apparatus (e.g., a coin depositing/dispensing apparatus, not shown) into which the apparatus 1 according to this embodiment is incorporated; this is the same as the aforementioned coin distribution processes in the first to fourth distribution sections D1 to D4. Unlike this, the control device (the control program) which is mounted on the control substrate 32 provided in the substrate box 23 of the apparatus 1 according to this embodiment controls only the coin separation and discrimination processes of the coin separation and discrimination unit 20.

Figure 18:
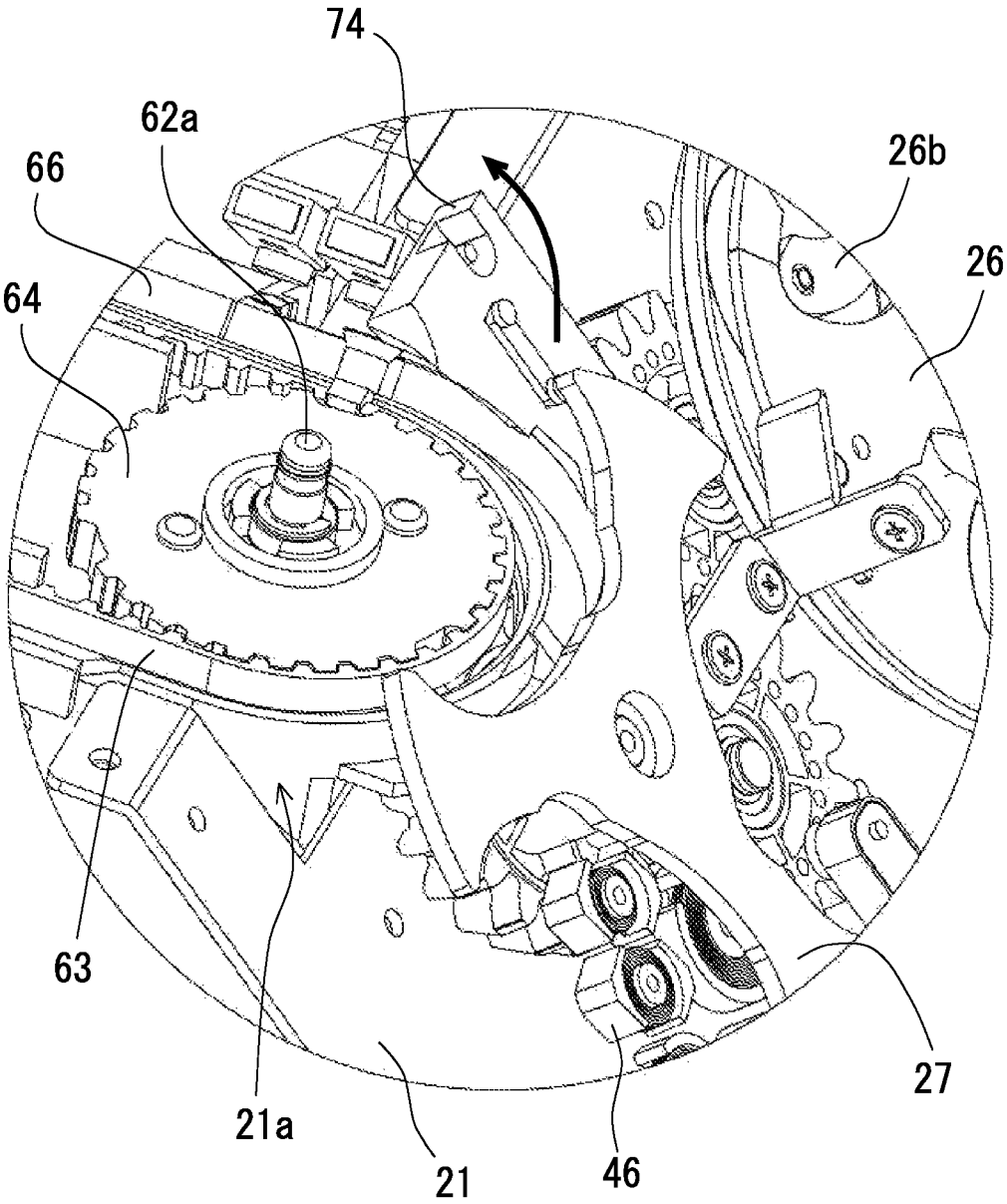
FIG. 18 is a partial enlarged partial explanatory view showing the structure of a second delivery region which is formed at the connecting part of the coin separation and discrimination unit and the coin conveyance and distribution unit in the apparatus of FIG. 1.

As shown in FIGS. 10 and 18, a plate-shaped direction changing member 74 is provided near the starting end of the coin conveyance path 76. The direction changing member 74 is a member that is used for changing the moving direction of coins C that have delivered toward the coin conveyance path 76 through the second delivery region P2 from the coin separation and discrimination unit 20, thereby enabling the delivered coins C to arrive at the starting end of the path 76 to enter the same correctly and smoothly. The direction changing member 74 is provided while taking the following points into consideration.

Specifically, the coin conveyance path 76, which is formed by the guide rail 66, the inclined portion 77*a* of the rear cover 77, and the inclined portion 78*a* of the front cover 78, is extended in the Y direction shown in FIG. 9 in a horizontal plane. Moreover, the coin separation and discrimination unit 20 is extended in the X direction shown in FIG. 9 in such a state as to be inclined at approximately 45° with respect to the horizontal plane. Therefore, the opening direction of the starting end of the coin conveyance path 76 is shifted by approximately 90° with respect to the extending direction of the coin separation and discrimination unit 20. On the other hand, at the exit of the second delivery region P2 in the coin separation and discrimination unit 20, coins C are thrown in the obliquely forward and downward direction so as to move away from the unit 20 (specifically, the upper wall 22*a* of the casing 22 and the base plate 21), in other words, toward the starting end of the coin conveyance path 76, due to the rotational driving force of the rotary wiper 27 and the gravity.

The coins C thus thrown in this way will drop gradually in the obliquely forward and downward direction due to the gravity through the vicinity of the back of the base plate 21 of the coin separation and discrimination unit 20 and thereafter, the said coins C will move away from the back of the base plate 21 gradually and at the same time, will approach gradually the starting end of the coin conveyance path 76. However, even in the vicinity of the starting end of the path 76, the moving direction of the said coins C has a large difference (e.g., approximately 45° to 50°) from the opening direction of the starting end (i.e., the entrance) of the path 76. This means that it is difficult for the said coins C to enter the entrance of the path 76 surely and smoothly from the exit of the second delivery region P2 without changing the moving direction of the said coins C.

Accordingly, by mounting or providing the direction changing member 74 in the intermediate part (or the connecting part) between the exit of the second delivery region P2 and the entrance of the coin conveyance path 76 so as to be located at an appropriate position on the moving path of the said coins C which have been thrown from the exit of the second delivery region P2, as shown in FIGS. 10 and 18, the moving direction of the coins C that have been thrown from the second delivery region P2 is forcibly changed due to contact or collision with the direction changing member 74, thereby matching the moving direction of the coins C with the opening direction of the entrance of the coin conveyance path 76.

In this way, the coins C that have been thrown from the second delivery region P2 can be introduced into the entrance of the coin conveyance path 76 surely and smoothly and as a result, the coins C can be successively conveyed by the endless belt 63 in the coin conveyance and distribution unit 60 in spite of the moving direction of the coins C being changed by approximately 90° in a horizontal plane.

Relationship Between Moving Directions of Coins in Two Units

Next, the relationship between the moving direction of coins C in the coin separation and discrimination unit 20 and that in the coin conveyance distributing unit 60 will be explained below.

As clearly understood from the aforementioned explanation, the coin separation section using the rotary disk 26 and the coin discrimination section using the rotary wiper 27, which are combined together to form the coin separation and discrimination unit 20 in this embodiment, are mounted on the flat surface of the upper wall 22*a* of the casing 22. Coins C are separated from each other one by one while being rotated by the rotary disk 26 in the coin separation section and thereafter, the coins C thus separated are delivered to the coin discrimination section by way of the first delivery region P1 in their predetermined attitude, in other words, in the standing state which is inclined along the upper wall 22*a*. In the coin discrimination section, the coins C thus delivered are subject to denomination discrimination and authenticity denomination while being rotated by the rotary wiper 27 and thereafter, the coins C thus discriminated are delivered to the coin conveyance and distributing unit 60 by way of the second delivery region P2. Accordingly, it is apparent that these two processes, i.e., the separation process and the discrimination process, are carried out on the flat surface of the upper wall 22*a* while rotating the coins C to be processed on the same surface. Moreover, it is also apparent that the delivery action of the coins C to the coin discrimination section from the coin separation section by way of the first delivery region P1 is carried out on the upper wall 22*a* in an approximately horizontal direction. Accordingly, it is understood that the aforementioned two processes of the coin separation and discrimination unit 20 are carried out while moving the coins C along a plane which contains the flat surface of the upper wall 22*a* in a horizontal direction.

Here, the apparatus 1 of this embodiment is mounted on a horizontal surface. Thus, when seeing the moving state or flow of the coins C in the coin separation and discrimination unit 20 macroscopically from an upper viewpoint, in other words, when seeing it macroscopically in a plan view, it can be said that the aforementioned two processes of the coin separation and discrimination unit 20 are carried out while moving the coins C in the X direction which is indicated by an up arrow in FIG. 9 in a horizontal plane, in other words, the moving direction of the coins C during the processes of the coin separation and discrimination unit 20 is the X direction indicated by the up arrow in FIG. 9.

On the other hand, in the coin conveyance and distributing unit 60, the apparatus 1 of this embodiment is mounted on the horizontal surface and therefore, the coin conveyance path 76, which is formed by the combination of the guide rail 66 and the inclined portions 77*a* and 78*a* of the rear and front covers 77 and 78, is extended along the longitudinal axis of the elongated main body 61 in an approximately horizontal plane. Coins C to be processed are subjected to the distribution process according to the predetermined denominations and inappropriate coins C to be rejected are subjected to the discharging process while being conveyed on the coin conveyance path 76 and then, the coins C thus distributed in this way are stored in any one of the eight hoppers 83 and 84.

Accordingly, when seeing the moving state or flow of the coins C in the coin conveyance and distributing unit 60 macroscopically from an upper viewpoint, it can be said that the two processes of the coin distribution and the rejection coin discharge in the unit 60 are carried out while moving the coins C in the Y direction which is indicated by a rightward arrow in FIG. 9 in the horizontal plane, in other words, the moving direction of the coins C during the processes of the unit 60 is the Y direction indicated by the rightward arrow in FIG. 9.

Since the aforementioned X and Y directions are perpendicular in the horizontal plane, as shown in FIG. 9, it can be said that the macroscopic moving direction (i.e., the X direction) of the coins C in the coin separation and discrimination unit 20 and the macroscopic moving direction (i.e., the Y direction) of the coins C in the coin conveyance and distributing unit 60 have an orthogonal relationship to each other. As a result, there arises an advantage that the overall length of the apparatus 1 according to this embodiment of the present invention in the Y direction can be reduced compared with the conventional one disclosed in the aforementioned Publication No. 5760233 where the macroscopic moving direction of the coins C in the coin separation and discrimination unit and that in the coin conveyance and distributing unit are the same. This is due to the following reason.

Specifically, in the coin separation and discrimination unit 20, the rotary disk 26 is used for coin separation and the rotary wiper 27 is used for coin discrimination and furthermore, the processing surface of the coin separation section and that of the coin discrimination section are disposed to be adjacent to each other on the flat surface of the upper wall 22*a*. Accordingly, the length Lx20 of the coin separation and discrimination unit 20 in the X direction in FIG. 9 is approximately equal to the sum of the diameter D26 of the disk 26 and the diameter D27 of the wiper 27. Thus, the equation of Lx20÷D26+D27 is established. On the other hand, both of the disk 26 and the wiper 27 are flat plate-shaped and are mounted to be inclined at approximately 45° with respect to the horizontal plane. Moreover, the diameter D27 of the wiper 27 is slightly larger than the diameter D26 of the disk 26. Accordingly, it can be said that the length Ly20 of the coin separation and discrimination unit 20 in the Y direction in FIG. 9 is (1/1.4)÷0.7 times as much as the diameter D27 of the wiper 27. Thus, the equation of Ly20÷0.7×D27 is established. This means that the length Lx20 of the coin separation and discrimination unit 20 in the X direction is larger than twice as much as the length Ly20 of the unit 20 in the Y direction. In other words, there is the dimensional relationship that the length Ly20 of the unit 20 in the Y direction is smaller than a half (½) of the length Lx20 of the unit 20 in the X direction.

Accordingly, with the apparatus 1 according to this embodiment where the macroscopic moving direction of coins C in the coin separation and discrimination unit 20 and that in the coin conveyance and distribution unit 60 are perpendicular to each other, it is apparent that the overall length Ly1 of the apparatus 1 in the Y direction can be considerably reduced compared with the conventional one disclosed in the aforementioned Publication No. 5760233 where the macroscopic moving direction of the coins C in the coin separation and discrimination unit and that in the coin conveyance and distributing unit are the same. This contributes the downsizing and/or space saving of the apparatus 1.

In addition, with the apparatus 1 according to this embodiment, the overall length Lx20 of the coin separation and discrimination unit 20 in the X direction is slightly larger than the conventional one disclosed in the aforementioned Publication No. 5760233 where the macroscopic moving direction of the coins C in the coin separation and discrimination unit and that in the coin conveyance and distributing unit are the same. This means that the overall length Lx1 of the apparatus 1 in the X direction is slightly larger than the conventional one disclosed in the aforementioned Publication No. 5760233. However, the manufacturer can easily cope or deal with such the slight enlargement of the overall length Lx1 of the apparatus 1 as described here in the main apparatus (e.g., the coin depositing/dispensing apparatus) into which the apparatus 1 of this embodiment is incorporated. Accordingly, there arises no problem due to the slight enlargement of the overall length Lx1.

Operation of Apparatus for Coin Discriminating and Conveying Coins

Next, the operation of the apparatus 1 for discriminating and conveying coins according to the embodiment of the present invention will be explained below with reference to FIGS. 15A to 15O and FIGS. 31 to 45.

Figure 15A:
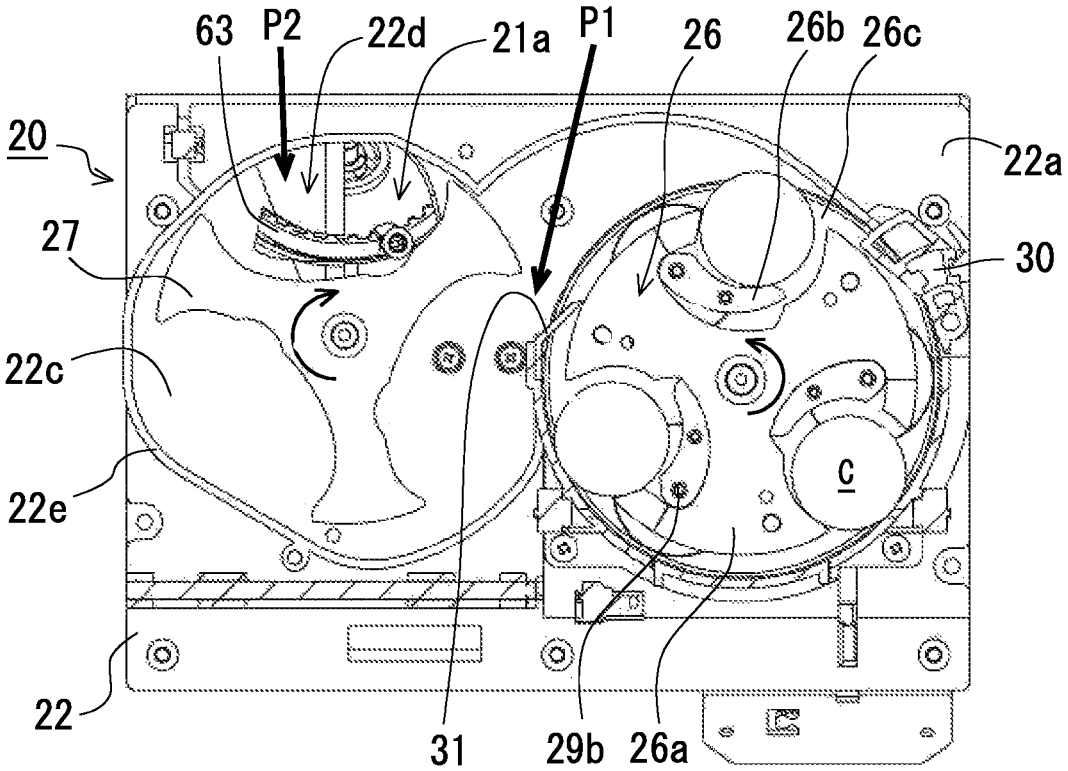
FIG. 15A is a partial explanatory view showing the coin feeding operation of the coin separation and discrimination unit of the apparatus of FIG. 1, in which the head and the substrate box are detached.

FIGS. 15A to 15O are partial explanatory views showing the coin feeding operation of the coin separation and discrimination unit 20 of the apparatus 1 shown in FIG. 1, in which the head 24 and the substrate box 23 are detached for easy viewing.

First, as shown in FIG. 15A, it is supposed that three coins C (which are respectively termed first, second and third coins here) are introduced into the coin separation section of the coin separation and discrimination unit 20. Since the coin separation section is structured in such a way that coins C stored in the coin storage unit 10 are entered the three engaging recesses 26*c* one by one by the counterclockwise rotation of the rotary disk 26, such the state as described here is easily realized.

Figure 15B:
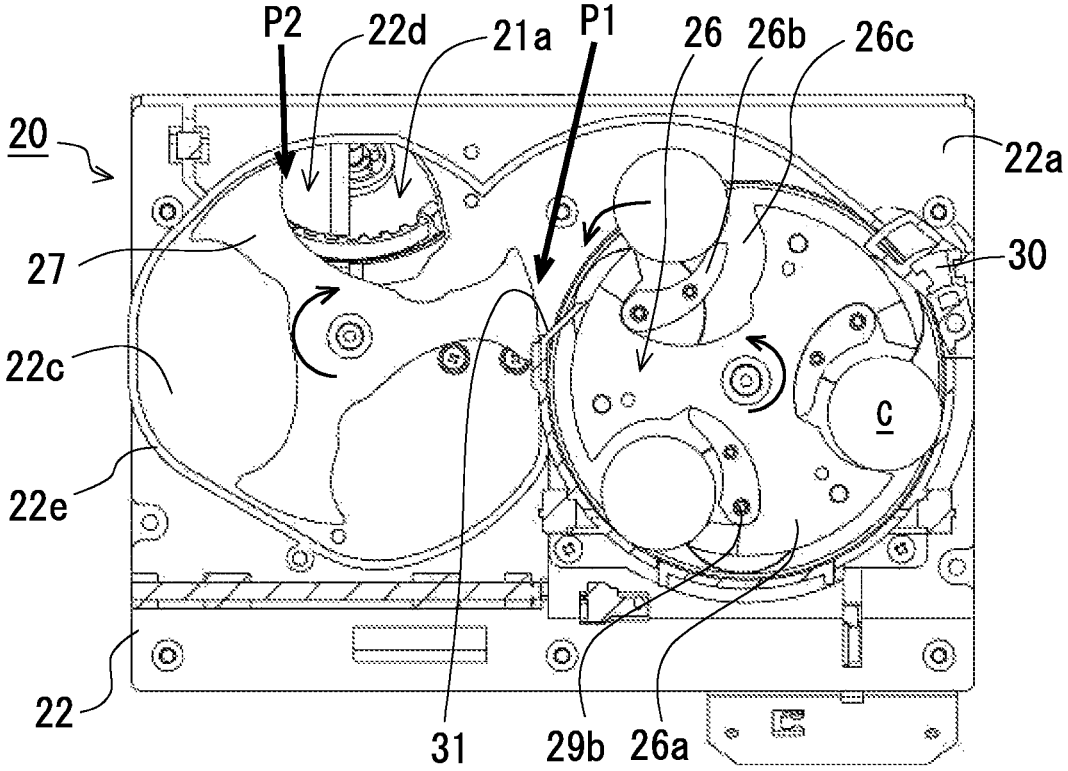
FIG. 15B is a partial explanatory view showing the coin feeding operation of the coin separation and discrimination unit of the apparatus of FIG. 1, in which the head and the substrate box are detached, which is subsequent to FIG. 15A.

When the rotary disk 26 is further rotated from the state in FIG. 15A to arrive at a position where the first coin C has gone slightly beyond the uppermost position of the disk 26, the relevant pushing member 26*b* which is adjacent to the first coin C is moved around the relevant pivoting shaft 29*b*, thereby pushing the first coin C outward from the relevant engaging recess 26*c*. FIG. 15B shows this state.

Figure 15C:
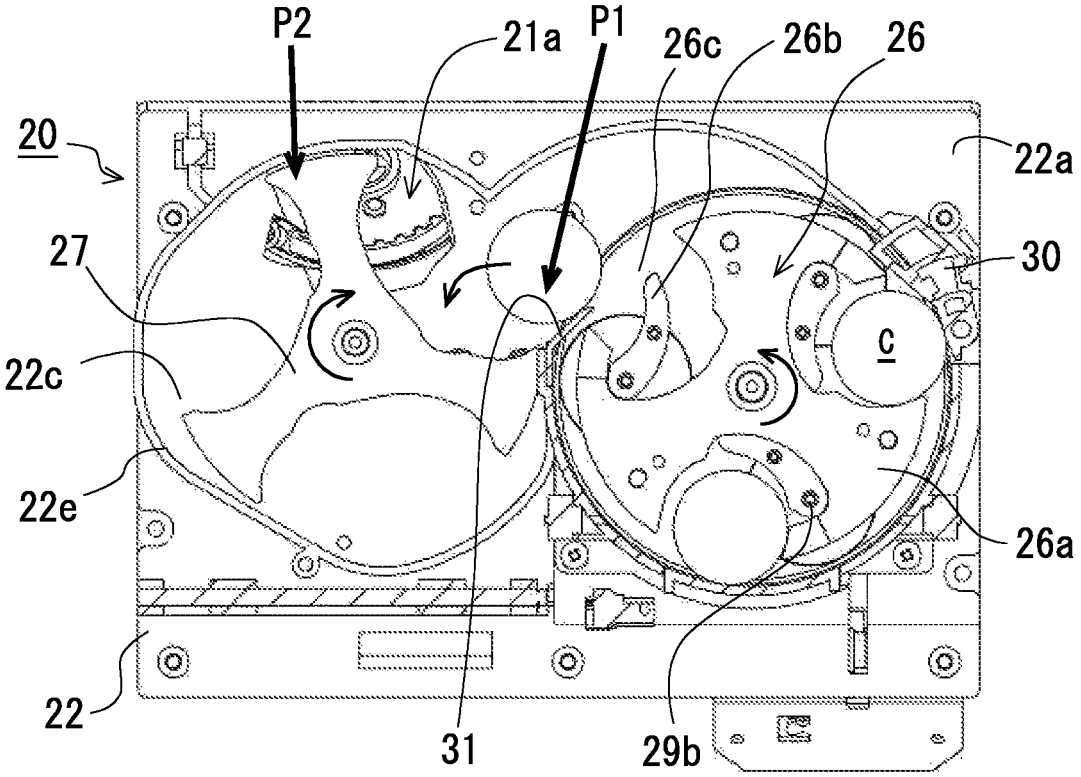
FIG. 15C is a partial explanatory view showing the coin feeding operation of the coin separation and discrimination unit of the apparatus of FIG. 1, in which the head and the substrate box are detached, which is subsequent to FIG. 15B.
Figure 15D:
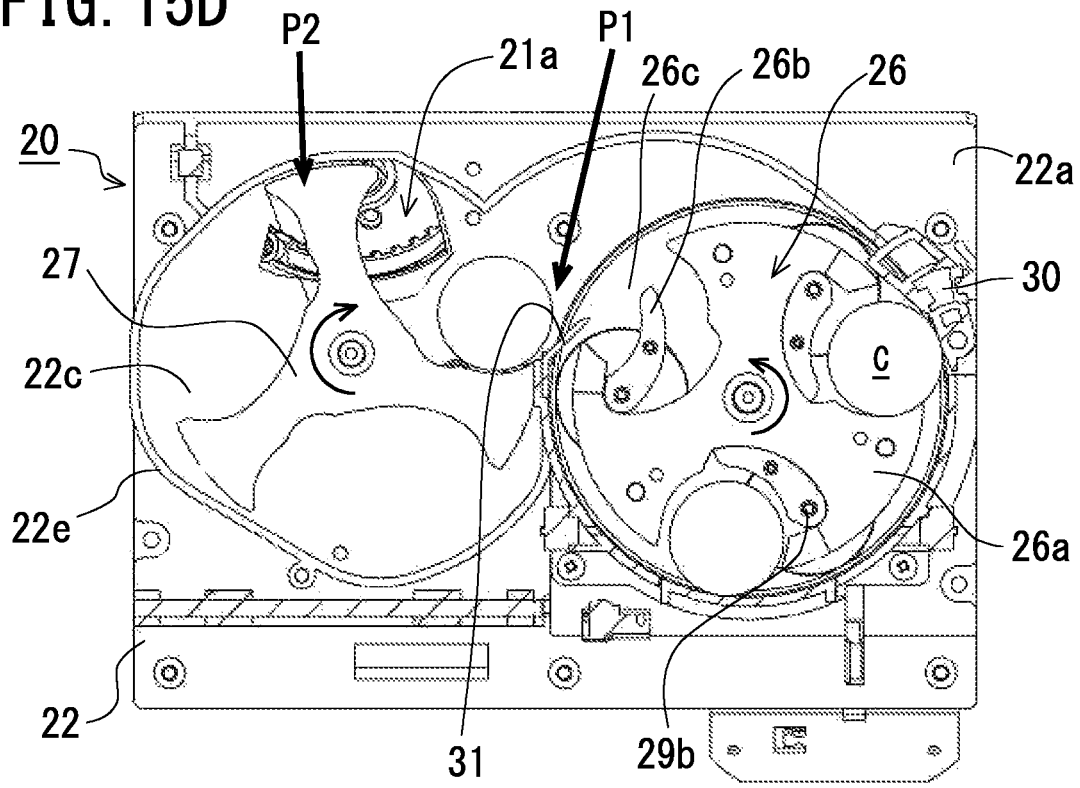
FIG. 15D is a partial explanatory view showing the coin feeding operation of the coin separation and discrimination unit of the apparatus of FIG. 1, in which the head and the substrate box are detached, which is subsequent to FIG. 15C.

Following this, as shown in FIG. 15C, when the first coin C is pushed out from the relevant engaging recess 26*c* by the pushing action of the relevant pushing member 26*b* at the position where the first coin C has gone beyond the uppermost position of the disk 26 slightly, the first coin C is contacted with the delivery direction regulation member 31 which is fixed to the upper wall 22*a* of the casing 22 and as a result, the moving direction of the first coin C is regulated to a direction toward the coin discrimination section. Consequently, the first coin C is forcibly moved to the side of the coin discrimination section. Furthermore, since the first coin C is kept dropping at this stage due to the gravity, it is received by one of the three arms of the rotary wiper 27 which is disposed at the closest position, as shown in FIG. 15D. At this stage, the first coin C thus received is contacted with the upstream side edge of the closest-positioned arm. In this way, the first coin C is surely delivered to the coin discrimination section from the coin separation section by way of the first delivery region P1.

Figure 15E:
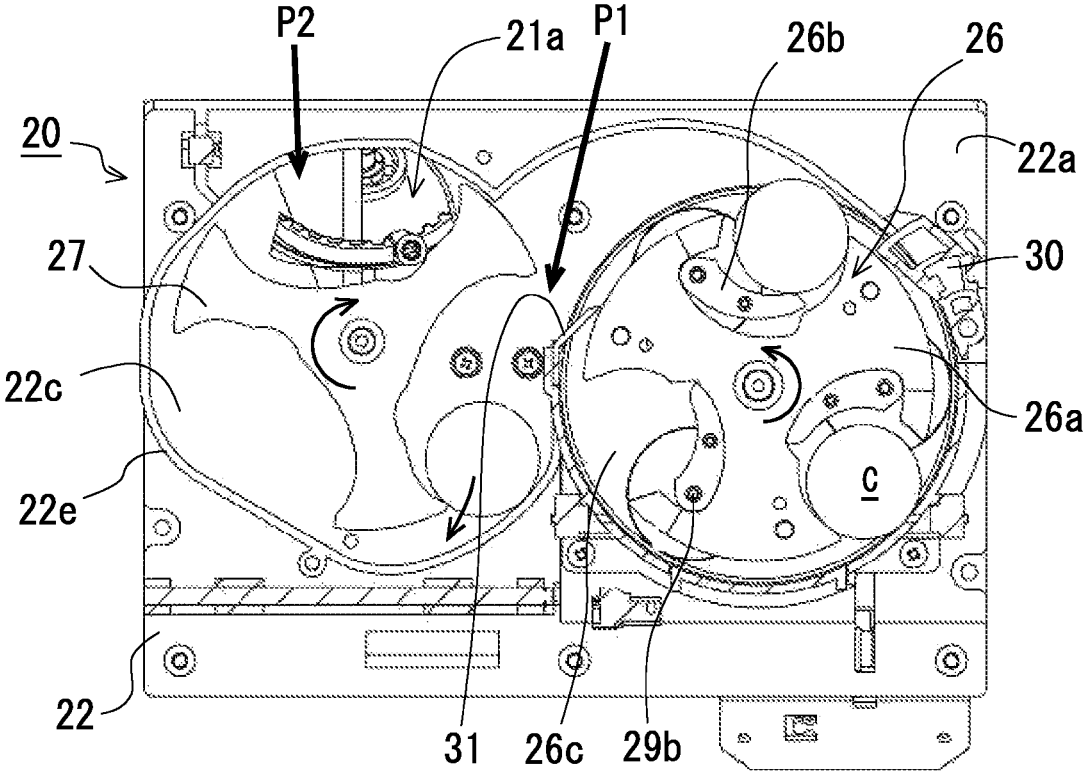
FIG. 15E is a partial explanatory view showing the coin feeding operation of the coin separation and discrimination unit of the apparatus of FIG. 1, in which the head and the substrate box are detached, which is subsequent to FIG. 15D.
Figure 15F:
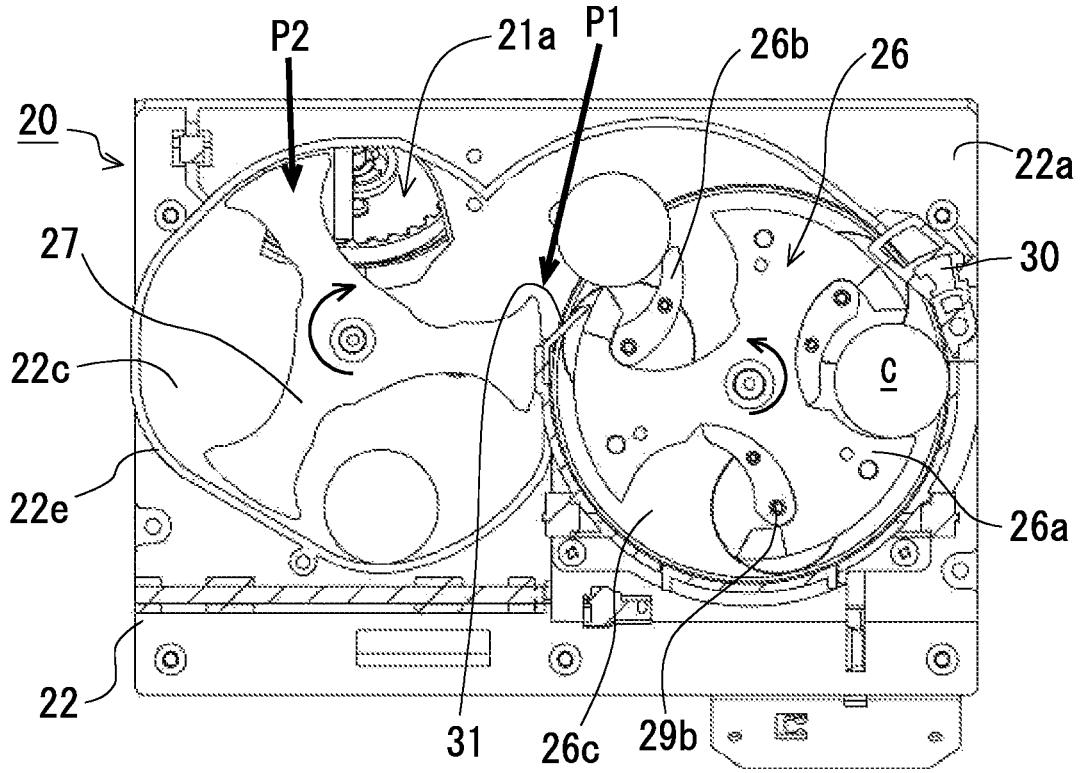
FIG. 15F is a partial explanatory view showing the coin feeding operation of the coin separation and discrimination unit of the apparatus of FIG. 1, in which the head and the substrate box are detached, which is subsequent to FIG. 15E.

The first coin C which is received by the closest-positioned arm of the wiper 27 is moved downward along with the relevant arm by the clockwise rotation of the wiper 27. This state is shown in FIG. 15E. When the relevant arm is displaced upward due to the further rotation of the wiper 27, the first coin C is unable to follow the motion of the said arm due to the gravity and thus, it is apart from the said arm. As a result, as shown in FIG. 15F, the first coin C is temporarily stopped at the lowest position of the guide wall 22*e*.

Figure 15G:
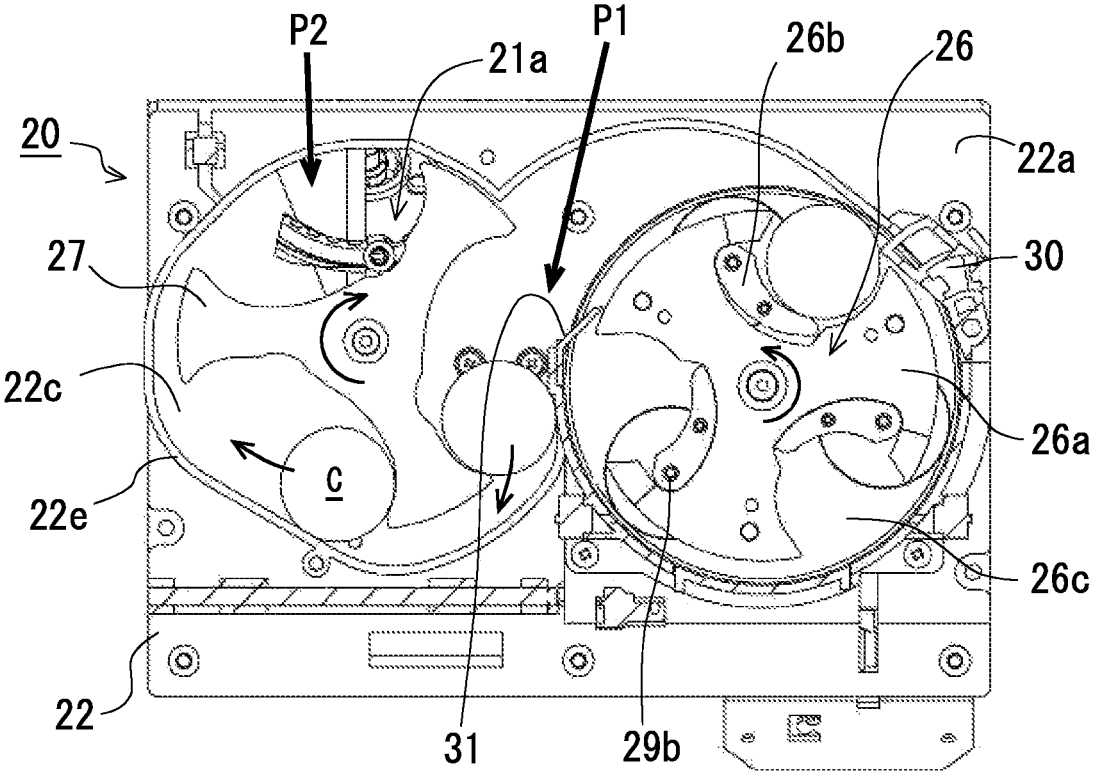
FIG. 15G is a partial explanatory view showing the coin feeding operation of the coin separation and discrimination unit of the apparatus of FIG. 1, in which the head and the substrate box are detached, which is subsequent to FIG. 15F.
Figure 15H:
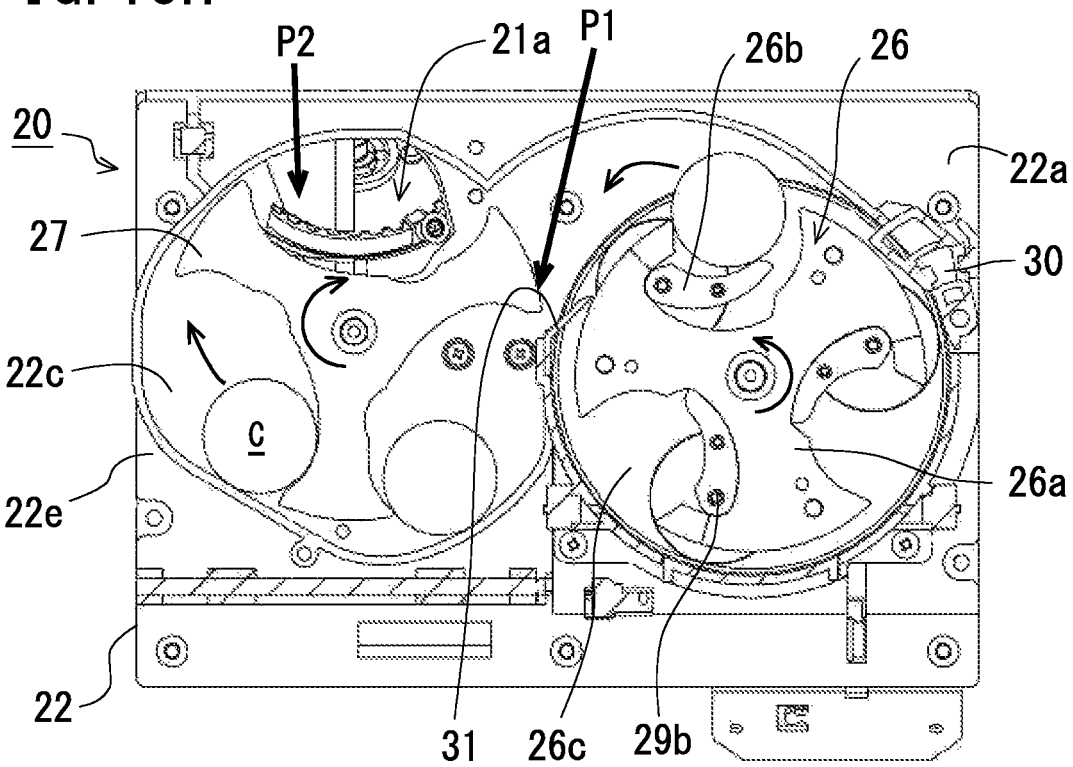
FIG. 15H is a partial explanatory view showing the coin feeding operation of the coin separation and discrimination unit of the apparatus of FIG. 1, in which the head and the substrate box are detached, which is subsequent to FIG. 15G.

Because of the further rotation of the wiper 27, the downstream-side edge of the next arm is contacted with the first coin C which is temporarily stopped at the lowest position of the guide wall 22*e*, thereby raising the first coin C using the said arm. At this stage, as shown in FIG. 15G, the second coin C is contacted with the upstream-side edge of the said arm and supported by the same. The first coin C which is temporarily stopped at the lowest position of the guide wall 22*e* is raised by the relevant arm due to the further rotation of the wiper 27, as shown in FIG. 15H. Since the first coin C passes through the coin discrimination region P3 at this stage, the denomination discrimination and authenticity discrimination for the first coin C are carried out automatically. Here, not only the denomination discrimination but also the authenticity discrimination are carried out simultaneously. At this stage, similar to the first coin C, the third coin C is pushed out from the relevant engaging recess 26*c* by the pushing action of the relevant pushing member 26*b*.

Figure 15I:
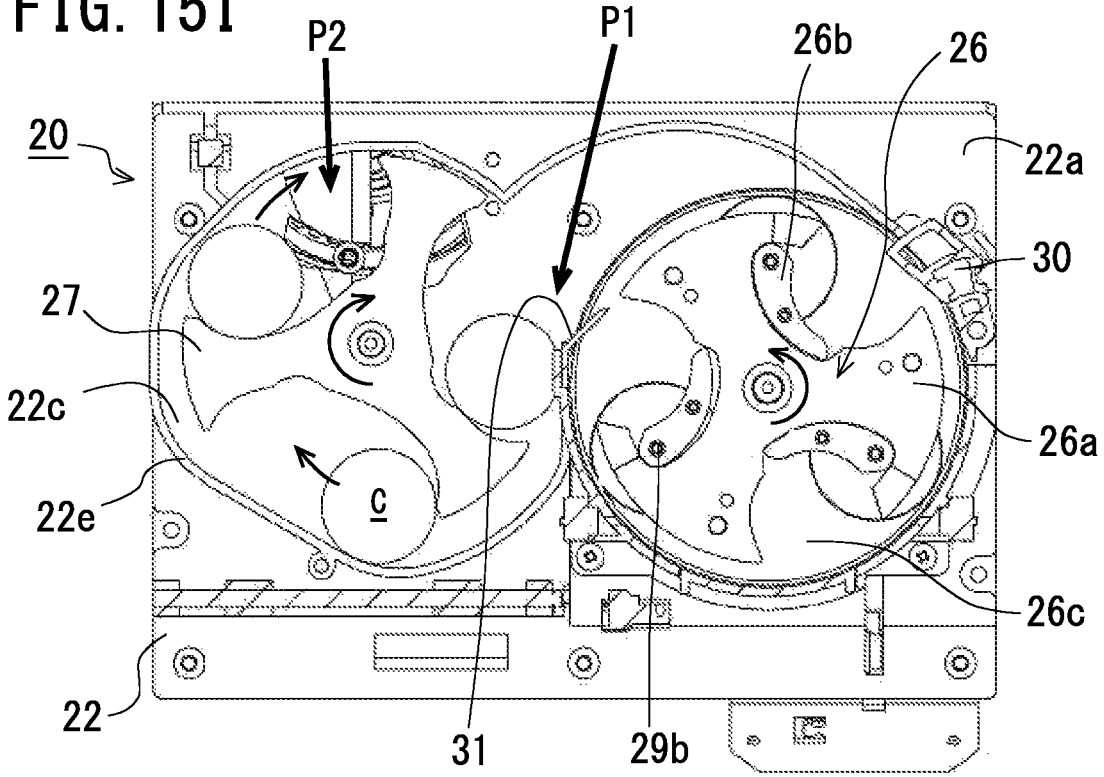
FIG. 15I is a partial explanatory view showing the coin feeding operation of the coin separation and discrimination unit of the apparatus of FIG. 1, in which the head and the substrate box are detached, which is subsequent to FIG. 15H.

Because of the further rotation of the wiper 27, the first coin C which has been subjected to the denomination and authenticity discrimination is further raised by the relevant arm, as shown in FIG. 15I. At this stage, the second coin C is raised by the relevant arm to pass through the coin discrimination region P3 and furthermore, the third coin C passes through the first delivery region P1 to be delivered to the coin discrimination section from the coin separation section.

Figure 15J:
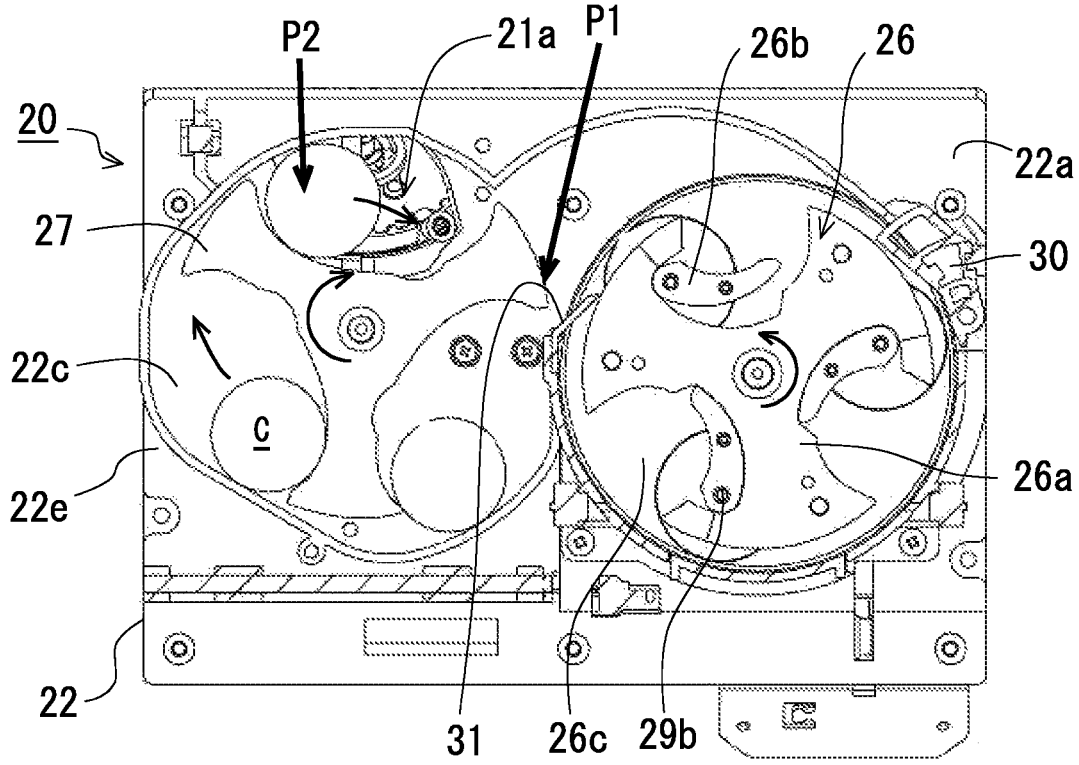
FIG. 15J is a partial explanatory view showing the coin feeding operation of the coin separation and discrimination unit of the apparatus of FIG. 1, in which the head and the substrate box are detached, which is subsequent to FIG. 15I.

Because of the further rotation of the wiper 27, the first coin C which has been subjected to the denomination and authenticity discrimination arrives at the second delivery region P2, as shown in FIG. 15J. At this stage, since the second coin C is raised by the relevant arm to pass through the coin discrimination region P3, it is subjected to the denomination and authenticity discrimination. The state of the third coin C is approximately the same as that of the first coin C shown in FIG. 15E.

Figure 15K:
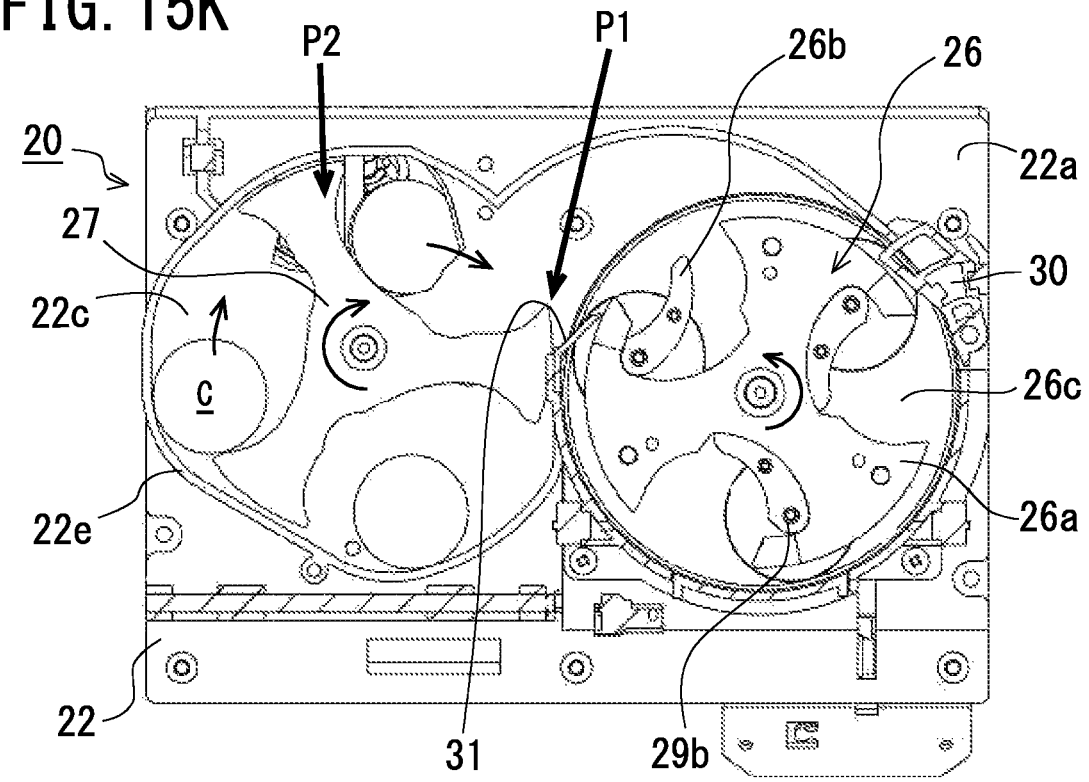
FIG. 15K is a partial explanatory view showing the coin feeding operation of the coin separation and discrimination unit of the apparatus of FIG. 1, in which the head and the substrate box are detached, which is subsequent to FIG. 15J.

Because of the further rotation of the wiper 27, the first coin C, which has arrived at the second delivery region P2, passes through this region P2, in other words, passes through the through hole 22*d* of the upper wall 22*a* and the opening 21*a* of the base plate 21. As a result, the leading end of the first coin C arrives at the back side of the base plate 21 (in other words, the back side of the coin discrimination section), as shown in FIG. 15K. At this stage, the second coin C, which has been subjected to the denomination and authenticity discrimination in the coin discrimination region P3, is raised by the relevant arm. The third coin C is temporarily stopped at the lowest position of the guide wall 22*e*.

Figure 15L:
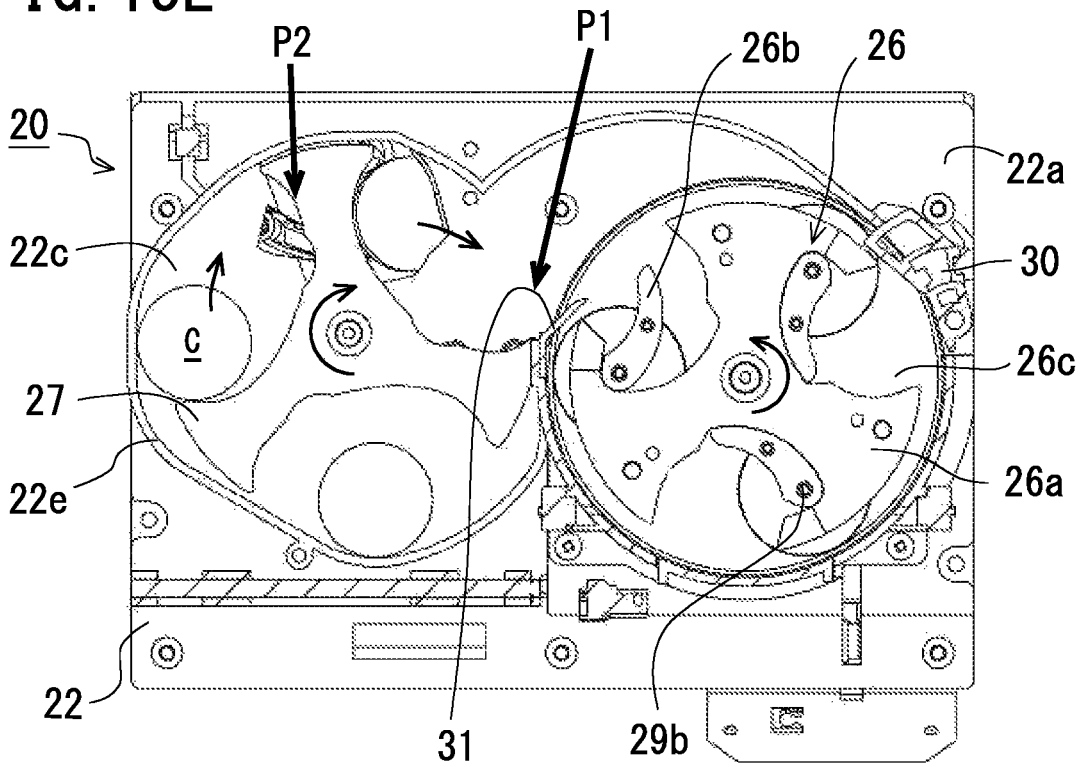
FIG. 15L is a partial explanatory view showing the coin feeding operation of the coin separation and discrimination unit of the apparatus of FIG. 1, in which the head and the substrate box are detached, which is subsequent to FIG. 15K.

Because of the further rotation of the wiper 27, the first coin C, which has passed through the second delivery region P2 and whose leading end has arrived at the back side of the base plate 21, starts to move downward due to the gravity and starts to change the moving direction gradually, as shown in FIG. 15L. At this stage, the first coin C is contacted or collided with the direction changing member 74 which is mounted near the starting end of the coin conveyance path 76 of the coin conveyance and distribution unit 60 and as a result, the first coin C changes its moving direction toward the said starting end (i.e., the entrance) of the path 76. The second coin C which has been subjected to the denomination and authenticity discrimination is further raised by the relevant arm. The third coin C is still temporarily stopped at the lowest position of the guide wall 22*e*.

Figure 15M:
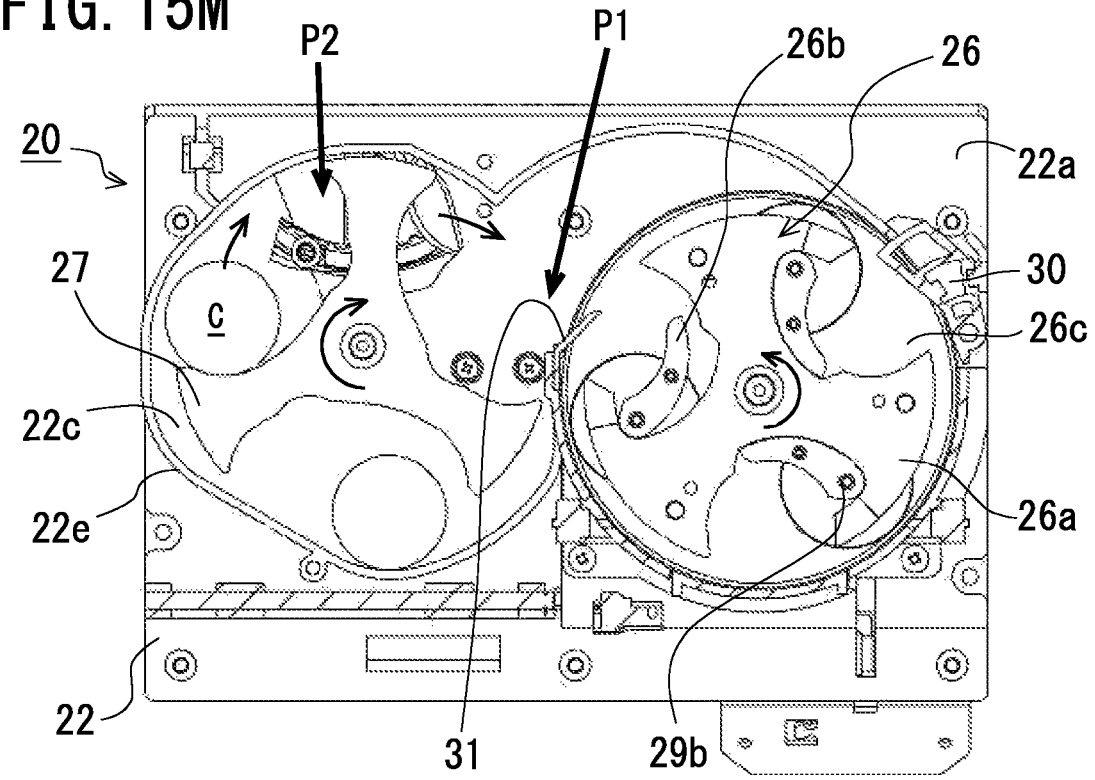
FIG. 15M is a partial explanatory view showing the coin feeding operation of the coin separation and discrimination unit of the apparatus of FIG. 1, in which the head and the substrate box are detached, which is subsequent to FIG. 15L.

Because of the further rotation of the wiper 27, the first coin C whose leading end has arrived at the back side of the base plate 21 is kept moving toward the starting end or entrance of the coin conveyance path 76 while the moving direction of the first coin C is being changed due to the gravity and the direction changing member 74, as shown in FIG. 15M. At this stage, the second coin C, which has been subjected to the denomination and authenticity discrimination, is made closer to the second delivery region P2. The third coin C is still temporarily stopped at the lowest position of the guide wall 22*e*.

Figure 15N:
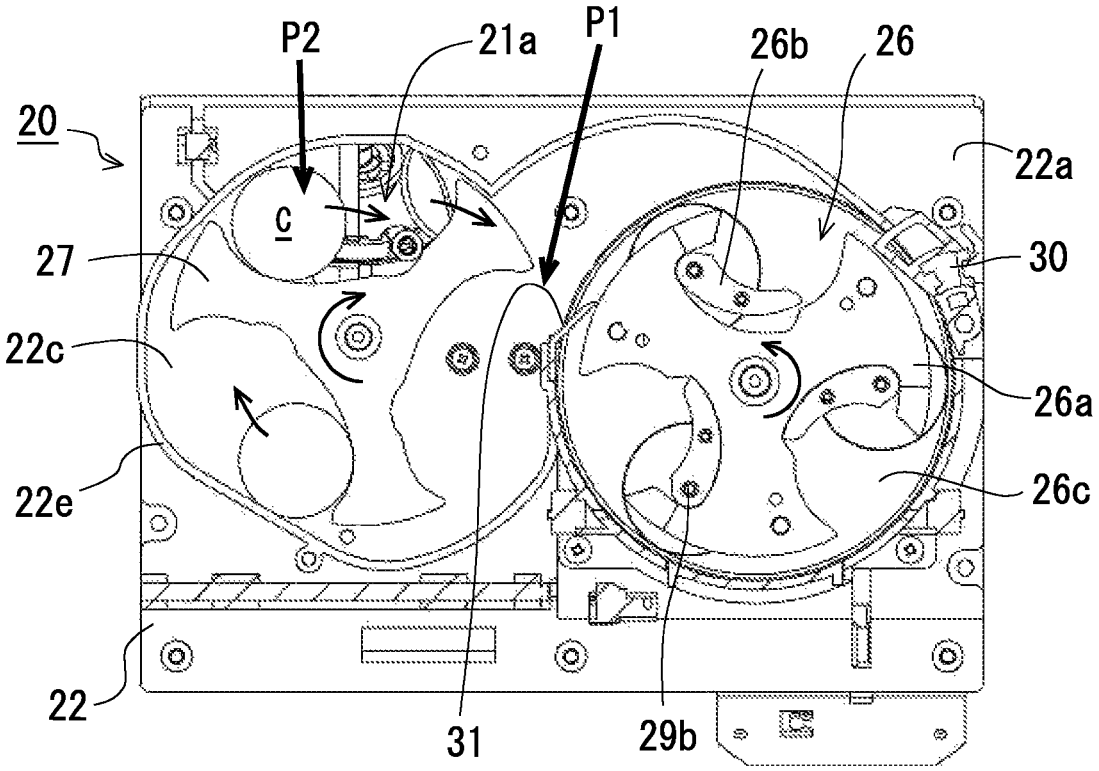
FIG. 15N is a partial explanatory view showing the coin feeding operation of the coin separation and discrimination unit of the apparatus of FIG. 1, in which the head and the substrate box are detached, which is subsequent to FIG. 15M.
Figure 150:
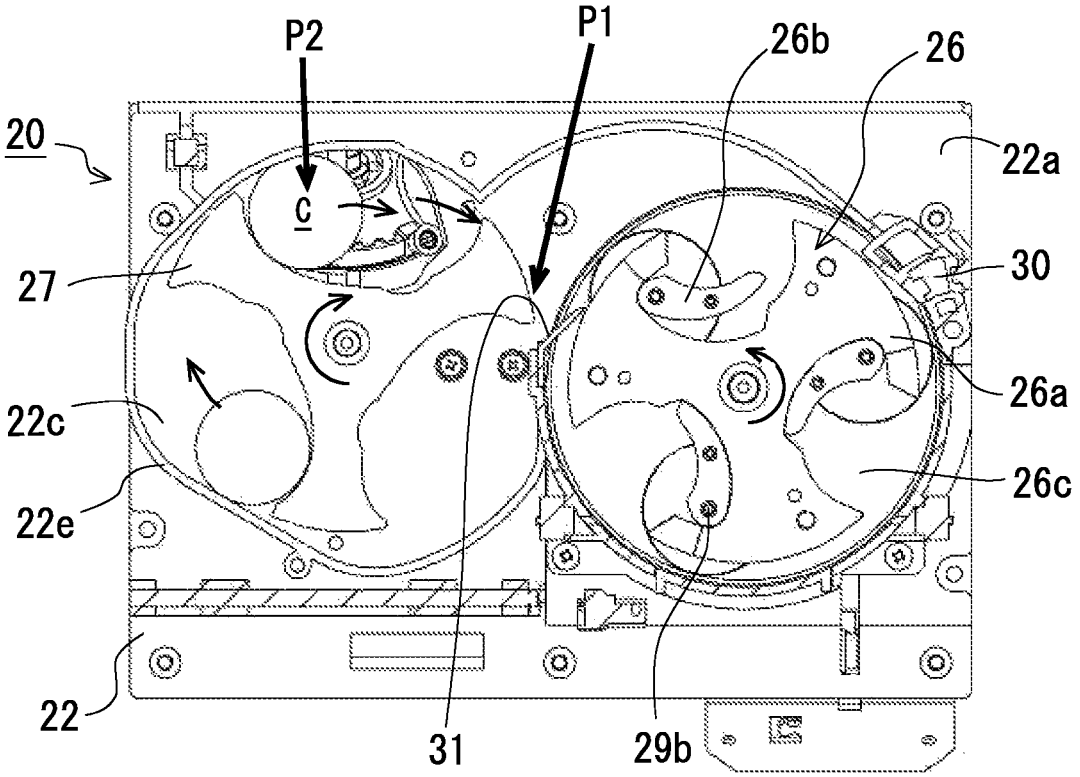

The first coin C whose leading end has arrived at the back side of the base plate 21 is kept moving toward the starting end or entrance of the coin conveyance path 76, as shown in FIG. 15N. At this stage, because of the further rotation of the wiper 27, the second coin C, which has been subjected to the denomination and authenticity discrimination, arrives at the second delivery region P2. The third coin C is raised from the lowest position of the guide wall 22*e* by the relevant arm.

The entirety of the first coin C arrives at the back side of the base plate 21 and the leading end of the said coin C is entered the entrance of the coin conveyance path 76, as shown in FIG. 15O. At this stage, because of the further rotation of the wiper 27, the second coin C, which has already been subjected to the denomination and authenticity discrimination, starts to pass through the second delivery region P2. The third coin C is subjected to the denomination and authenticity discrimination in the coin discrimination region P3 while being raised from the lowest position of the guide wall 22*e* by the relevant arm.

Through the aforementioned processes, the first coin C, which has been separated from the remaining coins C in the coin separation section having the rotary disk 26, is delivered to the coin discrimination section from the coin separation section by way of the first delivery region P1. After the first coin C is subjected to the predetermined denomination and authenticity discrimination in the coin discrimination region P3 in the coin discrimination section, the first coin C is delivered to the coin conveyance and distribution unit 60 by way of the second delivery region P2.

In the coin conveyance and distribution unit 60, the coins C which have been delivered from the coin separation and discrimination unit 20 by way of the second delivery region P2 are successively conveyed on the coin conveyance path 76 using the pins 63*a* fixed onto the endless belt 63. During the conveyance, the four gates 76*a*, which are formed in the coin conveyance path 76 and respectively assigned to the first, second, third, and fourth distribution sections D1, D2, D3, and D4, are opened or closed according to the necessity based on the result of the denomination and authenticity discrimination carried out in the coin discrimination section of the unit 20, thereby distributing the coins C of the predetermined eight denominations into the corresponding hoppers 83 and 84 and stored therein. The opening/closing operation of each of the four gates 76*a* is realized by driving or pivoting the corresponding distribution flap 70 (which serves as the first gate member) using the corresponding distribution flap driving solenoids 72.

Moreover, during the conveyance of coins C on the coin conveyance path 76, the entrance of the third chute 82 (as the gate for rejection) which is provided in the first distribution section D1 is opened or closed based on the result of the authenticity discrimination which is carried out in the coin discrimination section of the coin separation and discrimination unit 20, thereby discharging selectively the coins C to be judged rejective (e.g., counterfeit coins) into a dedicated storage container (not shown) and stored therein. The opening/closing operation of the entrance of the third chute 82 is realized by opening or closing the rejection flap 71 (which serves as the second gate member) which is provided in the first distribution section D1 using the rejection flap driving solenoid 73.

The aforementioned operation of the distribution flap 70 provided in each of the first to fourth distribution sections D1 to D4 and that of the rejection flap 71 provided in the first distribution section D1 are controlled by the control device (the control program) mounted on the aforementioned main apparatus (e.g., a coin depositing/dispensing apparatus) into which the apparatus 1 of this embodiment is incorporated, not by the control device (the control program) mounted on the control substrate 32 in the substrate box 23 of the apparatus 1.

Next, the coin distribution operation of the aforementioned first to fourth distribution sections D1 to D4 which are arranged along the coin conveyance path 76 in this order will be explained in detail with reference to FIGS. 31 to 45.

Since the coin distribution mechanism according to an embodiment of the present invention is incorporated into the first distribution section D1, and the coin distribution mechanism according to another embodiment of the present invention is incorporated into each of the second, third, and fourth distribution sections D2, D3, and D4. Thus, the operation of the coin distribution mechanism provided in each of the first to fourth distribution sections D1 to D4 also will be explained below.

First, a coin C that has been delivered to the coin conveyance path 76 by way of its starting end arrives at the entrance of the first distribution section D1. This arrival of the coin C is detected by the operation of the incoming coin sensor 67 which is disposed at the position immediately before the first distribution section D1.

When the denomination of the coin C thus arrived is not equal to any of the three designated or target denominations (e.g., 1 euro, 2 euros, and non-target) for the first distribution section D1, the distribution flap 70 provided in this section D1 is kept at the default position A0 (see FIG. 23). Thus, the relevant gate 76*a* of the path 76 disposed in this section D1 is kept closed by the upper end 70*c* of the distribution flap 70. For this reason, the said coin C that has entered the coin conveyance path 76 does not drop through the said gate 76*a* but passes through the same and then, conveyed on the path 76 toward the second distribution section D2.

The fact that the said coin C does not drop through the said gate 76*a* in the first distribution section D1 is detected by the non-operation of the dropping coin sensor 69 which is provided in this section D1. The fact that the said coin C has been conveyed on the path 76 toward the second distribution section D2 is detected by the operation of the moving coin sensor 68 which is disposed at the position immediately after the first distribution section D1. These two facts thus detected are notified to the control device (the control program) of the aforementioned main apparatus (e.g., the coin depositing/dispensing apparatus).

Figure 31:
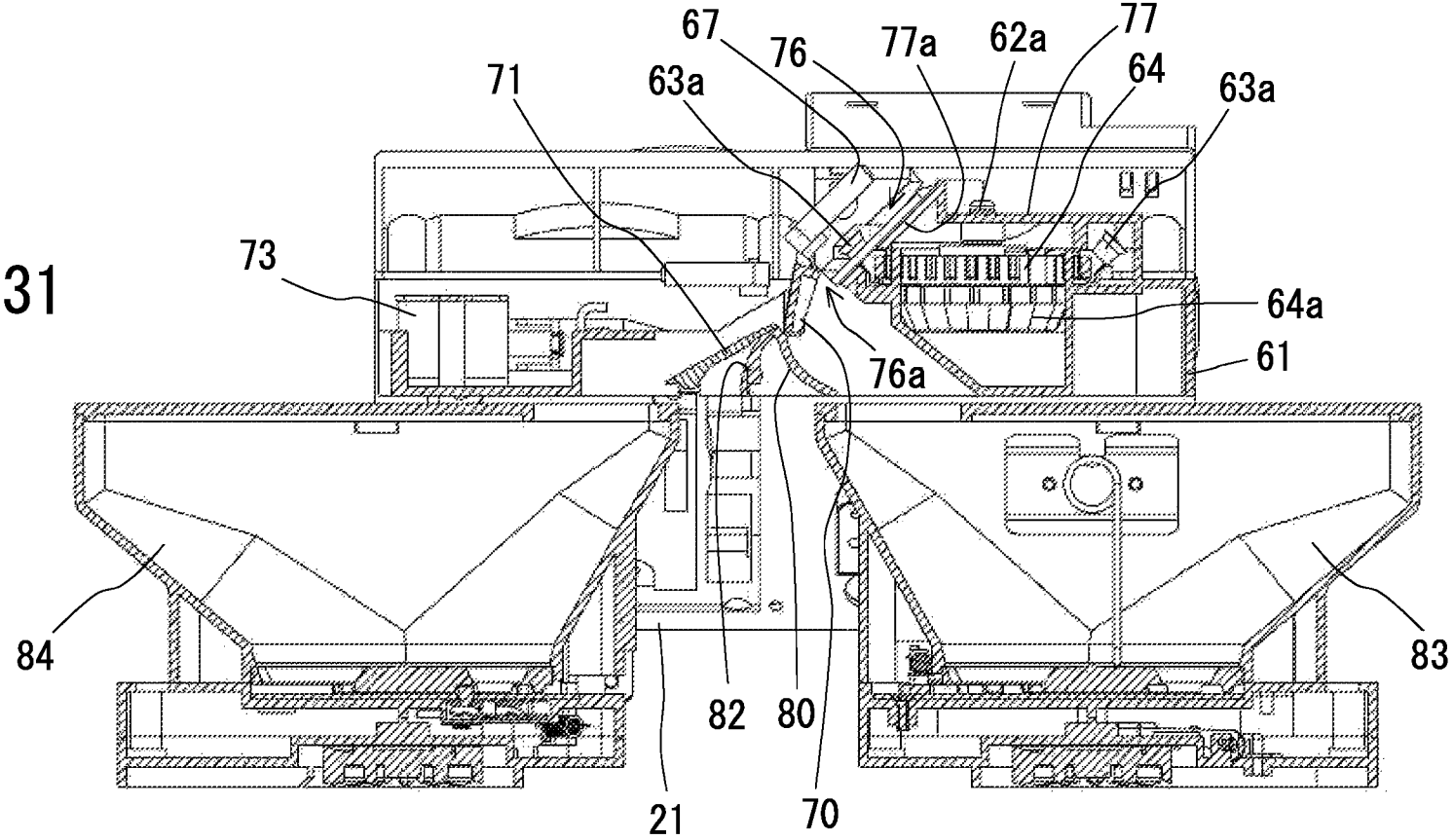
FIG. 31 is a cross-sectional view along the line L1 in FIG. 21 showing the distribution operation of a relevant coin toward a corresponding one of the rear hoppers in the coin distribution mechanism provided in the first distribution section of the coin conveyance and distribution unit of the apparatus of FIG. 1, in which the relevant coin does not yet reach the first distribution section.
Figure 32:
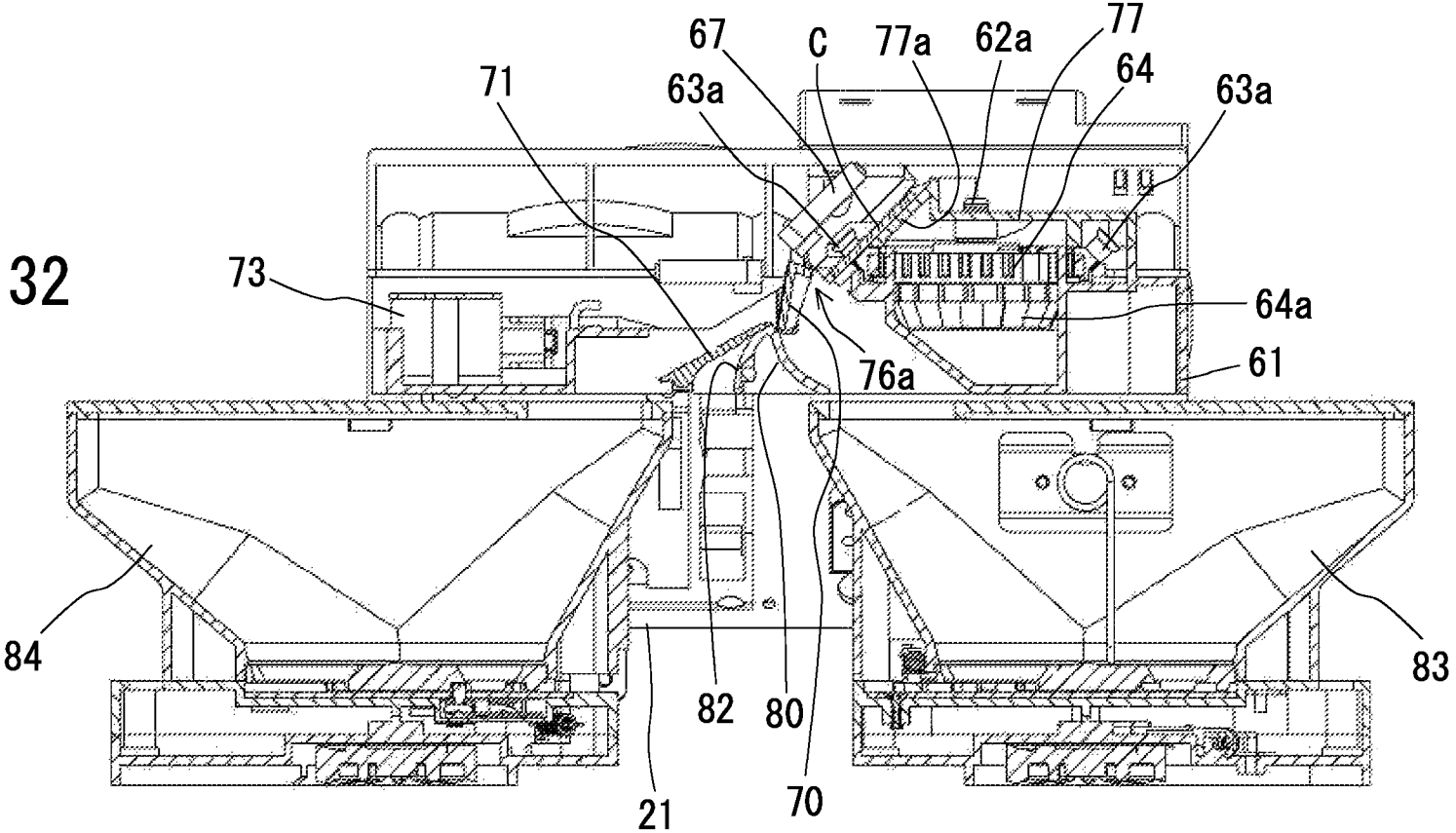
FIG. 32 is a cross-sectional view along the line L1 in FIG. 21 showing the distribution operation of the relevant coin toward the corresponding one of the rear hoppers in the coin distribution mechanism provided in the first distribution section of the coin conveyance and distribution unit of the apparatus of FIG. 1, in which the relevant coin has reached the first distribution section, which is subsequent to FIG. 31.
Figure 33:
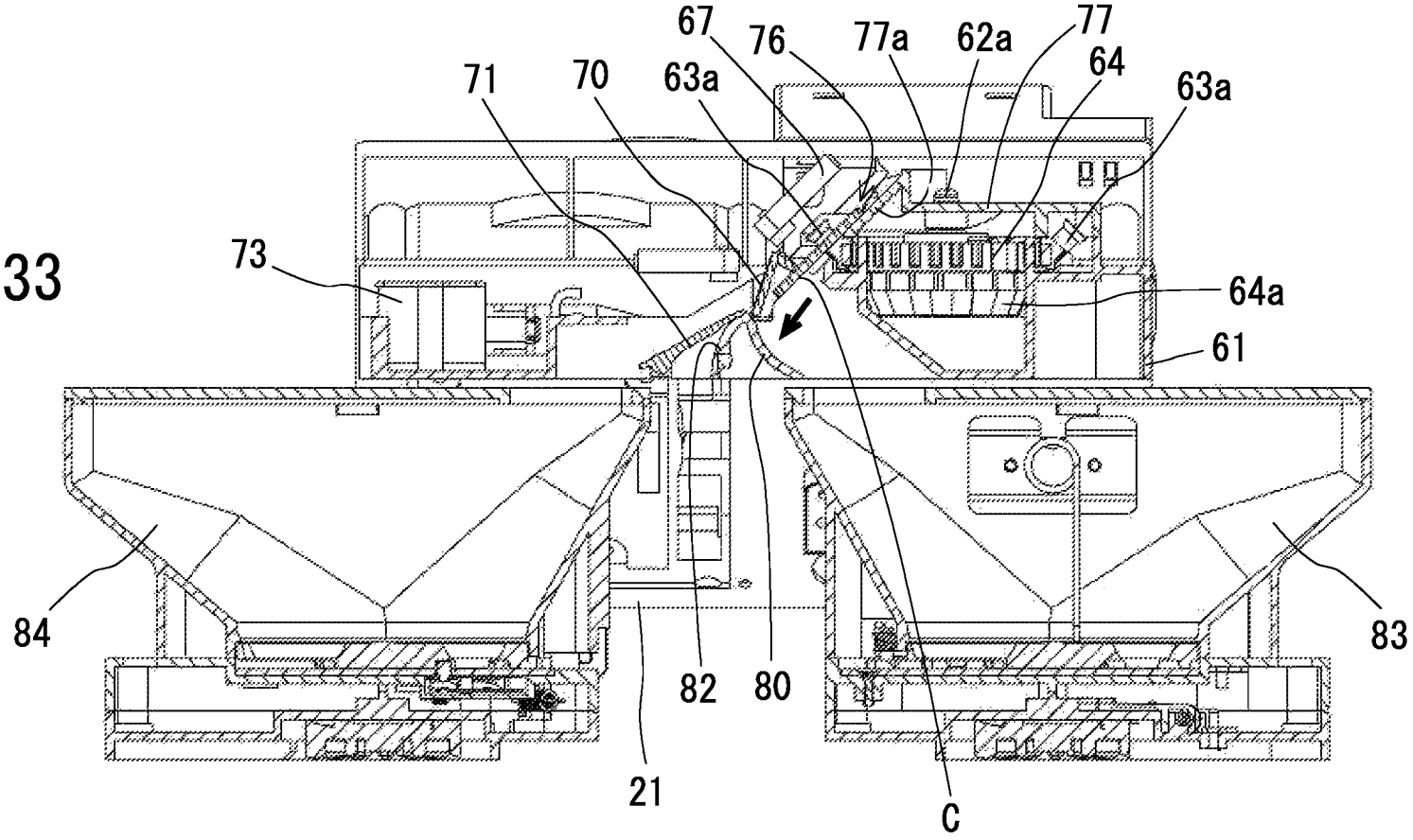
FIG. 33 is a cross-sectional view along the line L1 in FIG. 21 showing the distribution operation of the relevant coin toward the corresponding one of the rear hoppers in the coin distribution mechanism provided in the first distribution section of the coin conveyance and distribution unit of the apparatus of FIG. 1, in which the distribution operation of the relevant coin by the distribution flap in the coin distribution mechanism has started, which is subsequent to FIG. 32.
Figure 34:
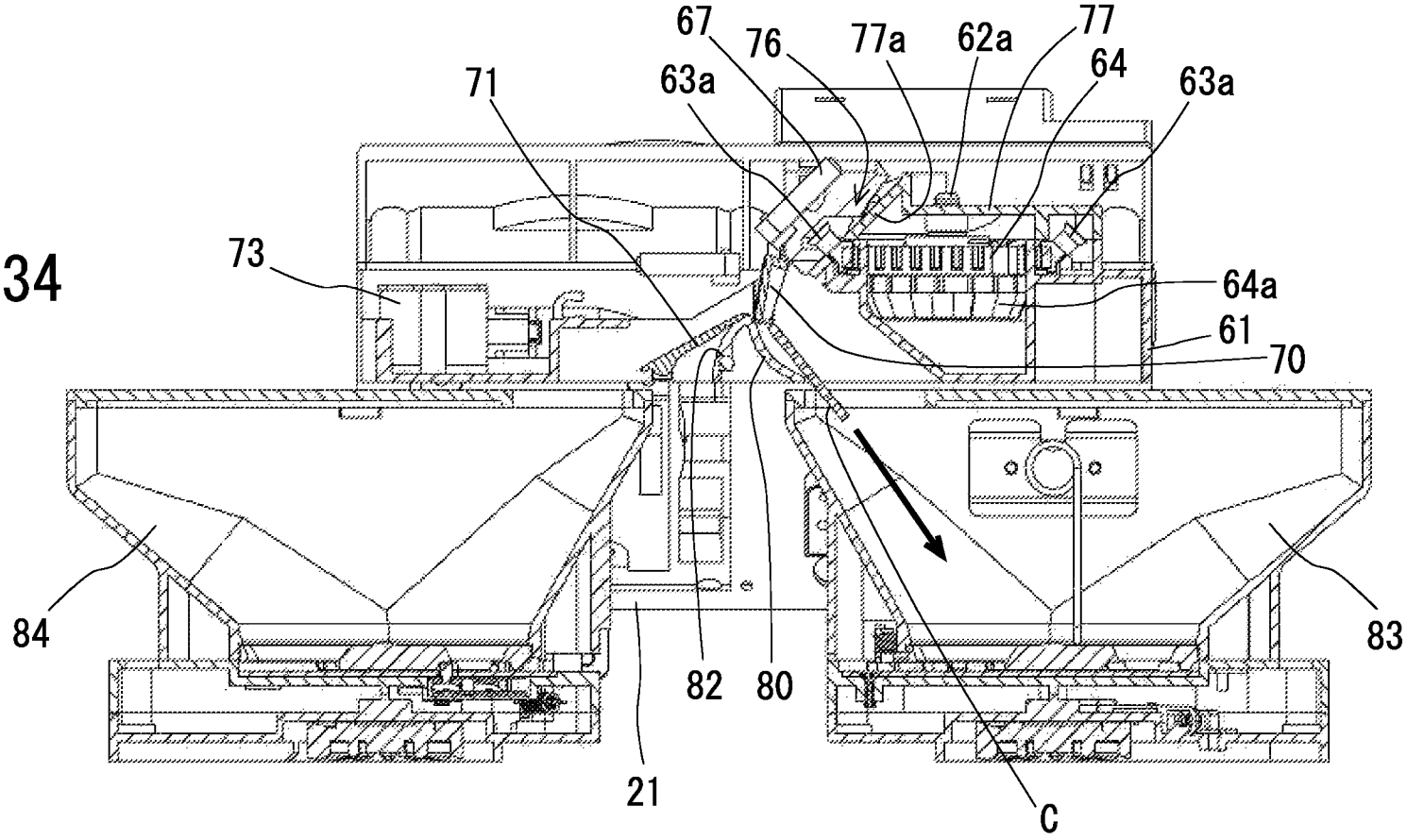
FIG. 34 is a cross-sectional view along the line L1 in FIG. 21 showing the distribution operation of the relevant coin toward the corresponding one of the rear hoppers in the coin distribution mechanism provided in the first distribution section of the coin conveyance and distribution unit of the apparatus of FIG. 1, in which the relevant coin is being dropping toward the corresponding rear hopper through a first chute of the coin distribution mechanism, which is subsequent to FIG. 33.

When the denomination of the coin C that has arrived at the first distribution section D1 is equal to one of the three designated or target denominations (e.g., 2 euros) for the first distribution section D1, the distribution flap 70 provided in this section D1 is pivoted upward by the relevant solenoid 72 to the first switched position A1 (see FIG. 24) from the default position A0 (see FIG. 23). Thus, the gate 76*a* of the path 76 disposed in this section D1 is opened, as shown in FIG. 31. For this reason, the said coin C thus arrived drops through the said gate 76*a* to the inside of the main body 61. Thereafter, the said coin C is guided by the second side face 70*b* of the said distribution flap 70 and the first chute 80 disposed below the said distribution flap 70 and as a result, stored in the rear hopper 83 provided for this section D1, as shown in FIGS. 32 to 34.

The fact that the said coin C has dropped through the said gate 76*a* to pass through the first chute 80 in the first distribution section D1 is detected by the operation of the dropping coin sensor 69 provided in this section D1. The fact that the said coin C has not been conveyed on the path 76 toward the second distribution section D2 is detected by the non-operation of the moving coin sensor 68 which is disposed at the position immediately after the first distribution section D1. These two facts thus detected are notified to the control device (the control program) of the aforementioned main apparatus (e.g., the coin depositing/dispensing apparatus).

Figure 35:
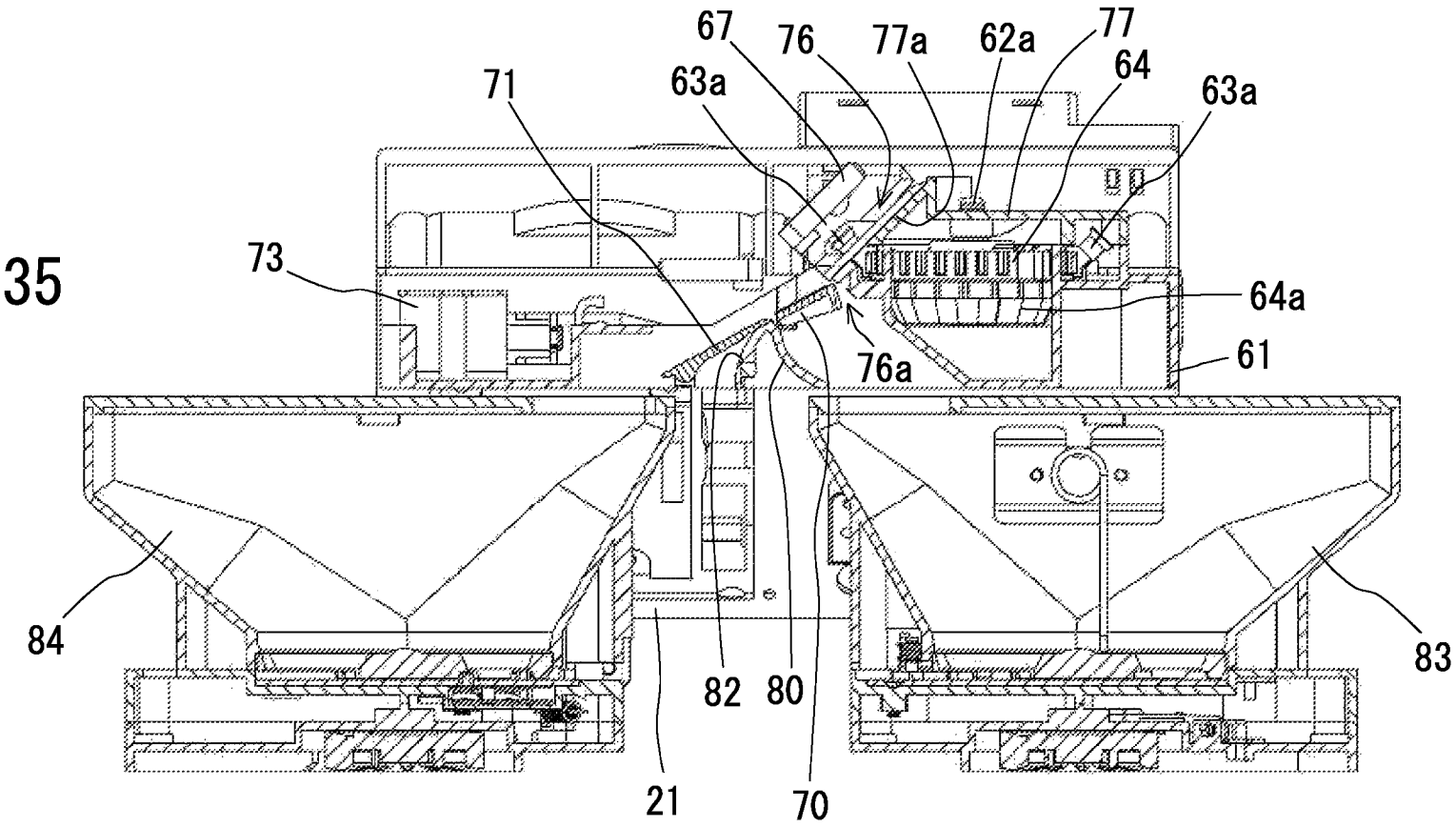
FIG. 35 is a cross-sectional view along the line L1 in FIG. 21 showing the distribution operation of a relevant coin toward a corresponding one of the front hoppers in the coin distribution mechanism provided in the first distribution section of the coin conveyance and distribution unit of the apparatus of FIG. 1, in which the relevant coin does not yet reach the first distribution section.
Figure 36:
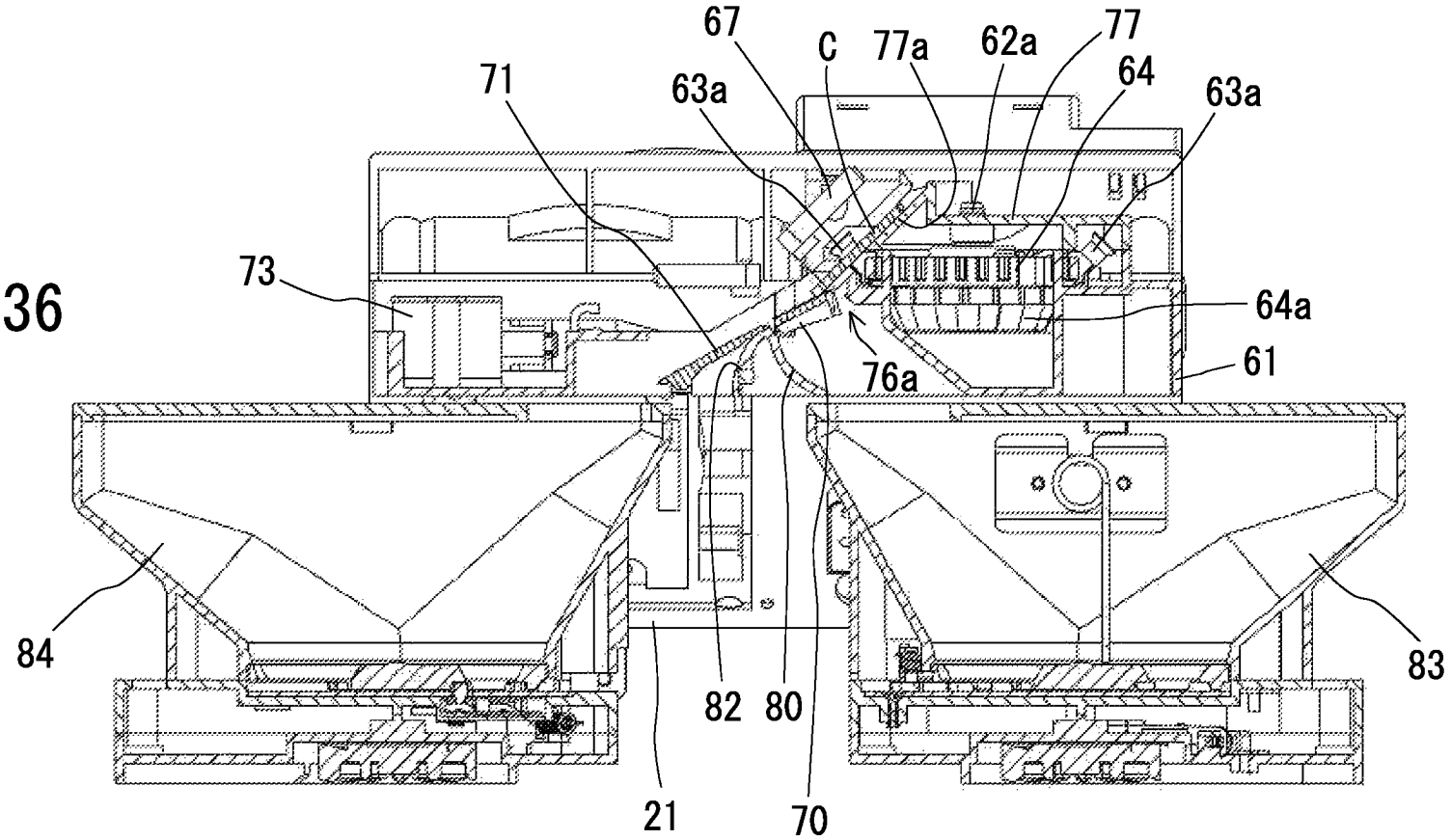
FIG. 36 is a cross-sectional view along the line L1 in FIG. 21 showing the distribution operation of the relevant coin toward the corresponding one of the front hoppers in the coin distribution mechanism provided in the first distribution section of the coin conveyance and distribution unit of the apparatus of FIG. 1, in which the distribution operation of the relevant coin by the distribution flap in the coin distribution mechanism has started, which is subsequent to FIG. 35.
Figure 37:
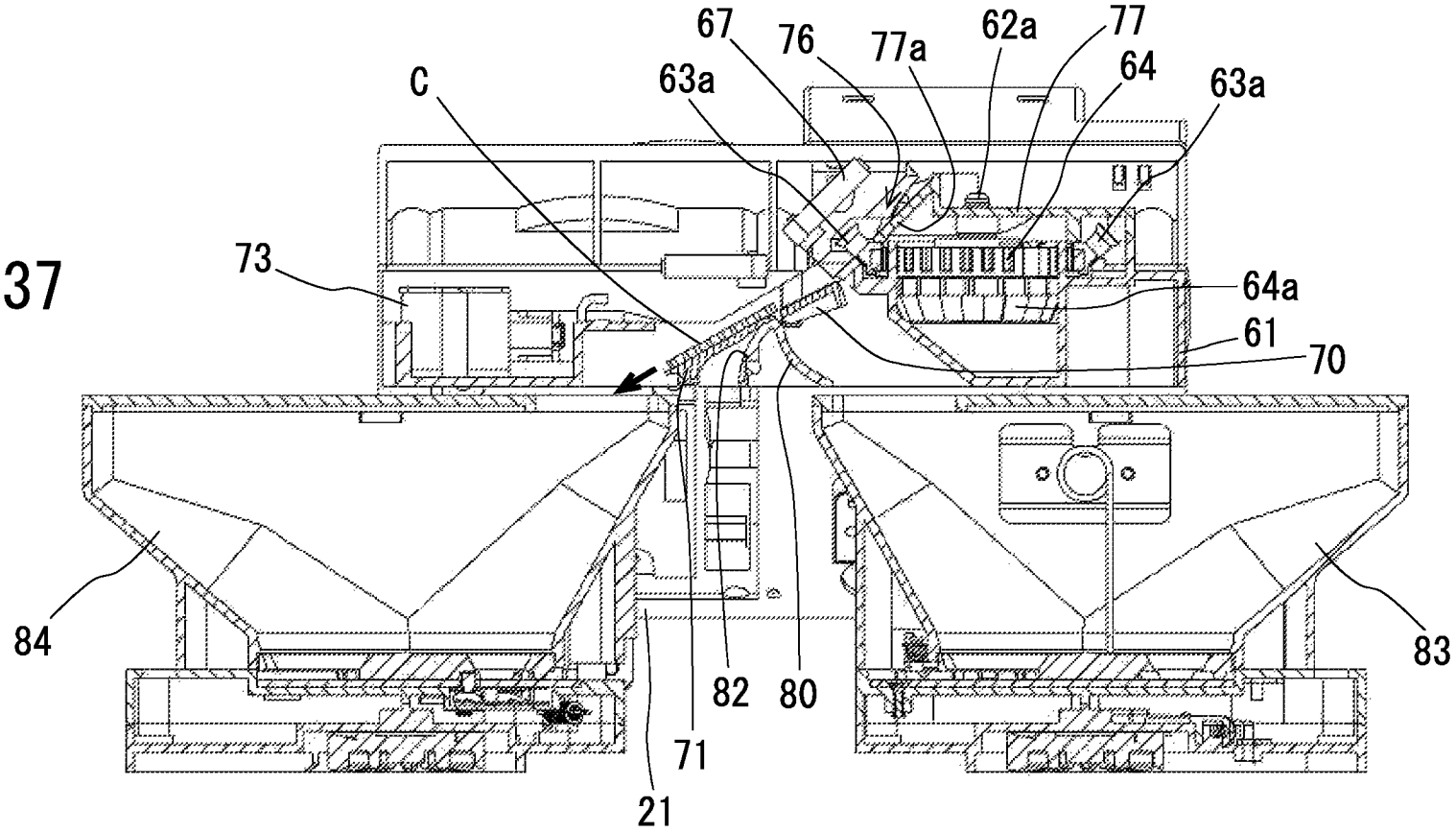
FIG. 37 is a cross-sectional view along the line L1 in FIG. 21 showing the distribution operation of the relevant coin toward the corresponding one of the front hoppers in the coin distribution mechanism provided in the first distribution section of the coin conveyance and distribution unit of the apparatus of FIG. 1, in which the relevant coin is being dropping toward the corresponding front hopper using the distribution flap and the rejection flap in the coin distribution mechanism, which is subsequent to FIG. 36.

When the denomination of the coin C that has arrived at the first distribution section D1 is equal to another of the three designated or target denominations (e.g., 1 euro) for the first distribution section D1, the distribution flap 70 provided in this section D1 is pivoted downward by the relevant solenoid 72 to the second switched position A2 (see FIG. 25) from the default position A0 (see FIG. 23). Thus, the gate 76*a* of the path 76 disposed in this section D1 is opened, as shown in FIG. 35. At this stage, the rejection flap 71 provided in this section D1 is located at the default position B0 (see FIG. 27) and thus, the top end 71*a* of the rejection flap 71 is contacted with the top end of the third chute 82, in which the entrance of the third chute 82 is closed. In this state, the rejection flap 71 can play the same role as that of the second chute 81 which is provided in each of the second to fourth distribution section D2 to D4. Thus, the said coin C thus arrived drops through the said gate 76*a* to the inside of the main body 61, as shown in FIGS. 36 to 38. Thereafter, the said coin C is guided by the first side face 70*a* of the said distribution flap 70 and the surface 71*a* of the rejection flap 71 toward the front hopper 84 provided for this section D1 and then, stored therein.

The fact that the said coin C has dropped through the said gate 76*a* to move on the surface 71*a* of the rejection flap 71 in the first distribution section D1 is detected by the operation of the dropping coin sensor 69 provided in this section D1. The fact that the said coin C has not been conveyed on the path 76 toward the second distribution section D2 is detected by the non-operation of the moving coin sensor 68 which is disposed at the position immediately after the first distribution section D1. These two facts thus detected are notified to the control device (the control program) of the aforementioned main apparatus (e.g., the coin depositing/dispensing apparatus).

Figure 41:
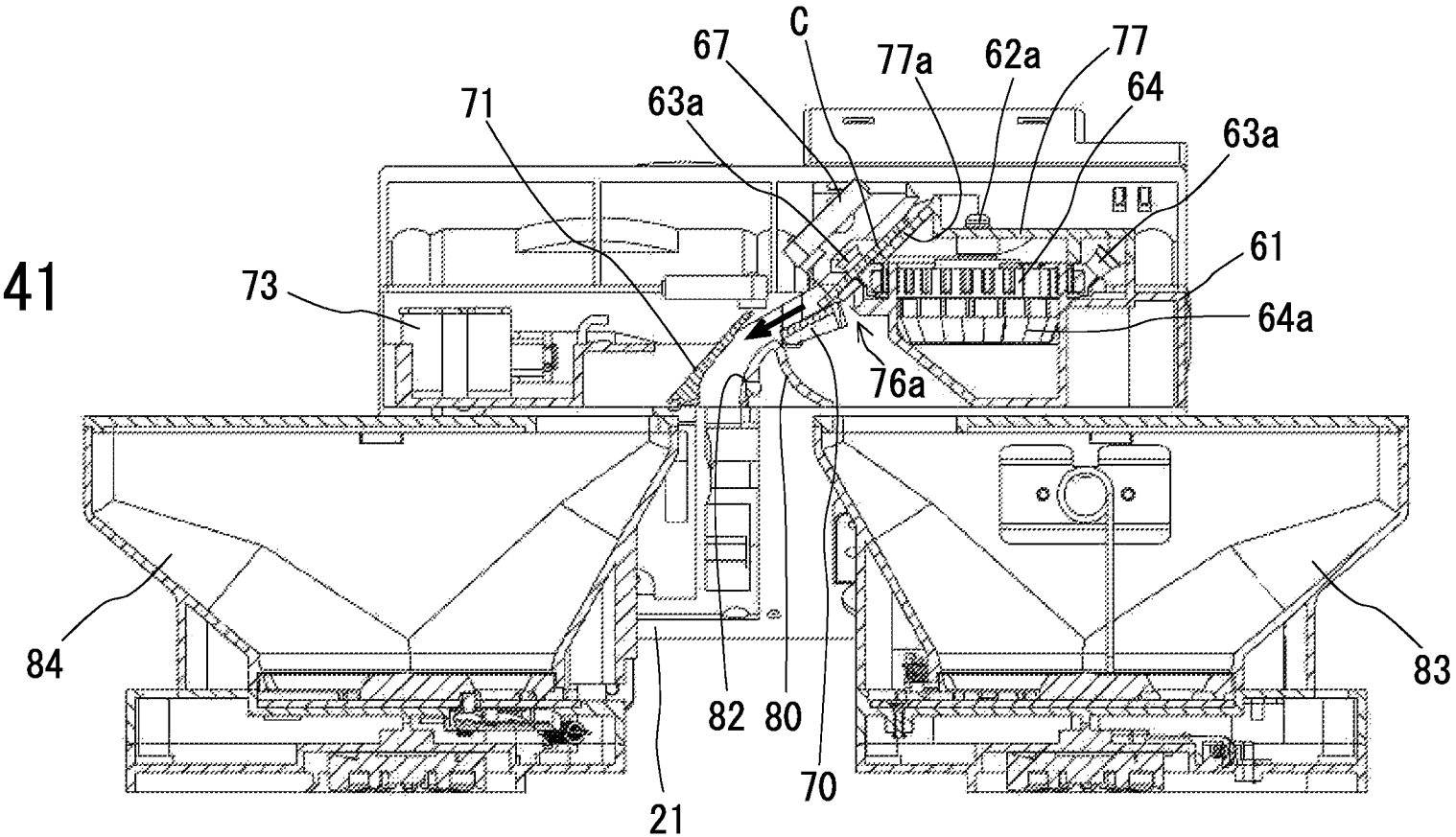
FIG. 41 is a cross-sectional view along the line L1 in FIG. 21 showing the distribution operation of a relevant coin toward a dispensing tray in the coin distribution mechanism provided in the first distribution section of the coin conveyance and distribution unit of the apparatus of FIG. 1, in which the distribution operation of the relevant coin toward the dispensing tray by the distribution flap and the rejection flap in the coin distribution mechanism has started.
Figure 42:
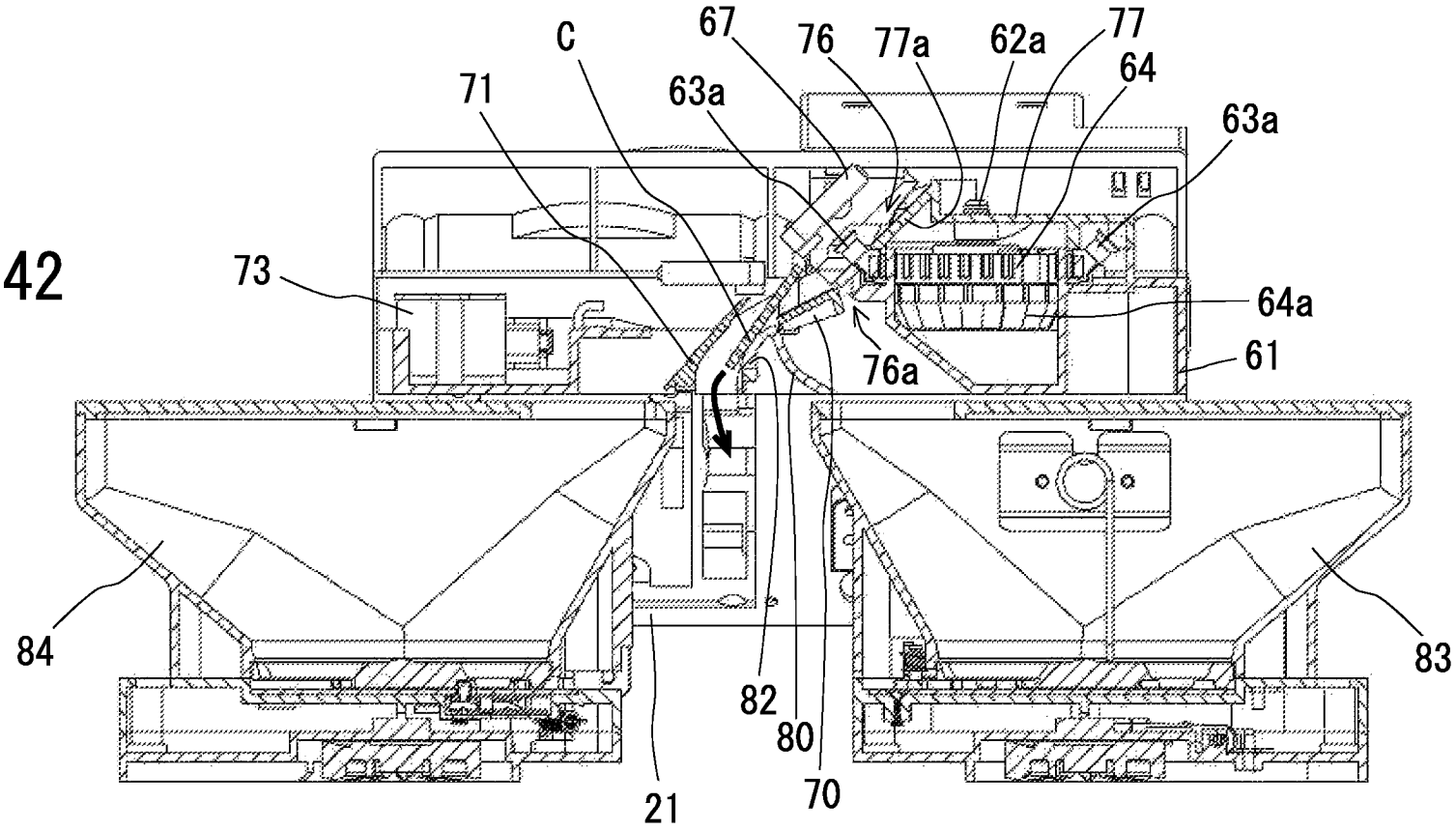
FIG. 42 is a cross-sectional view along the line L1 in FIG. 21 showing the distribution operation of the relevant coin toward the dispensing tray in the coin distribution mechanism provided in the first distribution section of the coin conveyance and distribution unit of the apparatus of FIG. 1, in which the relevant coin is being guided to drop toward the dispensing tray by a third chute in the coin distribution mechanism, which is subsequent to FIG. 41.
Figure 43:
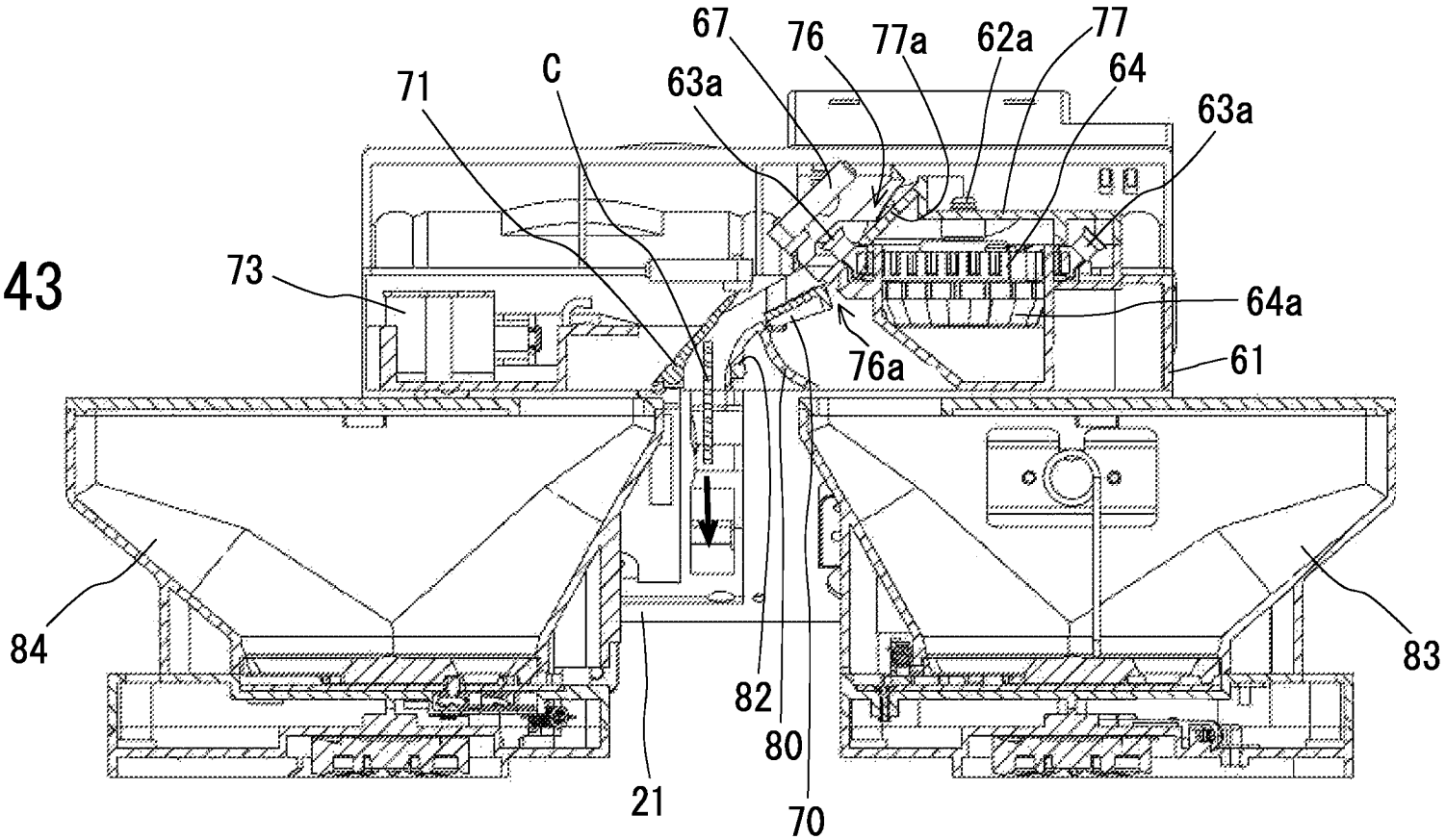
FIG. 43 is a cross-sectional view along the line L1 in FIG. 21 showing the distribution operation of the relevant coin toward the dispensing tray in the coin distribution mechanism provided in the first distribution section of the coin conveyance and distribution unit of the apparatus of FIG. 1, in which the relevant coin is being guided to drop toward the dispensing tray by the third chute and the rejection flap in the coin distribution mechanism, which is subsequent to FIG. 42.

When the denomination of the coin C that has arrived at the first distribution section D1 is equal to the remaining one of the three designated or target denominations (e.g., non-target) for the first distribution section D1, the distribution flap 70 provided in this section D1 is pivoted downward by the relevant solenoid 72 to the second switched position A2 (see FIG. 25) from the default position A0 (see FIG. 23). Thus, the gate 76*a* of the path 76 disposed in this section D1 is opened, as shown in FIG. 41. At this stage, the rejection flap 71 provided in this section D1 is pivoted upward by the relevant solenoid 73 to the switched position B1 (see FIG. 28) and thus, the top end 71*a* of the rejection flap 71 is detached from the top end of the third chute 82, in which the entrance of the third chute 82 is opened. Thus, the said coin C thus arrived drops through the said gate 76*a* to the inside of the main body 61 and thereafter, the said coin C is guided by the first side face 70*a* of the distribution flap 70 and the third chute 82 and as a result, dropped to be placed onto the dispensing belt (not shown) which is provided between the front hopper 84 and the rear hopper 83 for the first distribution section D1. The said coin C which has been placed on the dispensing belt is conveyed toward the dispensing tray (not shown) due to the motion of this belt, in which the said coin C is returned to this tray.

The fact that the said coin C has dropped through the said gate 76*a* to pass through the third chute 82 in the first distribution section D1 is detected by the operation of the dropping coin sensor 69 provided in this section D1. The fact that the said coin C has not been conveyed on the path 76 toward the second distribution section D2 is detected by the non-operation of the moving coin sensor 68 which is disposed at the position immediately after the first distribution section D1. These two facts thus detected are notified to the control device (the control program) of the aforementioned main apparatus (e.g., the coin depositing/dispensing apparatus).

A coin C that has passed through the first distribution section D1 on the coin conveyance path 76 arrives at the entrance of the second distribution section D2. This arrival of the coin C is detected by the operation of the moving coin sensor 68 which is disposed at the position immediately before the second distribution section D2.

When the denomination of the coin C thus arrived is not equal to any of the two designated or target denominations (e.g., 50 cents and 20 cents) for the second distribution section D2, the distribution flap 70 provided in this section D2 is kept at the default position A0 (see FIG. 23). Thus, the gate 76*a* of the path 76 disposed in this section D2 is kept closed by the upper end 70*c* of the said distribution flap 70. For this reason, the said coin C that is conveyed on the coin conveyance path 76 does not drop through the said gate 76*a* but passes through the same and then, conveyed on the path 76 toward the third distribution section D3.

The fact that the said coin C does not drop through the said gate 76*a* in the second distribution section D2 is detected by the non-operation of the dropping coin sensor 69 which is provided in this section D2. The fact that the said coin C has been conveyed on the path 76 toward the third distribution section D3 is detected by the operation of the moving coin sensor 68 which is disposed at the position immediately after the second distribution section D2. These two facts thus detected are notified to the control device (the control program) of the aforementioned main apparatus (e.g., the coin depositing/dispensing apparatus).

When the denomination of the coin C that has arrived at the second distribution section D2 is equal to one of the two designated or target denominations (e.g., 20 cents) for the second distribution section D2, the distribution flap 70 provided in this section D2 is pivoted upward by the relevant solenoid 72 to the first switched position A1 (see FIG. 24) from the default position A0 (see FIG. 23). Thus, the gate 76*a* of the path 76 disposed in this section D2 is opened, as shown in FIG. 39. For this reason, the said coin C thus arrived drops through the said gate 76*a* to the inside of the main body 61. Thereafter, the said coin C is guided by the second side face 70*b* of the said distribution flap 70 and the first chute 80 disposed below the said distribution flap 70 and as a result, stored in the rear hopper 83 provided for this section D2.

The fact that the said coin C has dropped through the said gate 76*a* to pass through the first chute 80 in the second distribution section D2 is detected by the operation of the dropping coin sensor 69 provided in this section D2. The fact that the said coin C has not been conveyed on the path 76 toward the third distribution section D3 is detected by the non-operation of the moving coin sensor 68 which is disposed at the position immediately after the second distribution section D2. These two facts thus detected are notified to the control device (the control program) of the aforementioned main apparatus (e.g., the coin depositing/dispensing apparatus).

When the denomination of the coin C that has arrived at the second distribution section D2 is equal to the other of the two designated or target denominations (e.g., 50 cents) for the second distribution section D2, the distribution flap 70 provided in this section D2 is pivoted downward by the relevant solenoid 72 to the second switched position A2 (see FIG. 25) from the default position A0 (see FIG. 23). Thus, the gate 76*a* of the path 76 disposed in this section D2 is opened, as shown in FIG. 40. For this reason, the said coin C thus arrived drops through the said gate 76*a* to the inside of the main body 61. Thereafter, the said coin C is guided by the first side face 70*a* of the said distribution flap 70 and the second chute 81 disposed below the said distribution flap 70 and as a result, stored in the front hopper 84 provided for this section D2.

The fact that the said coin C has dropped through the said gate 76*a* to pass through the second chute 81 in the second distribution section D2 is detected by the operation of the dropping coin sensor 69 provided in this section D2. The fact that the said coin C has not been conveyed on the path 76 toward the third distribution section D3 is detected by the non-operation of the moving coin sensor 68 which is disposed at the position immediately after the second distribution section D2. These two facts thus detected are notified to the control device (the control program) of the aforementioned main apparatus (e.g., the coin depositing/dispensing apparatus).

A coin C that has passed through the second distribution section D2 on the coin conveyance path 76 arrives at the entrance of the third distribution section D3. This arrival of the coin C is detected by the operation of the moving coin sensor 68 which is disposed at the position immediately before the third distribution section D3.

When the denomination of the coin C thus arrived is not equal to any of the two designated or target denominations (e.g., 5 cents and 10 cents) for the third distribution section D3, the distribution flap 70 provided in this section D3 is kept at the default position A0 (see FIG. 23). Thus, the gate 76*a* of the path 76 disposed in this section D3 is kept closed by the upper end 70*c* of the said distribution flap 70. For this reason, the said coin C that is conveyed on the coin conveyance path 76 does not drop through the said gate 76*a* but passes through the same and then, conveyed on the path 76 toward the fourth distribution section D4.

The fact that the said coin C does not drop through the said gate 76*a* in the third distribution section D3 is detected by the non-operation of the dropping coin sensor 69 which is provided in this section D3. The fact that the said coin C has been conveyed on the path 76 toward the fourth distribution section D4 is detected by the operation of the moving coin sensor 68 which is disposed at the position immediately after the third distribution section D3. These two facts thus detected are notified to the control device (the control program) of the aforementioned main apparatus (e.g., the coin depositing/dispensing apparatus).

When the denomination of the coin C that has arrived at the third distribution section D3 is equal to one of the two designated or target denominations (e.g., 10 cents) for the third distribution section D3, the distribution flap 70 provided in this section D3 is pivoted upward by the relevant solenoid 72 to the first switched position A1 (see FIG. 24) from the default position A0 (see FIG. 23). Thus, the gate 76*a* of the path 76 disposed in this section D3 is opened, as shown in FIG. 39. For this reason, the said coin C thus arrived drops through the said gate 76*a* to the inside of the main body 61. Thereafter, the said coin C is guided by the second side face 70*b* of the said distribution flap 70 and the first chute 80 disposed below the said distribution flap 70 and as a result, stored in the rear hopper 83 provided for this section D3.

The fact that the said coin C has dropped through the said gate 76*a* to pass through the first chute 80 in the third distribution section D3 is detected by the operation of the dropping coin sensor 69 provided in this section D3. The fact that the said coin C has not been conveyed on the path 76 toward the fourth distribution section D4 is detected by the non-operation of the moving coin sensor 68 which is disposed at the position immediately after the third distribution section D3. These two facts thus detected are notified to the control device (the control program) of the aforementioned main apparatus (e.g., the coin depositing/dispensing apparatus).

When the denomination of the coin C that has arrived at the third distribution section D3 is equal to the other of the two designated or target denominations (e.g., 5 cents) for the third distribution section D3, the distribution flap 70 provided in this section D3 is pivoted downward by the relevant solenoid 72 to the second switched position A2 (see FIG. 25) from the default position A0 (see FIG. 23). Thus, the gate 76*a* of the path 76 disposed in this section D3 is opened, as shown in FIG. 40. For this reason, the said coin C thus arrived drops through the said gate 76*a* to the inside of the main body 61. Thereafter, the said coin C is guided by the first side face 70*a* of the said distribution flap 70 and the second chute 81 disposed below the said distribution flap 70 and as a result, stored in the front hopper 84 provided for this section D3.

The fact that the said coin C has dropped through the said gate 76*a* to pass through the second chute 81 in the third distribution section D3 is detected by the operation of the dropping coin sensor 69 provided in this section D3. The fact that the said coin C has not been conveyed on the path 76 toward the fourth distribution section D4 is detected by the non-operation of the moving coin sensor 68 which is disposed at the position immediately after the third distribution section D3. These two facts thus detected are notified to the control device (the control program) of the aforementioned main apparatus (e.g., the coin depositing/dispensing apparatus).

A coin C that has passed through the third distribution section D3 on the coin conveyance path 76 arrives at the entrance of the fourth distribution section D4. This arrival of the coin C is detected by the operation of the moving coin sensor 68 which is disposed at the position immediately before the fourth distribution section D4. The denomination of the coin C thus arrived is equal to any one of the remaining two designated or target denominations (e.g., 1 cent and 2 cents).

When the denomination of the coin C that has arrived at the fourth distribution section D4 is equal to one of the two designated or target denominations (e.g., 2 cents) for the fourth distribution section D4, the distribution flap 70 provided in this section D4 is pivoted upward by the relevant solenoid 72 to the first switched position A1 (see FIG. 24) from the default position A0 (see FIG. 23). Thus, the gate 76*a* of the path 76 disposed in this section D4 is opened, as shown in FIG. 39. For this reason, the said coin C thus arrived drops through the said gate 76*a* to the inside of the main body 61. Thereafter, the said coin C is guided by the second side face 70*b* of the said distribution flap 70 and the first chute 80 disposed below the said distribution flap 70 and as a result, stored in the rear hopper 83 provided for this section D4.

The fact that the said coin C has dropped through the said gate 76*a* to pass through the first chute 80 in the fourth distribution section D4 is detected by the operation of the dropping coin sensor 69 provided in this section D4. The fact that the said coin C has not been conveyed on the path 76 toward the overflow path 75 is detected by the non-operation of the moving coin sensor 68 which is disposed at the position immediately after the fourth distribution section D4. These two facts thus detected are notified to the control device (the control program) of the aforementioned main apparatus (e.g., the coin depositing/dispensing apparatus).

When the denomination of the coin C that has arrived at the fourth distribution section D4 is equal to the other of the two designated or target denominations (e.g., 1 cent) for the fourth distribution section D4, the distribution flap 70 provided in this section D4 is pivoted downward by the relevant solenoid 72 to the second switched position A2 (see FIG. 25) from the default position A0 (see FIG. 23). Thus, the gate 76*a* of the path 76 disposed in this section D4 is opened, as shown in FIG. 40. For this reason, the said coin C thus arrived drops through the said gate 76*a* to the inside of the main body 61. Thereafter, the said coin C is guided by the first side face 70*a* of the said distribution flap 70 and the second chute 81 disposed below the said distribution flap 70 and as a result, stored in the front hopper 84 provided for this section D4.

The fact that the said coin C has dropped through the said gate 76*a* to pass through the second chute 81 in the fourth distribution section D4 is detected by the operation of the dropping coin sensor 69 provided in this section D4. The fact that the said coin C has not been conveyed on the path 76 toward the overflow path 75 is detected by the non-operation of the moving coin sensor 68 which is disposed at the position immediately after the fourth distribution section D4. These two facts thus detected are notified to the control device (the control program) of the aforementioned main apparatus (e.g., the coin depositing/dispensing apparatus).

Figure 45:
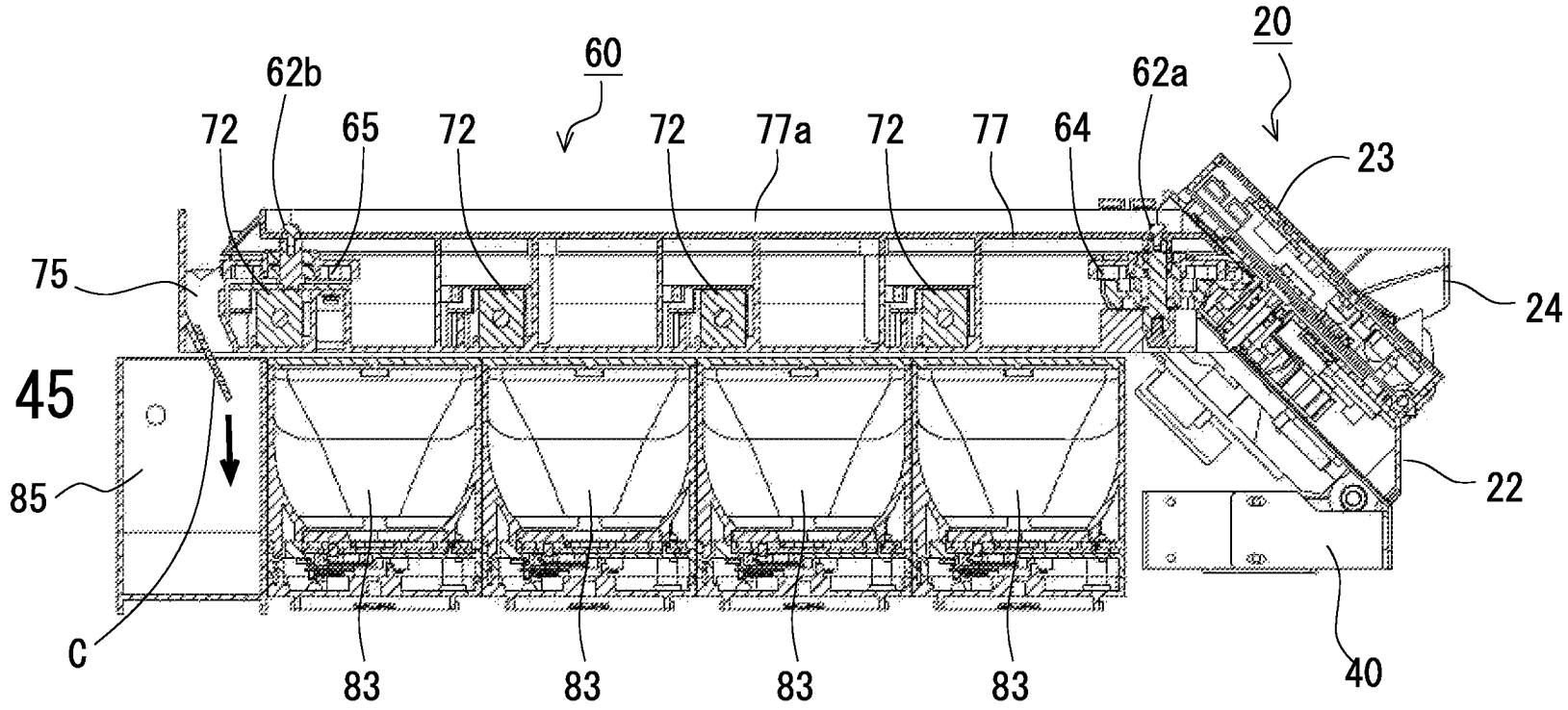
FIG. 45 is a cross-sectional view along the line L3 in FIG. 21 showing the distribution operation of the overflowed coin toward the overflowed coin receiving container in the coin conveyance and distribution unit of the apparatus of FIG. 1, in which the relevant coin is being dropped toward the overflowed coin receiving container from the overflow path, which is subsequent to FIG. 44.

When the quantity of coins C that have been thrown into the apparatus 1 of this embodiment exceed the processable quantity (the process limitation) of the apparatus 1, it is judged that the apparatus 1 is in the overflow state. In this case, regarding the coins C (which are termed "overflown coins") that arrive at the coin conveyance and distribution unit 60 after the processable quantity is reached, all the gates 76*a* provided in the first to fourth distribution sections D1 to D4 of the unit 60 are kept in the closed state by the upper ends 70*c* of the corresponding distribution flaps 70. For this reason, the overflown coins C do not drop respectively through the relevant gates 76*a* which are respectively provided in the sections D1 to D4 but passes through the same and then, are conveyed on the coin conveyance path 76 to the overflow path 75 which is provided at the terminal end of the path 76. Subsequently, the overflown coins C drop toward the overflown coin collecting container 85 which is provided below the overflow path 75 and stored therein, as shown in FIG. 45.

The fact that the overflown coins C do not drop through the gate 76*a* provided in the fourth distribution section D4 to pass through the same is detected by the non-operation of the dropping coin sensor 69 provided in this section D4. The fact that the said overflown coins C have been conveyed on the path 76 toward the overflow path 75 is detected by the operation of the moving coin sensor 68 which is disposed at the position immediately after the fourth distribution section D4. These two facts thus detected are notified to the control device (the control program) of the aforementioned main apparatus (e.g., the coin depositing/dispensing apparatus).

Advantageous Effects of Apparatus for Discriminating and Conveying Coins

With the apparatus 1 for discriminating and conveying coins according to the embodiment of the present invention, as explained above in detail, the coin separation and discrimination unit 20 comprises the coin separation section that is configured to separate coins C stored in the coin storage unit 10 from each other to deliver the coins C thus separated in the predetermined attitude; and the coin discrimination section, which is mounted on the upper wall 22*a* of the casing 22 having the through hole 22*d*, that is configured to discriminate the denomination and authenticity of the coins C sent from the coin separation section to deliver the coins C thus discriminated. The coin conveyance and distribution unit 60 is configured to distribute the coins C which have been subjected to the denomination and authenticity discrimination in the coin discrimination section according to the respective denominations during conveyance. Moreover, when seeing the moving state or flow of the coins C macroscopically, the coins C separated in the coin separation section of the unit 20 are moved in the X direction shown in FIG. 9 in the horizontal plane and then, delivered to the coin discrimination section of the unit 20 through the first delivery region P1. The coins C whose denomination and authenticity have been discriminated in the coin discrimination section of the unit 20 are moved in the Y direction shown in FIG. 9 which is perpendicular to the X direction in the horizontal plane and then, delivered to the coin conveyance and distribution unit 60 through the second delivery region P2. This means that the coins C to be processed are sent to the coin conveyance and distribution unit 60 from the coin separation and discrimination unit 20 after changing their moving direction by 90° in the horizontal plane.

In the coin conveyance and distribution unit 60, each of the second, third, and fourth distribution sections D2, D3, and D4 is configured to distribute coins C into their corresponding two denominations using the distribution flap 70 which serves as the single gate member and which is driven by the distribution flap driving solenoids 72. Thus, the size of each of the second to fourth distribution sections D2 to D4 is smaller than that of the conventional distribution section disclosed in the aforementioned Publication No. 4997374 and Publication No. 2018-198010 where coins are distributed into their two denominations using two gate members.

Moreover, the first distribution section D1 is configured to distribute coins C into their three denominations using the rejection flap 71 which serves as the second gate member and which is driven by the rejection flap driving solenoid 73 in addition to the distribution flap 70 which serves as the first gate member and which is driven by the distribution flap driving solenoids 72. Thus, the size of the first distribution section D1 is larger than that of each of the second to fourth distribution sections D2 to D4. However, even so, the size of the first distribution section D1 is smaller than that of the conventional distribution section disclosed in the aforementioned Publication No. 4997374 and Publication No. 2018-198010 where the rejection flap 71 which serves as the second gate member and which is driven by the rejection flap driving solenoid 73 is added to the aforementioned two gate members.

Accordingly, the length Lx60 of the coin conveyance and distribution unit 60 in the X direction in FIG. 9 including the first to fourth distribution sections D1 to D4 each having the aforementioned structure and function and the length Ly60 of the unit 60 in the Y direction in FIG. 9 can be reduced compared with those of the conventional structures disclosed in the aforementioned Publication No. 5760233 and Publication No. 2019-057269 where the coin distribution of a single denomination is carried out in each distribution unit, and with those of the conventional structures disclosed in the aforementioned Publication No. 4997374 and Publication No. 2018-198010 where the coin distribution of two denominations is carried out using two gate members in each distribution unit. As a result, the overall size (i.e., the X-direction length Lx1 and the Y-direction length Ly1) of the apparatus 1 for discriminating and conveying coins according to the embodiment of the present invention can be reduced compared with these conventional structures through the overall size reduction of the coin conveyance and distribution unit 60. This means that the recent requirement for downsizing and/or space saving of the apparatus 1 according to the embodiment of the present invention can be easily met by reducing the size of each of the distribution sections.

Furthermore, with the apparatus 1 according to the embodiment of the present invention, as already described in "RELATIONSHIP BETWEEN MOVING DIRECTIONS OF COINS IN TWO UNITS", the X-direction length Lx20 of the coin separation and discrimination unit 20 is expressed as Lx20÷D26+D27 and the Y-direction length Ly20 of the same unit 20 is expressed as Ly20÷0.7×D27 using the diameter D26 of the rotary disk 26 and the diameter D27 of the rotary wiper 27. Thus, the Y-direction length Ly20 of the unit 20 is smaller than a half (½) of the X-direction length Lx20 thereof. Accordingly, with the apparatus 1 of this embodiment, the Y-direction length Ly20 of the coin separation and discrimination unit 20 can be made considerably smaller than that of the conventional structure disclosed in the aforementioned Publication No. 5760233 where the macroscopic moving direction of coins in the coin separation and discrimination unit and that in the coin conveyance and distribution unit are the same. This means that the Y-direction length of the coin separation and discrimination unit 20 can be reduced in addition to the overall size reduction of the coin conveyance and distribution unit 60 in the apparatus 1, which arises an advantageous effect that further downsizing and/or space saving of the overall size (i.e., the X-direction length Lx1 and the Y-direction length Ly1) of the apparatus 1 can be realized.

In addition, the necessity for arranging the coin conveyance and distribution unit 60 so as to be perpendicular to the coin separation and discrimination unit 20 in a horizontal plane is (i) to change the moving direction of coins C to the Y direction from the X direction by way of the through hole 22*d* of the upper wall 22*a* and the opening 21*a* of the base plate 21 in the second delivery region P2, and (ii) to additionally provide the direction changing member 74 between the coin discrimination section of the unit 20 and the coin conveyance and distribution unit 60 only. Thus, it is unnecessary to change the basic structure of the coin discrimination section. Accordingly, the aforementioned downsizing and/or space saving of the apparatus 1 can be realized with a simple and low-cost structure.

Further in addition, with the apparatus 1 according to this embodiment, the X-direction length Lx20 of the coin separation and discrimination unit 20 is slightly larger than the case where the coin separation and discrimination unit 20 and the coin conveyance and distribution unit 60 are aligned in the Y direction. Thus, the X-direction length Lx1 of the apparatus 1 also is slightly larger than the said case. However, the manufacturer can effectively and easily cope or deal with the said slight enlargement of the X-direction length Lx1 of the apparatus 1 through an appropriate modification to the main apparatus (e.g., the coin depositing/dispensing apparatus) into which the apparatus 1 is incorporated. Accordingly, there arises no problem due to the said slight enlargement of the X-direction length Lx1.

Advantageous Effects of Coin Distribution Mechanism

Next, the advantageous effects of the coin distribution mechanism according to the embodiments of the present invention, which is provided in each of the first to fourth distribution sections D1 to D4 in the coin conveyance and distribution unit 60 of the apparatus 1 according to the embodiment of the present invention, will be described below.

The coin distribution mechanism incorporated into each of the first to fourth distribution sections D1 to D4 comprises

- the coin conveyance path 76 having the gate 76*a* for dropping coins C;
- the distribution flap 70 (which serves as the first gate member) that is placed below the gate 76*a* in a vicinity of the coin conveyance path 76 and that is configured to be movable around the pivotable shafts 88; and
- the distribution flap driving mechanism including the solenoids 72 (which serves as the first position switching device) that is configured to switch the position of the distribution flap 70 by moving the distribution flap 70 around the pivotable shafts 88.

The distribution flap 70 is configured to be movable among (i) the default position A0 where the gate 76*a* is closed, (ii) the first switched position A1 where the gate 76*a* is opened to allow a coin C to drop from the coin conveyance path 76 through the gate 76*a*, thereby moving the dropped coin C in the direction toward the relevant rear hopper 83 (i.e., the first direction), and (iii) the second switched position A2 where the gate 76*a* is opened to allow a coin C to drop from the coin conveyance path 76 through the gate 76*a*, thereby moving the dropped coin C in the direction toward the relevant front hopper 84 (i.e., the second direction).

Moreover, (a) when a coin C that is conveyed on the coin conveyance path 76 to be about to reach the gate 76*a* has a denomination equal to one of the relevant two denominations (i.e., the first denomination), the distribution flap 70 is moved from the default position A0 to be located at the first switched position A1 by the solenoids 72 of the distribution flap driving mechanism, thereby allowing the coin C to drop from the coin conveyance path 76 through the gate 76*a* in the first direction toward the relevant rear hopper 83. (b) When a coin C that is conveyed on the coin conveyance path 76 to be about to reach the gate 76*a* has a denomination equal to the other of the relevant two denominations (i.e., the second denomination), the distribution flap 70 is moved from the default position A0 to be located at the second switched position A2 by the solenoids 72 of the distribution flap driving mechanism, thereby allowing the coin C to drop from the coin conveyance path 76 through the gate 76*a* in the second direction toward the relevant front hopper 84. (c) When a coin C that is conveyed on the coin conveyance path 76 to be about to reach the gate 76*a* does not have a denomination equal to any one of the relevant two denominations (unequal to the first denomination nor the second denomination), the solenoids 72 are kept at the default position A0, thereby allowing the coin C to pass through the gate 76*a* without dropping from the coin conveyance path 76 through the gate 76*a*.

In this way, with the coin distribution mechanism according to the embodiment of the present invention, the distribution flap 70, which is placed below the gate 76*a* in the vicinity of the coin conveyance path 76, is configured to be movable by the solenoids 72 of the distribution flap driving mechanism among the default position A0, the first switched position A1, and the second switched position A2. Thus, by switching the position of the distribution flap 70 (i.e., the first gate member) as a single member according to a desired denomination, the moving direction of the coin C that is conveyed on the coin conveyance path 76 to be about to reach the gate 76*a* can be set to drop through the gate 76*a* in the direction toward the relevant rear hopper 83 (i.e., in the first direction), to drop through the gate 76*a* in the direction toward the relevant front hopper 84 (i.e., in the second direction), or to pass through the gate 76*a* without dropping through the gate 76*a*.

Accordingly, two desired denominations of coins C can be distributed by providing the distribution flap 70 as a single gate member and by switching the position of the distribution flap 70 in accordance with the denominations. This means that the same function as that of the conventional coin distribution mechanisms disclosed in the aforementioned Publication No. 4997374 and Publication No. 2018-198010 can be realized using the distribution flap 70 as a single gate member.

Moreover, since the function of distributing coins C of two denominations to move in different directions is realized using the distribution flap 70 as a single gate member, the coin distribution mechanism according to the embodiment of the present invention is simpler in mechanical configuration and driving mechanism than the aforementioned conventional coin distribution mechanisms disclosed in the aforementioned Publication No. 4997374 and Publication No. 2018-198010 where two desired denominations are distributed using two gate members, is easy in reducing the fabrication cost and facilitating the maintenance, and is easy in producing the control program for controlling the solenoids 72 which are included in the distribution flap driving mechanism (i.e., the first position switching device) and version up thereof.

Furthermore, the coin distribution mechanism according to the embodiment of the present invention incorporated into the first distribution section D1 further comprises the rejection flap 71 (i.e., the second gate member) which is provided in a vicinity of the distribution flap 70 and which is movable around the pivotable shafts 91 in addition to the distribution flap 70 (i.e., the first gate member) which is movable around the pivotable shafts 88. Moreover, when the distribution flap 70 is located at the second switched position A2, the rejection flap 71 is configured to allow a coin C that is dropped from the coin conveyance path 76 through the gate 76*a* to move in the third direction (i.e., the direction toward the dispensing belt) which is different from the first direction toward the relevant rear hopper 83 and the second direction toward the relevant front hopper 84. For this reason, there arises an advantageous effect that coins C of three denominations in total (e.g., relevant two denominations and one rejective denomination) can be distributed in this coin distribution mechanism.

In addition, the third denomination is not limited to the rejective denomination. It is needless to say that the third denomination may be any one of authorized denominations other than the denominations to be processed (i.e., the target denominations). In this case, the total number of the target denominations is increased by one and as a result, nine denominations in total can be distributed in the apparatus 1.

Modifications

The aforementioned embodiments are exemplary embodied examples of the present invention. Thus, it is needless to say that the present invention is not limited to these embodiments and any other modification is applicable to the embodiments without departing the spirit of the invention.

For example, in the aforementioned embodiment of the apparatus 1, the rotary disk 26 is used in the coin separation section and the rotary wiper 27 is used in the coin discrimination section; however, the present invention is not limited to this. Any other structure may be used for the coin separation section if it is capable of separating coins C as desired. Any other structure may be used for the coin discrimination section if it is capable of discriminating the denomination and authenticity of coins C as desired.

Moreover, in the aforementioned embodiment of the apparatus 1, (i) the coin conveyance path 76 which is formed by the guide rail 66, the inclined portion 77*a* of the rear cover 77, and the inclined portion 78*a* of the front cover 78, (ii) the endless belt 63 having the pins 63*a* attached thereto at predetermined distances, and (iii) the gates 76*a* formed on the coin conveyance path 76 are used in the coin conveyance and distribution unit 60. However, the present invention is not limited to this. Any other structure may be used for this purpose if it is capable of distributing coins C as desired while being conveyed.

In addition, with the coin distribution according to the aforementioned embodiments, which are respectively incorporated into the first distribution section D1 and each of the second to fourth distribution sections D2 to D4, the distribution flap 70 which is movable around the pivotable shafts 88 and which is driven by the distribution flap driving solenoids 72 is used as the first gate member. However, the present invention is not limited to this. It is needless to say that any other member having a different shape and/or structure from the distribution flap 70 may be used as the first gate member if it is capable of performing the same function as the distribution flap 70. In addition, the means for driving the first gate member also may be optionally modified in accordance with the change applied to the distribution flap 70.

Further in addition, with the coin distribution mechanism according to the aforementioned embodiment which is incorporated into the first distribution section D1, the rejection flap 71 which is movable around the pivotable shafts 91 and which is driven by the rejection flap driving solenoid 73 is used as the second gate member, in addition to the distribution flap 70 as the first gate member and the distribution flap driving solenoids 72 therefor. However, the present invention is not limited to this. It is needless to say that any other member having a different shape and/or structure from the rejection flap 71 may be used as the second gate member if it is capable of performing the same function as the rejection flap 71. In addition, the means for driving the second gate member also may be optionally modified in accordance with the change applied to the rejection flap 71.

INDUSTRIAL APPLICABILITY

The coin distribution mechanism and the apparatus for discriminating and conveying coins according to the present invention are applicable not only to coins as currency but also to coin equivalents such as token and medals. Moreover, the coin distribution mechanism and the apparatus for discriminating and conveying coins according to the present invention are applicable not only to any coin depositing/dispensing apparatus but also to any coin processing apparatus that necessitates selective conveyance and distribution of coins of desired denominations.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A mechanism for distributing coins into their denominations during conveyance, the mechanism comprising:

a coin conveyance path that has a gate for dropping coins and that is configured as having a single predetermined linear conveyance direction;

a first gate member that is placed below the gate in a vicinity of the coin conveyance path and that is configured to be movable around a first axis;

a first position switching device that is configured to switch a position of the first gate member by moving the first gate member around the first axis;

a second gate member that is placed below the gate in a vicinity of the coin conveyance path and that is configured to be movable around a second axis; and a second position switching device that is configured to switch a position of the second gate member by moving the second gate member around the second axis;

wherein the first gate member is configured to be movable among (i) a default position where the gate is closed, (ii) a first switched position where the gate is opened to allow a coin to drop from the coin conveyance path through the opened gate, thereby moving the dropped coin in a first direction, and (iii) a second switched position where the gate is opened to allow a coin to drop from the coin conveyance path through the opened gate, thereby moving the dropped coin in a second direction which is different from the first direction;

when a coin that is conveyed on the coin conveyance path to be about to reach the gate has a predetermined first denomination, the first gate member is moved from the default position to be located at the first switched position by the first position switching device, thereby allowing the coin to drop from the coin conveyance path through the opened gate in the first direction;

when a coin that is conveyed on the coin conveyance path to be about to reach the gate has a predetermined second denomination which is different from the first denomination, the first gate member is moved from the default position to be located at the second switched position by the first position switching device, thereby allowing the coin to drop from the coin conveyance path through the opened gate in the second direction; and when a coin that is conveyed on the coin conveyance path to be about to reach the gate has a denomination unequal to the first denomination nor the second denomination, the first gate member is kept at the default position, thereby allowing the coin to pass through the closed gate without dropping from the coin conveyance path through the gate; and wherein the second gate member is configured to allow a coin that has dropped from the coin conveyance path through the opened gate in a state where the first gate member has been located at the second switched position to move in the second direction or a third direction according to a denomination of the coin, and the third direction is different from the first direction and the second direction.

2. The mechanism according to claim 1, wherein at the default position, the gate is closed by the first gate member in such a way that an end of the first gate member is contacted with the gate;

at the first switched position, the gate is opened in such a way that the end of the first gate member is apart from the gate, and a first face of the first gate member serves as a guiding face for guiding a coin that has dropped through the opened gate in the first direction; and at the second switched position, the gate is opened in such a way that the end of the first gate member is apart from the gate, and a second face of the first gate member serves as a guiding face for guiding a coin that has dropped through the opened gate in the second direction.

3. The mechanism according to claim 1, wherein the first axis for the first gate member is disposed in a vicinity of the gate so as to extend along a conveyance direction of the coin conveyance path; and a moving direction of the first gate member around the first axis when the first gate member is switched to the second switched position from the default position is opposite to a moving direction of the first gate member around the first axis when the first gate member is switched to the first switched position from the default position.

4. The mechanism according to claim 1, wherein a chute member is provided below the first gate member; and the chute member is configured to guide a coin that has dropped through the opened gate toward a desired container when the first gate member is switched to the first switched position or the second switched position from the default position.

5. The mechanism according to claim 1, wherein the first position switching device comprises a reciprocating motion generating device that is configured to reciprocate an operating part in a direction approximately perpendicular to the first axis; and a crank mechanism that is configured to convert a reciprocating motion of the operating part of the reciprocating motion generating device to a pivoting motion around the first axis and to transmit the pivoting motion to the first gate member.

6. The mechanism according to claim 1, wherein the second gate member is configured to be movable between (a) a default position where a moving path for allowing a coin that has dropped from the coin conveyance path through the opened gate to move in the third direction is closed, and (b) a switched position where the moving path is opened;

when a coin that is conveyed on the coin conveyance path to be about to reach the gate has a predetermined third denomination which is different from the first denomination and the second denomination, the first gate member is located at the second switched position by the first position switching device and the second gate member is located at the switched position by the second position switching device, thereby allowing the coin that has dropped from the coin conveyance path through the opened gate to move through the moving path in the third direction; and when a coin that is conveyed on the coin conveyance path to be about to reach the gate has the second denomination, the first gate member is located at the second switched position by the first position switching device and the second gate member is located at the default position by the second position switching device, thereby allowing the coin that has dropped from the coin conveyance path through the opened gate to move in the second direction.

7. The mechanism according to claim 6, wherein a rejective denomination is designated as the third denomination;

when a coin that is conveyed on the coin conveyance path to be about to reach the gate has the rejective denomination, the first gate member is located at the second switched position and the second gate member is located at the switched position, thereby allowing the coin to drop from the coin conveyance path through the opened gate to be discharged through the moving path to an outside of an apparatus that comprises the said mechanism.

8. The mechanism according to claim 1, wherein the first gate member is configured to be pivotable around the first axis.

9. The mechanism according to claim 1, wherein the first gate member is configured to be pivotable around the first axis;

the first position switching device comprises a reciprocating motion generating device that is configured to reciprocate an operating part in a direction approximately perpendicular to the first axis; and the operating part is configured to selectively take one of a middle position where the first gate member is located at the default position, a protruded position where the first gate member is located at the first or second switched position, and a retracted position where the first gate member is located at the second or first switched position.

10. The mechanism according to claim 1, wherein the coin conveyance path is formed by a guide rail, an inclined portion of a front cover, and an inclined portion of a rear cover;

the guide rail forms a bottom of the coin conveyance path, the inclined portion of the front cover forms a front cover of the coin conveyance path, and the inclined portion of the rear cover forms a rear cover of the coin conveyance path;

the gate is formed by an opening which is formed in the guide rail; and a coin is conveyed on the guide rail in an inclined standing state while being contacted with the guide rail and the inclined portion of the front cover or the rear cover; and is dropped through the opening of the guide rail when the first gate member is located at the first switched position or the second switched position.

11. The mechanism according to claim 1, further comprising an incoming coin sensor that is configured to detect presence or absence of introduction of a coin into the coin conveyance path;

a moving coin sensor that is configured to detect presence or absence of arrival of a coin that is being conveyed on the coin conveyance path at the gate; and a dropping coin sensor that is configured to detect presence or absence of dropping of a coin through the opened gate from the coin conveyance path.

12. The mechanism according to claim 1, wherein the second gate member is configured to be pivotable around the second axis.

13. The mechanism according to claim 1, wherein the second gate member is configured to be pivotable around the second axis;

the second position switching device comprises a reciprocating motion generating device that is configured to reciprocate an operating part in a direction approximately perpendicular to the second axis; and the operating part is configured to selectively take one of a first position where the second gate member is located at the default position, and a second position where the second gate member is located at the switched position.

14. An apparatus for discriminating and conveying coins, comprising:

one or more distribution sections mounted in a coin conveyance and distribution unit;

wherein any one of the one or more distribution sections comprises the mechanism according to claim 1.

15. The apparatus according to claim 14, wherein in a plan view, a macroscopic moving direction of coins to be processed in the coin conveyance and distribution unit has an approximately orthogonal relationship to a macroscopic moving direction of the coins to be processed in a coin separation and discrimination section unit.

* * * * *